US005756917A

United States Patent [19]

Watanabe et al.

[11] Patent Number: 5,756,917

[45] Date of Patent: May 26, 1998

[54] AUTOMATIC ACCOMPANIMENT DEVICE CAPABLE OF SELECTING A DESIRED ACCOMPANIMENT PATTERN FOR PLURAL ACCOMPANIMENT COMPONENTS

[75] Inventors: Kunihiko Watanabe; Masao Sakama; Yutaka Tohgi; Hiroyuki Ohba; Eiichiro Aoki; Shigehiko Mizuno, all of Hamamatsu, Japan

[73] Assignee: Yamaha Corporation, Japan

[21] Appl. No.: 423,149

[22] Filed: Apr. 17, 1995

[30] Foreign Application Priority Data

Apr. 18, 1994 [JP] Japan ..... 6-101684
Jul. 25, 1994 [JP] Japan ..... 6-192284

[51] Int. Cl.[6] ..... G10H 1/36; G10H 7/00

[52] U.S. Cl. ..... 84/634; 84/635

[58] Field of Search ..... 84/609.611, 634, 84/635, 649–651

[56] References Cited

U.S. PATENT DOCUMENTS 4,685,370 8/1987 Okuda et al. ..... 84/611 X
4,887,503 12/1989 Suzuki ..... 84/613
5,085,118 2/1992 Sekizuka ..... 84/637 X
5,369,217 11/1994 Yamashita et al. ..... 84/611
5,457,282 10/1995 Miyamoto et al. ..... 84/634
5,461,192 10/1995 Imaizumi ..... 84/634

*Primary Examiner*—William M. Shoop, Jr.
*Assistant Examiner*—Jeffrey W. Donels
*Attorney, Agent, or Firm*—Graham & James LLP

[57] ABSTRACT

A pattern memory stores plural accompaniment patterns for each of plural accompaniment components, and each of the accompaniment components is composed of one or more musical instrument parts. An operator is provided for selecting a desired accompaniment pattern for each of the components, and the accompaniment patterns correspond, in accordance with a predetermined rule, to different possible manners in which the operator is actuated, so that a specific accompaniment pattern corresponding to a manner in which the operator is actually actuated. A new accompaniment pattern is registered into the pattern memory in accordance with the predetermined rule. Information indicative of the predetermined rule may be shown on a display. The pattern memory may store accompaniment patterns for each of plural different accompaniment styles, and specific accompaniment patterns may by shared between the accompaniment styles. There are proposed various variations to select a desired accompaniment pattern for each accompaniment component. Further, it is also possible to selectively read out a predetermined part of a specific accompaniment pattern and to set such a condition to prevent a specific accompaniment from being read out. Moreover, it is possible to read out a specific accompaniment pattern which satisfies a predetermined retrieval condition or which is close to a desired accompaniment pattern. It is also possible to read out plural accompaniment patterns in sequence for sequential reproductive performance.

26 Claims, 25 Drawing Sheets

| ROCK MUSIC PATTERN TABLE | | | DISCO MUSIC PATTERN TABLE | | |
|---|---|---|---|---|---|
| ADDRESS | HEAD ADDRESS | COMPLEXITY | ADDRESS | HEAD ADDRESS | COMPLEXITY |
| 1 | A − 1 | 5 | 1 | B − 1 | 10 |
| 2 | A − 2 | 7 | 2 | B − 2 | 14 |
| 3 | A − 3 | 10 | 3 | C − 1 | 22 |
| 4 | C − 1 | 11 | 4 | B − 3 | 25 |
| 5 | A − 4 | 16 | 5 | C − 2 | 26 |
| 6 | C − 2 | 20 | 6 | C − 3 | 30 |
| ⋮ | ⋮ | ⋮ | ⋮ | ⋮ | ⋮ |
| n | A − n | 95 | n | B − n | 91 |

| ROCK MUSIC PATTERN TABLE | | | DISCO MUSIC PATTERN TABLE | | |
|---|---|---|---|---|---|
| ADDRESS | HEAD ADDRESS | COMPLEXITY | ADDRESS | HEAD ADDRESS | COMPLEXITY |
| 1 | A − 1 | 5 | 1 | B − 1 | 10 |
| 2 | A − 2 | 7 | 2 | B − 2 | 14 |
| 3 | A − 3 | 10 | 3 | C − 1 | 22 |
| 4 | C − 1 | 11 | 4 | B − 3 | 25 |
| 5 | A − 4 | 16 | 5 | C − 2 | 26 |
| 6 | C − 2 | 20 | 6 | C − 3 | 30 |
| ⋮ | ⋮ | ⋮ | ⋮ | ⋮ | ⋮ |
| n | A − n | 95 | n | B − n | 91 |

| COMPONENT | SELECTED PATTERN |
|---|---|
| BD+SD | 80 |
| Tom | 20 |
| HH | 45 |
| CY | — |
| ⋮ | |

Search-template = ((0 480 960 1440)(0 240 360 480)(20 20 20 20)); Replace-template = ((0 160 320)(001)(011))

Search-template = ((0 480 960 1440)(0 240 360 480)(20 20 20 20)); Replace-template = ((0 160 320)(001)(011))
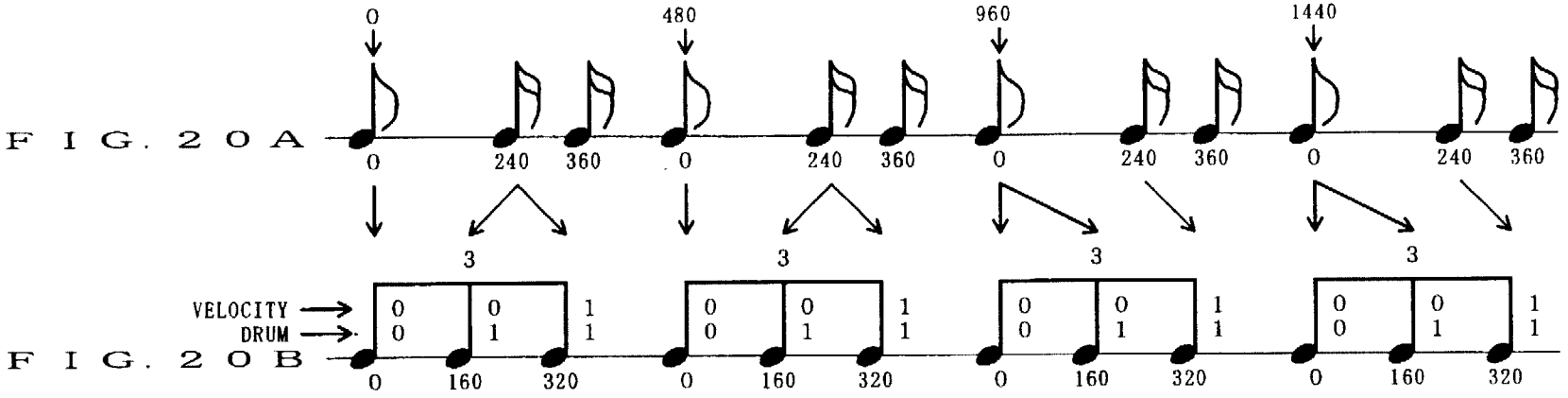
FIG. 20A
FIG. 20B
Search-template = ((0 480 960 1440)(0 240 360 480)(20 20 20 20)); Replace-template = ((0 160 320)(001)(***))
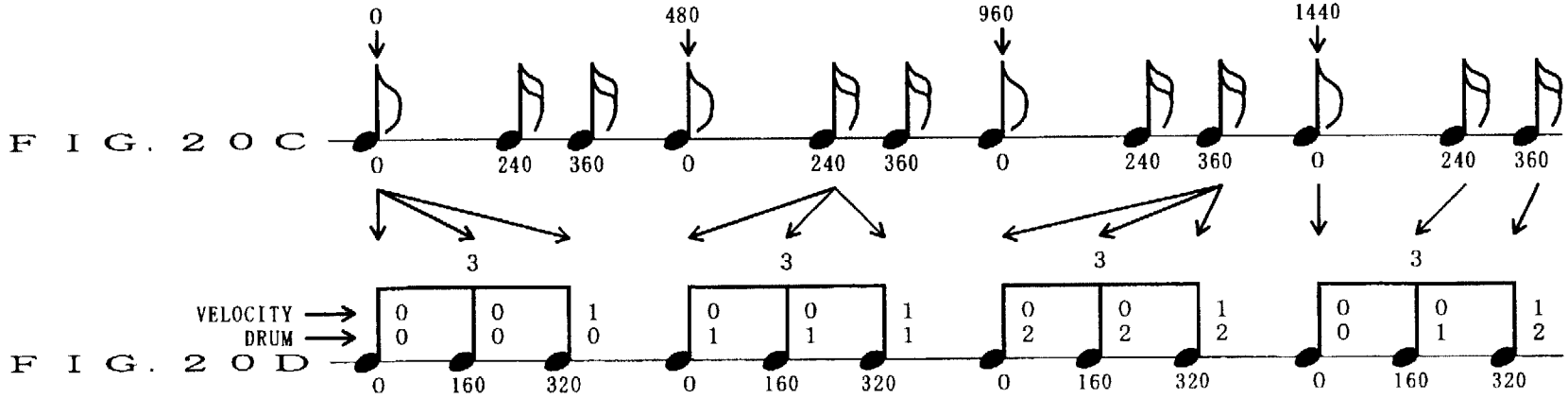
FIG. 20C
FIG. 20D

| ROCK MUSIC PATTERN TABLE | | | |
|---|---|---|---|
| ADDRESS | HEAD ADDRESS | COMPLEXITY | AVAIL. / UNAVAIL. |
| 1 | A − 1 | 5 | AVAIL. |
| 2 | A − 2 | 7 | AVAIL. |
| 3 | A − 3 | 10 | UNAVAIL. |
| 4 | C − 1 | 11 | AVAIL. |
| 5 | A − 4 | 16 | UNAVAIL. |
| 6 | C − 2 | 20 | AVAIL. |
| ⋮ | ⋮ | ⋮ | ⋮ |
| n | A − n | 95 | AVAIL. |

| DISCO MUSIC PATTERN TABLE | | | |
|---|---|---|---|
| ADDRESS | HEAD ADDRESS | COMPLEXITY | AVAIL. / UNAVAIL. |
| 1 | B − 1 | 10 | AVAIL. |
| 2 | B − 2 | 14 | AVAIL. |
| 3 | C − 1 | 22 | UNAVAIL. |
| 4 | B − 3 | 25 | AVAIL. |
| 5 | C − 2 | 26 | UNAVAIL. |
| 6 | C − 3 | 30 | AVAIL. |
| ⋮ | ⋮ | ⋮ | ⋮ |
| n | B − n | 91 | AVAIL. |

AUTOMATIC ACCOMPANIMENT DEVICE CAPABLE OF SELECTING A DESIRED ACCOMPANIMENT PATTERN FOR PLURAL ACCOMPANIMENT COMPONENTS

BACKGROUND OF THE INVENTION

The present invention generally relates to an automatic accompaniment device which is applicable to automatic rhythm performance and other forms of automatic accompaniment, and more particularly to such a device which is capable of making and changing accompaniment patterns with utmost ease.

For providing automatic accompaniment patterns desired by users, the prior art automatic accompaniment devices typically depend on an approach of selecting any of plural accompaniment patterns that are stored in memory in advance. However, this approach has the disadvantage that only a limited number of accompaniment patterns can be selected. Namely, in this type of prior art automatic accompaniment devices, the number of accompaniment patterns that can be stored in memory is so limited that it is only allowed to merely select as close patterns as possible to what the user actually desires. Thus, more often than not, accompaniment patterns can not be provided which are truly satisfactory to the user.

So, as an approach for freely making automatic accompaniment patterns in accordance with the user's desire, it has been proposed to data that desired accompaniments patterns are sampled or formed and stored into memory by the user manually playing a keyboard of electronic musical instrument etc. in an arbitrary manner. In this way, automatic accompaniment can be performed by reading out the accompaniment patterns stored in the memory. Nevertheless, this approach also has the problem that it is difficult, if not impossible, to make proper accompaniment patterns unless the user has enough musical knowledge and performance skill. Besides, even where the user has enough knowledge and performance skill, it often takes a considerable amount of time and labor to make accompaniment patterns, and this renders it very difficult to make accompaniment patterns as desired by the user.

U.S. Pat. No. 4,685,370 discloses a solution for facilitating the rhythm performance pattern making. According to the disclosure, plural patterns are stored in advance for each percussive tone source in such a manner that a desired pattern is selected for each of the tone source, so that a desired rhythm performance pattern as a whole can be provided by a combination of the selected patterns for the respective percussive tone sources. But, with this disclosed technique, it is necessary to make separate selections of the percussive tone source and pattern, which is very troublesome and time-consuming. The disclosed technique also has the problem of poor operability and is not satisfactory in that variation of performance patterns provided by the combination of the stored patterns is quite limited. Further, since selection can be made only from the stored patterns, it is not possible to create accompaniment patterns freely at the user's will.

SUMMARY OF THE INVENTION

Therefore, it is an object of the present invention to provide an automatic accompaniment device which is capable of making and changing accompaniment patterns with utmost ease no matter how complex the accompaniment patterns may be.

To achieve the above-mentioned object, the present invention provides an automatic accompaniment device which comprises an accompaniment pattern storage section for storing plural accompaniment patterns for each of plural accompaniment components, each of the components being composed of one or more musical instrument parts for an accompaniment performance, a selection section for, for each of the components, selecting a desired accompaniment pattern from among the plural accompaniment patterns, the selection section including a selecting operator, a readout section for reading out, from the accompaniment pattern storage section, the accompaniment pattern of any of the components selected by the selection section, wherein the plural accompaniment patterns of each of the components correspond, in accordance with a predetermined rule, to different possible operated modes of the operator, and the readout section selectively reads out one of the accompaniment patterns that corresponds to an actually operated mode of the operator, an accompaniment tone generation section for generating automatic accompaniment tone on the basis of the accompaniment pattern read out by the readout section, and a write section for registering a desired accompaniment pattern into the accompaniment pattern storage section in accordance with the predetermined rule.

Each of the accompaniment components is composed of one or more musical instrument parts for an automatic performance, and for example, interrelated plural instrument parts (snare drum and bass drum, ride cymbal and high hat, etc.) may compose such an accompaniment component. The user can select a desired accompaniment pattern of a desired component by use of the selection section, at which time the accompaniment pattern is selected on the basis of the actually operated mode of the selecting operator (i.e., manner in which the selecting operator is actually operated) in accordance with a predetermined rule. That is, plural accompaniment patterns of the selected component correspond to different possible operated modes of the selecting operator in the predetermined rule, and the readout means selectively reads out a specific accompaniment pattern that corresponds to the actually operated mode of the operator. The thus-selected accompaniment pattern is read out from the accompaniment pattern storage section (data base in the later-described embodiments), so that automatic accompaniment tone is generated on the basis of the accompaniment pattern.

As conventionally known, a desired rhythm name, accompaniment style or category is selectable via a switch or other suitable section. One typical form of application of the present invention may be an application in the course of reproductive performance of all accompaniment patterns for the selected rhythm name, accompaniment style or category. Namely, by designating desired one of the components and then operating the selecting operator in a desired mode or manner (e.g., strongly or weakly), an automatic accompaniment pattern corresponding to the actually operated mode of the operator is automatically selected, and the accompaniment pattern having been so far performed for the designated component is replaced with the thus-selected accompaniment pattern. In another form of application of the present invention, an accompaniment pattern is selected in the above-mentioned manner for each of the components constituting accompaniment patterns for a specific rhythm name, accompaniment style or category, and combination of the accompaniment patterns selected for the individual components provide the overall accompaniment performance pattern for the entire rhythm name, accompaniment style or category.

The accompaniment pattern selected for each component is a pattern of one or more musical instruments corresponding to the component. Accordingly, the user can select, for each component, a specific accompaniment pattern from among a number of accompaniment patterns provided in the data base section in an optimum condition and hence can advantageously select an optimum accompaniment pattern.

The present invention may further comprises the write section for registering a desired accompaniment pattern into the accompaniment pattern storage section in accordance with the predetermined rule. Namely, in the case where a new accompaniment pattern is to be additionally registered into the accompaniment storage section (i.e., data base in the later-described embodiments) or an existing accompaniment pattern in the storage section is to be renewed, the relation between accompaniment patterns of a specific component according to the predetermined rule may change (for example, if a first accompaniment pattern has a first degree of complexity and a second accompaniment pattern to be renewed has a second degree of complexity greater than the first degree of complexity, the interrelation according to the predetermined rule will change). In consideration of this, the write section registers the desired accompaniment pattern in accordance with the predetermined rule. Consequently, in such a case where appropriate modification has been applied to the accompaniment pattern read out from the pattern storage section (data base), the modified accompaniment pattern can be additionally registered into the accompaniment pattern storage section (data base) as a new accompaniment pattern or renewedly registered into the storage section by means of the write section. As the result, the pattern selection range can be significantly broadened so that it is allowed to select and set more complicated patterns with increased ease. Further, because a desired accompaniment pattern is additionally or renewedly registered in accordance with the predetermined rule, the readout section can, without requiring any particular process, selectively read out the thus-written accompaniment pattern as an pattern corresponding to the actually-operated mode of the selecting operator.

As an example, the predetermined rule may be one corresponding to the degrees of complexity of the accompaniment patterns, or may be one corresponding to the degrees of furiousness or ride of the accompaniment patterns.

An automatic accompaniment device according to one mode of embodiment of the invention may be arranged in such a manner that the accompaniment pattern storage section includes an accompaniment pattern storage area for storing the plural accompaniment patterns, and an arrangement order storage area for storing arrangement order information to be used for arranging the plural accompaniment patterns in accordance with the predetermined rule, and that the readout section, by referring to the arrangement order storage area in response to operation of the operator, selects one of the accompaniment patterns corresponding to the actually-operated mode of the operator.

The automatic accompaniment device may further comprise a display section for displaying information indicative of the predetermined rule for the accompaniment pattern read out by the readout section. In this example, the information indicative of the predetermined rule is the degrees of complexity, furiousness, ride or other kind of order of the accompaniment patterns and may be determined on the basis of various factors such as the number of notes and event occurrence states in the individual accompaniment patterns. Consequently, by only looking at the information indicative of the predetermined rule displayed on the display section, the user can readily recognize the degrees of complexity, furiousness, ride or the like of the read out accompaniment pattern. Such information may be displayed on the display on numerical values or in graphic form.

An automatic accompaniment device according to another aspect of the present invention comprises an accompaniment pattern storage section for storing plural accompaniment patterns for each of plural accompaniment components belonging to plural accompaniment styles, each of the components being composed of one or more musical instrument parts for an accompaniment performance, one or more of the accompaniment patterns stored in the accompaniment pattern storage section being shared between the plural accompaniment styles, a selection section for, for each of the components, selecting a desired accompaniment pattern from among the plural accompaniment patterns, the selection section including a selecting operator, a readout section for reading out, from the accompaniment pattern storage section, the accompaniment pattern of any of the components selected by the selection section, wherein the plural accompaniment patterns of each component correspond, in accordance with a predetermined rule, to different possible operated modes of the operator, and the readout section selectively reads out one of the accompaniment patterns that corresponds to an actually operated mode of the operator, and an accompaniment tone generation section for generating automatic accompaniment tone on the basis of the accompaniment pattern read out by the readout section.

If, in order to make accompaniment patterns for plural accompaniment categories, styles or rhythm names, individual accompaniment patterns for all the accompaniment styles are separately stored, the data amount stored will become enormous. Hence, the accompaniment pattern storage section in the present invention stores plural accompaniment patterns for each of plural accompaniment components (each component is composed of one or more musical instrument parts) belonging to the accompaniment styles (e.g., rock, disco and waltz), in such a manner that specific ones of the accompaniment patterns are shared among the accompaniment styles. This can effectively reduce the necessary overall data storage amount. For example, where some accompaniment patterns can be shared between rock music and disco music, these patterns are stored in the accompaniment pattern storage section for shared use by the rock music and disco music. By thus storing the accompaniment patterns for shared use, the necessary data storage amount in the accompaniment pattern storage section can be reduced to a considerable degree.

An automatic accompaniment device according to still another aspect of the present invention comprises an accompaniment pattern storage section for storing plural accompaniment patterns for each of plural accompaniment components, each of the components being composed of one or more musical instrument parts for an accompaniment performance, a component designating operators for designating desired one of the components, a pattern selecting operator provided separately from the component designating operators, for selecting desired one of the plural accompaniment patterns of the component designated by any of the component designating operators, a readout section for reading out, from the accompaniment pattern storage section, the accompaniment pattern corresponding to operation of the component designating operator and pattern selecting operator, and an accompaniment tone generation section for generating automatic accompaniment tone on the basis of the accompaniment pattern read out by the readout section.

The combined use of any of the component designating operators and the pattern selecting operator makes it possible to select a desired accompaniment pattern of a desired component. The pattern selecting operator may be a sliding operator, rotating operator such as a wheel, or multidimensional operator such as a joystick or the like which is capable of outputting successively varying values as it is operated in a successive manner. This facilitates finer selection of a desired accompaniment pattern. These operators vary in their output values in a gradual manner and hence allow a desired accompaniment pattern to be efficiently selected from among a great number of accompaniment patterns stored in the accompaniment pattern storage section.

An automatic accompaniment device according to still another aspect of the present invention comprises an accompaniment pattern storage section for storing plural accompaniment patterns for each of plural accompaniment components, each of the components being composed of one or more musical instrument parts for an accompaniment performance, a selecting operator for selecting desired one of the accompaniment patterns for each of the components, the selecting operator outputting a pattern selection signal by being operated, a readout section for reading out, from the accompaniment pattern storage section, one of the accompaniment patterns for each of the components on the basis of the pattern selection signal output from the selecting operator, wherein the pattern selection signal being used as a relative value, and current pattern selection information is created by performing arithmetic operation between a value of last pattern selection information created when one of the accompaniment patterns was selected last and a value of the current pattern selection signal, the one of the accompaniment patterns being selected on the basis of the current pattern selection information, and an accompaniment tone generation section for generating automatic accompaniment tone on the basis of the accompaniment pattern read out by the readout section.

The last pattern selection information created when an accompaniment pattern was selected last is absolute value information, and by adding or subtracting the current pattern selection signal, as a relative value, to or from the last pattern selection information value, current pattern selection information is created. Thus, it will be readily recognized in what degree the current pattern selection information is different (for instance, in degree of complexity) from the last pattern selection information, and this will prove very convenient in editing and making accompaniment pattern.

An automatic accompaniment device according to still further aspect of the present invention comprises an accompaniment pattern storage section for storing plural accompaniment patterns for each of plural accompaniment components, each of the components being composed of one or more musical instrument parts for an accompaniment performance, a setting section for setting, as unavailable for readout, any of the accompaniment patterns stored in the storage section, a selection section for selecting desired one of the accompaniment patterns for each of the components, a readout section for reading out, from the accompaniment pattern storage section, the accompaniment pattern selected by the selection section, the readout section being controlled so as not to read the accompaniment pattern set as unavailable for readout by the setting section, and an accompaniment tone generation section for generating automatic accompaniment tone on the basis of the accompaniment pattern read out by the readout section.

The above-mentioned accompaniment device is designed in such a manner that predetermined accompaniment patterns of those stored in the accompaniment pattern storage section are not read out by the readout section. This design forecloses the inconvenience that a real-time automatic accompaniment is performed with an undesired accompaniment pattern, and it is therefore allowed to provide a performance exactly as desired by the user.

An automatic accompaniment device according to still further aspect of the present invention comprises an accompaniment pattern storage section for storing plural accompaniment patterns for each of plural accompaniment components, each of the components being composed of one or more musical instrument parts for an accompaniment performance a selection section for selecting desired one of the accompaniment patterns for each of the components, a designation section for designating a predetermined part in the accompaniment pattern selected by the selection section, a readout section for reading out, from the accompaniment pattern storage section, the desired accompaniment pattern in correspondence to selection of the selection section and designation of the designation section, and an accompaniment tone generation section for generating automatic accompaniment tone on the basis of the accompaniment pattern read out by the readout section.

By designating a specific part (range) of the selected accompaniment pattern, a partial change, replacement or removal of the accompaniment pattern can be much facilitated. For instance, the user may designate a specific one of plural drum sounds constituting the selected accompaniment pattern, or a specific part (range) of the accompaniment pattern. By such capability to designate a specific part of the selected accompaniment pattern, only a part preferred by the user can be added or selected, and thus it is possible to highly enhance freedom in making accompaniment patterns.

An automatic accompaniment device according to still another aspect of the present invention comprises an accompaniment pattern storage section for storing plural accompaniment patterns for each of plural accompaniment components, each of the components being composed of one or more musical instrument parts for an accompaniment performance, a selection section for selecting desired one of the accompaniment patterns for each of the components, a readout section for reading out, from the accompaniment pattern storage section, the accompaniment pattern selected by the selection section, a replacement section for replacing a predetermined percussion instrument sound of plural percussion instrument sounds constituting the accompaniment pattern read out by the readout section, with another percussion instrument sound, and an accompaniment tone generation section for generating automatic accompaniment tone on the basis of the accompaniment pattern that is read out by the readout section and has the predetermined percussion instrument sound replaced with the other percussion instrument sound.

In such a case where specific one of plural drum sounds constituting an accompaniment pattern has been replaced with another drum sound, and the user likes the sounding pattern of the drum sound but does not like its tone color, the accompaniment device arranged in the above-mentioned manner can replace the tone color with another. This will also highly enhance freedom in making accompaniment patterns and permit an accompaniment pattern exactly as imaged by the user to be selected easily at a faster speed.

An automatic accompaniment device according to still another aspect of the present invention comprises an accompaniment pattern storage section for storing plural accompaniment patterns for each of plural accompaniment components, each of the components being composed of one or more musical instrument parts for an accompaniment performance, a retrieval condition designating section for designating a predetermined retrieval condition, a readout section for reading out, from the accompaniment pattern storage section, any of the accompaniment patterns which satisfies the retrieval condition designated by the retrieval condition designating section, and an accompaniment tone generation section for generating automatic accompaniment tone on the basis of the accompaniment pattern read out by the readout section.

From the accompaniment pattern storage section is selectively read out any of the accompaniment patterns which satisfies the retrieval condition designated by the retrieval condition designation section (e.g., "pattern where events exist at second and fourth beat timing" or "pattern where the number of events is "n" or more"). In this case, the accompaniment device may further comprise a selection section for selecting desired one of the accompaniment patterns for each of the components so that the readout section reads out the accompaniment pattern selected by the selection section from among any of the accompaniment patterns satisfying the designated retrieval condition.

An automatic accompaniment device according to still another aspect of the present invention comprises an accompaniment pattern storage section for storing plural accompaniment patterns for each of plural accompaniment components, each of the components being composed of one or more musical instrument parts for an accompaniment performance, a pattern input section for inputting a desired accompaniment pattern, a readout section for selectively reading out, from the accompaniment pattern storage section, any of the accompaniment patterns that is close to the accompaniment pattern input by the pattern input section, and an accompaniment tone generation section for generating automatic accompaniment tone on the basis of the accompaniment pattern read out by the readout section.

From the accompaniment pattern storage section is selectively read out any of the accompaniment patterns which is close to an accompaniment pattern input via the pattern input section. This arrangement also permits an accompaniment pattern exactly as imaged by the user to be selected easily at a faster speed. Also in this case, the accompaniment device may further comprise a selection section for selecting desired one of the accompaniment patterns for each of the components so that the readout section reads out the accompaniment pattern selected by the selection section from among any of the accompaniment patterns which is close to the input accompaniment pattern.

An automatic accompaniment device according to still another aspect of the present invention comprises an accompaniment pattern storage section for storing plural accompaniment patterns for each of plural accompaniment components, each of the components being composed of one or more musical instrument parts for an accompaniment performance, a selection section for selecting desired one of the accompaniment patterns for each of the components, a first readout section for reading out, from the accompaniment pattern storage section, the accompaniment pattern selected by the selection section, a second readout section for reading out, from the accompaniment pattern storage section, the accompaniment pattern in predetermined order, and an accompaniment tone generation section for generating automatic accompaniment tone on the basis of the accompaniment pattern read out by the first or second readout section.

By setting a mode where the accompaniment patterns are sequentially read out, by the second readout section, from the accompaniment pattern storage section in predetermined order, it is possible to briefly confirm what sorts of accompaniment patterns are contained in the storage section. Once a specific accompaniment pattern preferred by the user has been found in the course of the sequential readout operation, the user can select it.

Now, the preferred embodiments of the present invention will be described in detail below with reference to the accompanying drawings.

BRIEF DESCRIPTION OF THE DRAWINGS

In the drawings:

FIGS. 20A to 20D are conceptual diagrams showing a manner in which the drum sound and velocity of a current pattern are replaced in the transformer process;

DETAILED DESCRIPTION OF THE PREFERRED EMBODIMENTS

Figure 1:
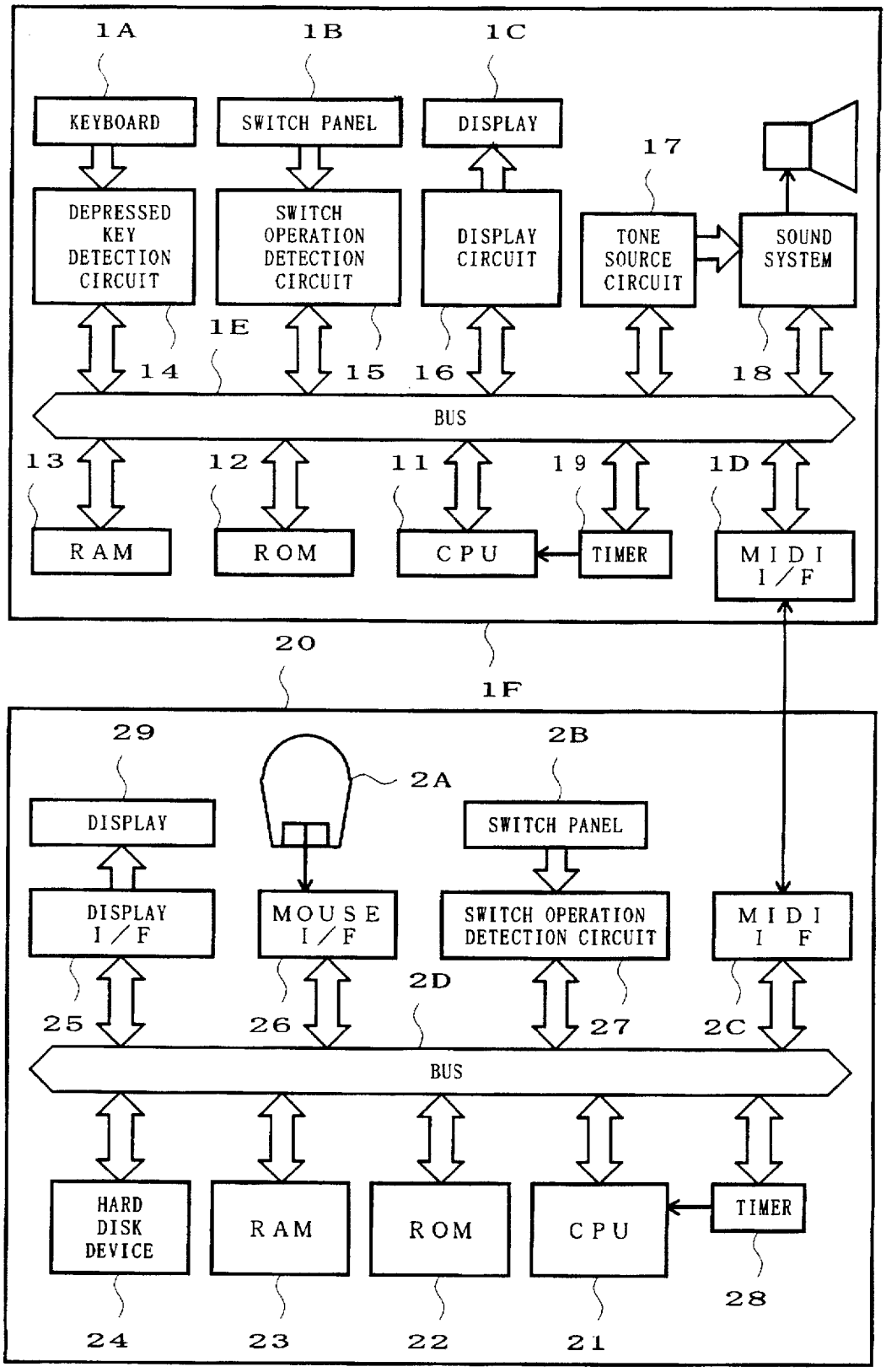
FIG. 1 is a hardware block diagram illustrating the detailed structure of an electronic musical instrument containing a sequencer-type automatic performance device, and a personal computer for editing accompaniment patterns, as well as the connection between the electronic musical instrument and the personal computer.

FIG. 1 is a hardware block diagram illustrating the detailed structure of an electronic musical instrument 1F containing a keyboard and a tone source circuit, and a personal computer 20 for editing accompaniment patterns and providing data based on the accompaniment patterns to the electronic musical instrument 1F, as well as the connection between the electronic musical instrument 1F and the personal computer 20.

First, the detailed structure of the electronic musical instrument 1F will be described below.

A microprocessor unit (CPU) 11 controls the entire operation of the electronic musical instrument 1F. To this CPU 11 are connected, via a bus 1E, a ROM 12, a RAM 13, a depressed key detection circuit 14, a switch operation detection circuit 15, a display circuit 16, a tone source circuit 17, a sound system 18, a timer 19 and a MIDI interface (I/F) 1D.

Here, the description will be made in relation to such a specific electronic musical instrument in which depressed key detection, transmission/reception of performance data (note data), tone generation processing etc. are carried out via the CPU 11. But, it should be noted that the present invention is also applicable to another type of electronic musical instrument in which there are separately provided a module comprising the depressed key detection circuit 14 and a module comprising the tone source circuit 17, and in which data exchange between the two modules is performed via MIDI interfaces.

The ROM 12, which is a read-only memory, stores therein various programs and data that are utilized by the CPU 11.

The RAM 13 is provided in predetermined address areas of a random access memory for use as registers and flags for temporarily storing various data which are produced as the CPU 11 executes the programs.

A keyboard 1A has a plurality of keys for designating the pitch of tone to be generated and key switches provided in corresponding relations to the keys. If necessary, the keyboard may also include key-touch detection means such as a key depression velocity or force detection device. The keyboard is employed here just because it is a fundamental performance operator which is easy for music players to manipulate, but any other suitable performance operator such as drum pads or the like may of course be employed.

The depressed key detection circuit 14, which comprises a circuit including a plurality of key switches corresponding to the keys on the keyboard, outputs key-on event data upon detection of a newly depressed key and key-off event data upon detection of a newly released key. The depressed key detection circuit 14 also generates key touch data by determining the key depression velocity or force and outputs the generated touch data as velocity data. Each of the key-on and key-off data and key touch data is expressed in accordance with the MIDI standard and contains data indicative of a key code and a channel to be assigned to generate a tone.

A switch panel 1B comprises a variety of operators, i.e., operating members for selecting, setting and controlling the color, volume, effect etc. of tone to be generated. The switch panel 1B is of any conventionally-known structure and will not be described further.

The switch operation detection circuit 15 detects the operational state of each operating member on the switch panel 1B and supplies, via the bus 1E, the CPU 11 with switch data corresponding to the detected operational state.

The display circuit 16 shows on a display section 1C various information such as the controlling state of the CPU 11 and the contents of currently set data. The display section 1C comprises, for example, a liquid crystal display (LCD), and its operation is controlled by the display circuit 16.

The tone source circuit 17 has a plurality of tone generation channels, by means of which it is capable of generating plural tones simultaneously. The tone source circuit 17 receives performance data (data based on the MIDI standard) supplied via the bus 1E, and on the basis of the received data, it can generate tone signals through selectively assigned tone generation channels. As will be later described, the tone source circuit 17 of the electronic musical instrument 1F is constructed in such manner to be able to generate tone signals of various kinds of drum sound.

Any tone signal generation method may be used in the tone source circuit 17 depending on the application. For example, any conventionally known tone signal generation method may be used such as: the memory readout method where tone waveform sample value data stored in a waveform memory are sequentially read out in accordance with address data that change in correspondence to the pitch of tone to be generated; the FM method where tone waveform sample value data are obtained by performing predetermined frequency modulation operations using the above-mentioned address data as phase angle parameter data; or the AM method where tone waveform sample value data are obtained by performing predetermined amplitude modulation operations using the above-mentioned address data as phase angle parameter.

The tone signal generated by the tone source circuit 17 is audibly reproduced through the sound system 18 which comprises an amplifier and a speaker (both not shown).

The timer 19 generates clock pulses which are used for counting time intervals etc. Each of the clock pulses is applied to the CPU 11 as an interrupt command, in response to which the CPU 11 carries out various processing as will be later described in detail.

A MIDI interface (I/F) ID interconnects the bus 1E of the electronic musical instrument 1F and a MIDI interface (I/F) 2C of the personal computer 20. The MIDI interface 2C in turn interconnects a bus 2D of the personal computer 20 and the above-mentioned MIDI interface 2C. Accordingly, the bus 1E of the electronic musical instrument 19 and the bus 2D of the personal computer 20 are interconnected via the two MIDI interfaces 1D and 2C, so that data exchange based on the MIDI standard can be done bidirectionally.

Next, the structure of the personal computer 20 will be described in detail.

A microprocessor unit (CPU) 21 controls the entire operation of the personal computer 20. To this CPU 21 are connected, via the bus 2D, a ROM 22, a RAM 23, a hard disk device 24, a display interface (I/F) 25, a mouth interface (MOUSE I/F) 26, a switch operation detection circuit 27, a timer 28 and the above-mentioned MIDI interface 2C.

The ROM 22, which is a read-only memory, stores therein a variety of data such as various programs and data and various signs and characters.

Figure 3:
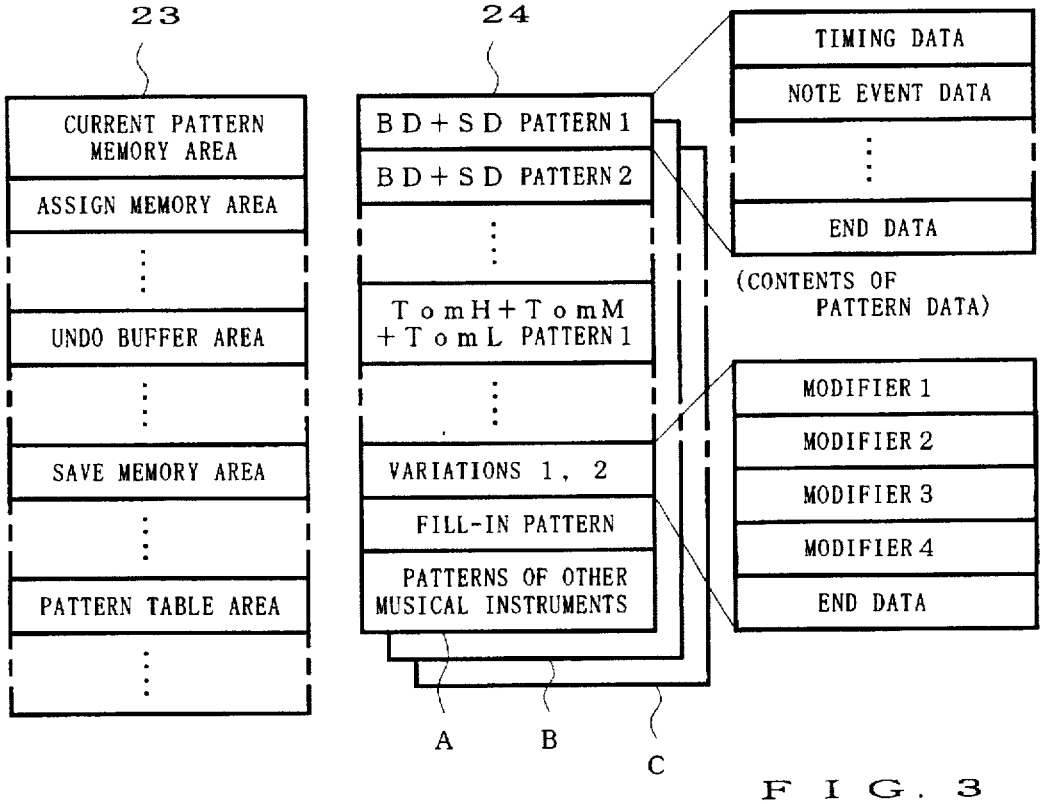
FIG. 3 illustrates the data storage formats in a RAM and a hard disk device of the personal computer shown in FIG. 1.

The RAM 23, which is an random access memory (RAM), temporarily stores various data produced as the CPU 21 executes the programs. As shown in FIG. 3, predetermined areas of the RAM 23 in this embodiment are assigned as a current pattern memory area, an assign memory area, an undo buffer area, a save memory area and a pattern table area.

The current pattern memory area is used for storing each rhythm pattern which is read out during an automatic accompaniment (current pattern). The assign memory area is used for storing each rhythm pattern which is newly made by edit processing or transformer process as will be described later in detail. The undo buffer area is used for temporarily storing each rhythm pattern which is changed or transformed by the transformer process. The save memory area is used for saving the current pattern when a fill-in is inserted, or for temporarily storing a rhythm pattern of a previously existing component when some rhythm pattern component is newly read out from a predetermined data base.

The pattern table area is provided for storing data that represent the addresses and degrees of complexity of rhythm patterns stored in the data base (hard disk device 24), using the degrees of complexity as addresses. In more specific terms, this pattern table area is an area for storing an address conversion table that is looked up to convert, into addresses of the data base, the serial addresses of the rhythm patterns that have been rearranged in accordance with the degrees of complexity, i.e., in such order where less complex patterns assumes smaller address values.

The hard disk device 24, which is an external storage device of the personal computer 20, has a storage capacity somewhere between dozens of megabytes (MB) and hundreds of megabytes. In this embodiment, the hard disk device 24 which is used as the data base of rhythm patterns is divided into three banks A, B, C for storing three different styles (categories) of patterns.

In this embodiment, bank A stores a plurality of rhythm patterns corresponding to drum sound components dedicated to rock music, bank B stores a plurality of rhythm patterns corresponding to drum sound components dedicated to disco music, and bank C stores a plurality of rhythm patterns corresponding to drum sound components common to rock and disco music. Head addresses to uniquely identify the individual rhythm patterns stored in the banks are sequentially stored in the above-mentioned pattern table area by using, as addresses, the degrees of complexity in such a manner that less complex patterns assumes smaller address values.

For instance, in the case of a component of bus drum (BD) and snare drum (SD), plural patterns comprising (BD+SD) pattern 1, (BD+SD) pattern 2, . . . are stored in such a manner that they become progressively complex as their pattern numbers increase. Similarly, in the case of a component of tom tom high, tom tom middle and tom tom low (Tom H, Tom M, Tom L), plural patterns comprising (Tom H+Tom M+Tom L) pattern 1, (Tom H+Tom M+Tom L) pattern 2, . . . are stored in such a manner that they become progressively complex as their pattern numbers increase.

Figures 4, 5A, 5B:
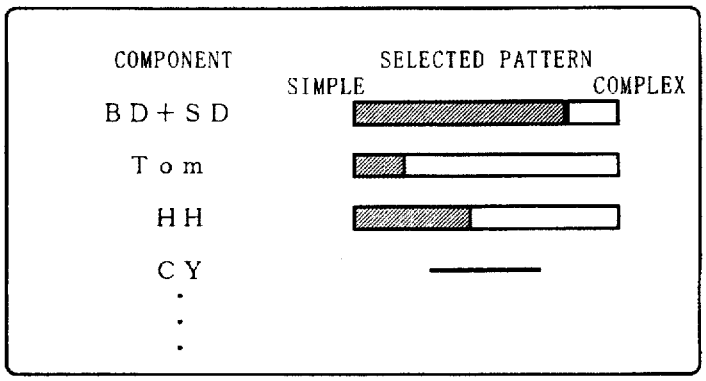
FIG. 4 illustrates the contents of an address conversion table stored in a pattern table area.
FIG. 5A is a diagram showing an example of video information presented on a display.
FIG. 5B is a diagram showing another example of video information presented on the display.

FIG. 4 shows the contents of the address conversion table stored in the pattern table area, in which are illustrated a rock music pat tern table and a disco music pattern table.

The rock music pattern table stores head addresses A-1, A-2, A-3, C-1, A-4, C-2, . . . , A-n for uniquely identifying individual ones of the plural rhythm patterns contained in banks A and C, using, as addresses, the serial numbers 1, 2, 3, . . . , n corresponding to the degrees of complexity of the rhythm patterns. Similarly, the disco music pattern table stores head addresses B-1, B-2, C-1, B-3, C-2, C-3, . . . , B-n for uniquely identifying individual ones of the plural rhythm patterns contained in banks B and C, using, as addresses, the serial numbers 1, 2, 3, . . . , n corresponding to the degrees of complexity of the rhythm patterns.

Here, the prefix "A", "B" or "C" of each head address specifies any one of the banks where the corresponding rhythm pattern is stored. That is, the head addresses A-1, A-2, A-3, A-4 and A-n specify bank A, the head addresses B-1, B-2, B-3 and B-n specify bank B, and the head addresses C-1, C-2 and C-3 specify bank C.

This embodiment employs the degrees of complexity represented in values ranging from "0" to "100" that are obtained by converting the complexity of each rhythm pattern in accordance with predetermined rules. The predetermined rules may for example be determined directly on the basis of the number of notes contained in the rhythm pattern, the number in the rhythm pattern of such timing where note event data exists, a difference between the numbers of notes contained in the former and latter halves of the rhythm pattern, or the number of event occurrences at specific timing (such as first or third beat, or eighth-note upbeat), or on the basis of a combination of some of the above-mentioned factors arbitrarily selected by the user, or in collective consideration of all these factors. In a modified example, the rhythm patterns may be rearranged in any appropriate order as desired by the user.

In FIG. 4, at address "1" of the rock music pattern table, there is shown that a rhythm pattern dedicated to rock music and having the smallest degree of complexity of "5" is stored at head address "A-1." of the data base. Similarly, at address "2" is shown that a rhythm pattern dedicated to rock music and having the degree of complexity "7" is stored at address "A-2" of the data base; at address "3" is shown that a rhythm pattern dedicated to rock music and having the degree of complexity of "10" is stored at address "A-3" of the data base; at address "4" is shown that a rhythm pattern common to rock music and disco music and having the degree of complexity of "11" is stored at address "C-1" of the data base; at address "5" is shown that a rhythm pattern dedicated to rock music and having the degree of complexity of "16" is stored at address "A-4" of the data base; at address "6" is shown that a rhythm pattern common to rock music and disco music and having the degree of complexity of "20" is stored at address "C-2" of the data base; and at address "n" is shown that a rhythm pattern dedicated to rock music and having the greatest degree of complexity of "95" is stored at address "A-n" of the data base.

Further, in FIG. 4, at address "1" of the disco music pattern table, there is shown that a rhythm pattern dedicated to disco music and having the smallest degree of complexity of "10" is stored at head address "B-1" of the data base. Similarly, at address "2" is shown that a rhythm pattern dedicated to disco music and having the degree of complexity "14" is stored at address "B-2" of the data base; at address "3" is shown that a rhythm pattern common to rock music and disco music and having the degree of complexity of "22" is stored at address "C-1" of the data base; at address "4" is shown that a rhythm pattern dedicated to disco music and having the degree of complexity of "25" is stored at address "B-3" of the data base; at address "5" is shown that a rhythm pattern common to rock music and disco music and having the degree of complexity of "26" is stored at address "C-2" of the data base; at address "6" is shown that a rhythm pattern common to rock music and disco music and having the degree of complexity of "30" is stored at address "C-3" of the data base; and at address "n" is shown that a rhythm pattern dedicated to disco music and having the greatest degree of complexity of "91" is stored at address "B-n" of the data base.

Because the rhythm patterns in bank C are common to rock and disco music, these patterns are present in both of the rock and disco music tables. For example, in the pattern table of FIG. 4, the rhythm patterns of head addresses "C-1" and "C-2" are contained in both of the rock and disco music tables. The reason why the rhythm patterns common to rock music and disco music are different in degree of complexity between rock music and disco music is that the predetermined rules applied in determining the degree of complexity differ between the rock and disk music pattern tables as earlier mentioned.

Each of the banks A, B, C also stores fill-in patterns in preparation for real time performance and patterns of other musical instruments as shown in FIG. 3, and thus, if desired, performance can be made by temporarily inserting such a fill-in pattern in place of a current pattern.

Each of the rhythm patterns in the banks A, B, C, as shown in FIG. 3, comprises a set of performance data stored on a relative time basis, and each of the performance data is a combination of timing data indicative of the timing of an event and note event data indicative of the sort of the event. In this embodiment, the note event data is a three-byte data stored in a format corresponding to a MIDI note-on message. The timing data is represented in terms of the number of clock pulses between adjacent note events. In the hard disk device 24, there are also stored, as variation patterns 1 and 2, two kinds of sequence data for selectively instructing modifiers for rhythm pattern transformation. That is, as shown in FIG. 3, variations 1 and 2 comprise sequential data including modifiers 1–4 stored in sequence.

Although not specifically shown in the drawings, a cache memory (RAM) having a capacity of about several megabytes may be provided in order to substantially reduce the time required for accessing the hard disk device 24, or a DMA (Direct Memory Access) device may be provided in order to reduce the burden involved in data exchange between the RAM 23 and the hard disk device 24.

A display 29, which comprises a conventional CRT, LCD or the like, received data processed within the personal computer 20 via a display interface (I/F) and visually presents the input data in video form on its screen.

FIG. 5 shows examples of video information presented on the display 29. In order to indicate which of the components is being currently selected and of which degree of complexity the selected component is, the display 29 shows, on a section denoted as "selected pattern", the degree of complexity of each individual rhythm pattern of the selected component. Accordingly, the display indicates that such a component whose degree of complexity is displayed in the section "selected pattern" is being currently selected and that other components whose degrees of complexity are not shown in the section "selected pattern" are not being currently selected.

For instance, the illustrated example of FIG. 5A shows that a rhythm pattern having the degree of complexity "80" is being selected with respect to component BD+SD comprised of bus drum (BD) and snare drum (SD). It also shows that a rhythm pattern having the degree of complexity "20" is being selected with respect to tom tom component Tom and a rhythm pattern having the degree of complexity "45" is being selected with respect to high hat component HH, but it shows that no rhythm pattern is being selected for cymbal component CY by not indicating any degree of complexity. In a similar manner to the above-mentioned, whether or not any given component is being selected will be readily seen by checking whether or not the degree of complexity of that component is indicated in the "selected pattern" section on the display. In addition, from indication of the degree of complexity in the "selected pattern" section on the display, it will be readily recognized at which relative level of complexity the corresponding rhythm pattern is located.

Although indicated by numerical values in the illustrated example of FIG. 5A, the degrees of complexity may be indicated in graphic representation such as a bar graph shown in FIG. 5B. By thus indicating the degrees of complexity in graphic representation, it is possible to readily know if any given component is being currently selected and also sensuously recognize the relative positioning of the component's degree of complexity.

The relative positioning of the rhythm patterns may be determined in terms of any other factor (e.g., degree of furiousness or "groove") than the above-mentioned degree of complexity, or may be indicated in multidimensions such as two or three dimensions by combining these factors. In the case of the multidimensional indication, graphic representation such as a radar chart will be useful.

A mouse 2A is a kind of pointing device for inputting desired coordinate points to the personal computer 20, and the output of the mouse 2A is supplied to the CPU 21 via a mouse interface (MOUSE I/F) 26 and the bus 2D.

A switch panel 2B is in the form of a keyboard for inputting programs and data to the personal computer 20 and is provided with ten-keys and function keys.

A switch operation detection circuit 27 detects the operational state of each key on the switch panel 2B and provides, via the bus 2D, the CPU 21 with key operation data corresponding to the detected operational state.

A timer 28 counts time intervals and provides operation clock pulses for the entire personal computer 20. By counting the clock pulses, the personal computer 20 counts a predetermined time and, upon counting-up of the predetermined time carries out timer interrupt processing.

According to this embodiment, in addition to the mouse 2A and switch panel 2B of the personal computer 20, the keys on the keyboard of the electronic musical instrument 1F can work as an operating member for selecting, setting and controlling the functions of the personal computer 20. This is achieved by transmitting a note number corresponding to the key depression state on the keyboard over to the CPU 21 of the personal computer 20 via the MIDI interfaces 1D and 2C.

Figure 6:
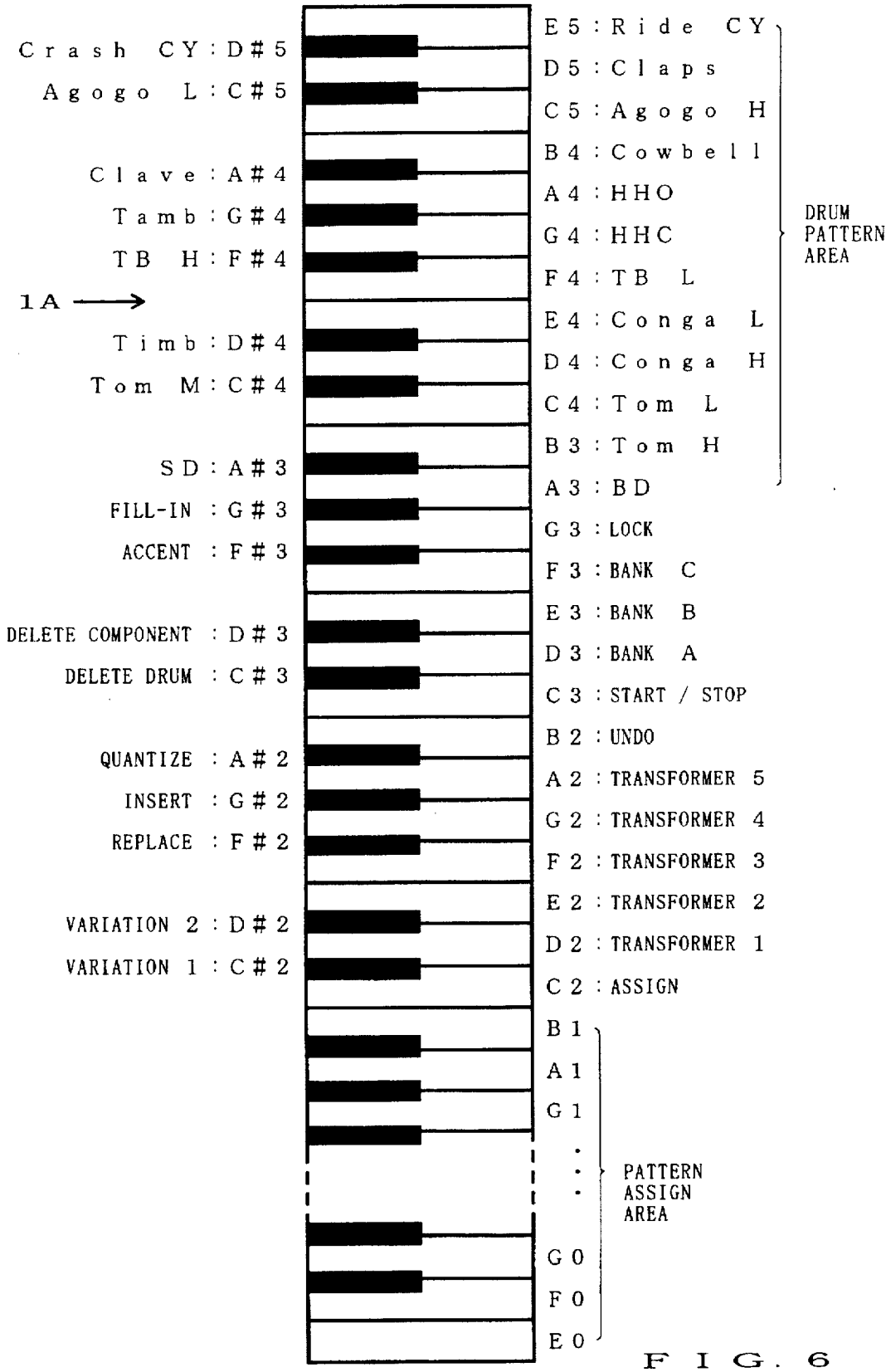
FIG. 6 is a diagram illustrating an example of various functions assigned to a keyboard of FIG. 1.

FIG. 6 illustrates an example of various functions assigned to the individual keys on the keyboard In the illustrated example, the keyboard, which has a total of 61 keys, is divided into a pattern assign area, an operating member area and a drum pattern area. The keys of note numbers B0–B1 form the pattern assign area, the keys of note numbers C2–G#3 form the operating member area, and the keys of note numbers A3–E5 form the drum pattern area.

The keys of note numbers E0–B1 generate addresses which correspond to an assign memory area for storing each rhythm pattern that has been made by the edit or transformer processes as a new rhythm pattern. Namely, the assign memory area in the RAM 23 is composed of an assign memory administration subarea having 20 addresses and pattern storage subareas capable of storing 20 patterns, and the addresses of the assign memory administration subarea correspond to note numbers E0–B1. For instance, note number E0 corresponds to the first address in the assign memory administration subarea, and similarly note numbers F#0–B1 correspond to the third to twentieth address in the subarea. In each of the addresses in the assign memory administration subarea, there is stored the value of head address of the corresponding pattern storage subarea.

The keys of note numbers C2–G#3 function as various kinds of operating members for executing the edit and transformer processes. Therefore, note numbers C2–G#3 by themselves constitute key operation data indicating the operating member functions assigned to these keys.

More specifically, the key of note number C2 corresponds to an assign key; the keys of note numbers D2, E2, F2, G2 and A2 correspond to transformer keys for designating transformers 1–5; the key of note number B2 to an undo designation key; and the key of note number C3 to a start/stop key. Further, the keys of note numbers D3, E3 and F3 correspond to bank keys for designating banks A–C; the key of note number G3 to a pattern-establishing lock key; the keys of note numbers C#2 and D#2 to variation keys for designating variations 1 and 2; the key of note number F#2 to a replace input key; the key of note number G#2 to an insert input key; and the key of note number A#2 to a quantize processing designation key. Furthermore, the key of note number C#3 corresponds to a delete drum instruction key; the key of note number D#3 to a delete component instruction key; the key of note number F#3 to an accent input key; and the key of note number G#3 to a fill-in designation key.

The detail of the processing performed in response to the actuation of these keys will be described later.

The keys of note numbers A3–E5 in the drum pattern area of the keyboard function as drum sound designation keys. Therefore, the note numbers A3–E5 by themselves constitute drum sound data indicative of the kind of drum sounds assigned to these keys.

More specifically, the key of note number A3 corresponds to a sound of bus drum (BD); the key of note number A#3 to a sound of snare drum (SD); the key of note number B3 to a sound of tom tom high (Tom H); the key of note number C4 to a sound of tom tom low (Tom L); the key of note number C#4 to a sound of tom tom middle (Tom M); the key of note number D4 to a sound of conga high (Conga H); and the key of note number E4 to a sound of conga low (Conga L). Further, the key of note number D#4 corresponds to a sound of timbales (Timb); the key of note number F4 to a sound of temple block (i.e., wooden drum used in temples) low (TB L); the key of note number F#4 to a sound of temple block high (TB H); the key of note number G4 to a sound of closed high hat cymbals (HHC); the key of note number A4 to a sound of open high hat cymbals (HHO); the key of note number G#4 to a sound of tambourine (Tamb); the key of note number A#4 to a sound of claves (Clave); and the key of note number B4 to a sound of cowbell (Cowbell). Furthermore, the key of note number C5 to a sound of agogo high (Agogo H); the key of note number C#5 to a sound of agogo low (Agogo L); the key of note number D5 to a sound of hand claps (Claps); the key of note number D#5 to a sound of crash cymbals (Crash CY); and the key of note number E5 to a sound of ride cymbals (Ride CY).

Each of the drum sounds can be designated independently of the others, but, in this embodiment, it is used as a component with any of other drum sounds selected to realize a desired form of performance. Accordingly, some components may comprise only one of the drum sounds and other components may comprise a plurality of the drum sounds. In the case of a component comprising a plurality of the drum sounds, it is necessary that a certain common characteristic (musical relevancy) be present between the drum sounds constituting the component. For instance, such a component is formed by each of the following combinations: bus drum (BD) and snare drum (SD); tom tom high (Tom H), tom tom middle (Tom M) and tom tom low (Tom L); conga high (Conga H), conga low (Conga L) and timbales (Timb); temple block high (TB H) and temple block low (TB L); open high hat cymbals (HHO) and closed high hat cymbals (HHC); and agogo high (Agogo H) and agogo low (Agogo L). Therefore, in this example, each of the drum sounds of tambourine (Tamb), claves (Clave), cowbell (cowbell), hand claps (Claps), crash cymbals (Crash CY) and ride cymbals (Ride CY) forms a component by itself.

Alternatively, any other components may of course be formed by combinations such as: tambourine (Tamb) and claves (Clave); cowbell (Cowbell) and hand claps (Claps); and crash cymbals (Crash CY) and ride cymbals (Ride CY) etc.

Figure 2:
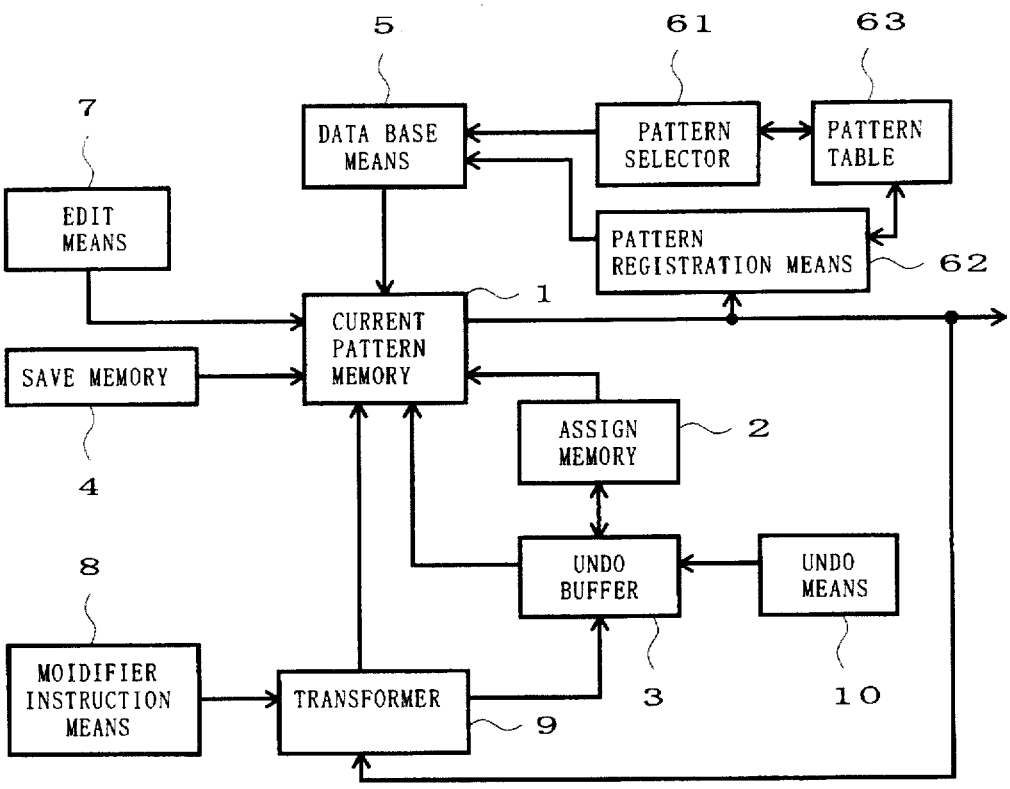
FIG. 2 is a functional block diagram illustrating a case where the electronic musical instrument and personal computer together function as an accompaniment pattern making device.

FIG. 2 is a functional block diagram illustrating in the case where the electronic musical instrument 1F and personal computer 20 shown in FIG. 1 cooperatively work as an accompaniment pattern making device.

The operation of the accompaniment pattern making device of FIG. 2 centers around a current pattern memory 1. The personal computer 20 carries out the automatic performance processing by sequentially reading out rhythm patterns from the current pattern memory 1.

The current pattern memory 1, assign memory 2, undo buffer 3 and save memory 4 in FIG. 2 correspond to predetermined areas in the RAM 23 shown in FIG. 3.

A data base means 5 corresponds to the hard disk device 24 of FIG. 1 and has many rhythm pattern data stored therein as shown in FIG. 3.

A pattern selector 61 corresponds to the drum sound designating keys A3, A#3, B3, . . . , E5 in the drum pattern area and the bank designating keys of note numbers D3, E3 and F3.

Thus, once a desired component within the data base is selected by means of the pattern selector 61, the accompaniment pattern making device reads out the corresponding rhythm pattern data from the data base means 5 and passes the read-out data to the current pattern memory 1. In this embodiment, the selection of a desired component is made by the operation of the pattern selector 61, i.e., keyboard, and a component is designated which corresponds to the note number generated by the operation of the keyboard. Each component has plural rhythm patterns as previously mentioned, and, in this embodiment, a selection as to which rhythm pattern of the designated component is to be read out is made depending on the magnitude of velocity data resulting from the keyboard operation.

Namely, as previously mentioned, the head addresses of the individual rhythm pattern data forming the banks A, B and C within the data base 5 are sequentially recorded in the pattern table 63, using as serial addresses corresponding to the degrees of rhythm pattern complexity. Therefore, by relating velocity data generated in response to actuation of the pattern selector 61 to the addresses of the pattern table 63, the head address of rhythm pattern data which differs in degree of complexity depending on the magnitude of the velocity data value can be supplied to the pattern selector 61. The pattern selector 61 reads out rhythm pattern data stored at the address in the data base means 5 designated by the head address, and passes the read-out data to the current pattern memory 1. The rhythm pattern data thus passed from the base means 5 is stored in the current pattern memory 1 as a current pattern, and the current pattern will be subjected to various modifications by edit means 7 and a transformer 9.

The edit means 7 corresponds to the replace input key of note number F#2, insert input key of note number G#2, quantize processing designation key of note number A#2, delete drum instruction key of note number C#3, delete component instruction key of note number D#3 and accent input key of note number F#3 which are all provided on the keyboard shown in FIG. 2.

Throughout the specification, the term "replace input" is used to mean replacing original note event data of the current pattern with new note event data and then storing only the new note event data. The term "insert input" is used to mean additionally storing new note event data to original note event data of the current pattern. The term "quantize" is used to mean fitting the timing of a note event to predetermined reference timing. Further, the term "accent" is used to mean re-accenting any of the drum sounds of the current pattern which corresponds to a depressed key on the keyboard. The term "delete drum" is used to mean deleting only any of the drum sounds of the current pattern which corresponds to a depressed key on the keyboard. Furthermore, the term "delete component" is used to mean deleting every one of the drum sounds of the current pattern which forms a component corresponding to a depressed key on the keyboard.

A modifier instruction means 8 corresponds to the transformer designation keys of note numbers D2, E2, F2, G2, A2 on the keyboard of FIG. 1.

The transformer 9 corresponds to transformer programs stored in the ROM 22 of FIG. 1. The contents of the current pattern are transformed in accordance with a modifier instructed by the modifier instruction means 8 corresponding to the transformer instruction keys. By only instructing such a modifier, the transformer 9 is caused to form a pattern having a desired image.

An undo means 10 corresponds to the undo key of note number B2 on the keyboard of FIG. 1.

The pattern modified by the transformer 9 is stored in the undo buffer 3, so that if a desired pattern has not been obtained as the result of modification, the original pattern can be retrieved. Namely, because all modified patterns are sequentially stored into the undo buffer 3 in the order in which they have been modified, the original pattern can be retrieved by sequentially reading backwardly the undo buffer 3.

In this way, the current pattern having been formed by modification or addition of a new pattern can be stored into the assign memory 2, and the pattern stored in the assign memory 2 can be read out at any time by actuating any of the keys in the pattern assign area on the keyboard.

A pattern registration means 62 corresponds to a pattern registering operator on the switch panel of FIG. 1.

The pattern registration means 62 registers the current pattern contained in the current pattern memory 1, which has been subjected to various modifications by the edit means 7 and transformer 9, into the data base means 5 as new rhythm pattern data. At this time, the pattern registration means 62 detects the degree of complexity of the rhythm pattern data newly registered in the data base means and rearrange the order of the data within pattern table 63 in accordance with the detected degree of complexity, to thereby renew the pattern table 63.

The pattern table rearrangement will be explained assuming a case where a tom tom rhythm pattern Tom having the degree of complexity "20" as shown in FIG. 5 is newly registered in the disco music pattern table of bank B in the data base means 5. First, the pattern registration means 62 registers the tom tom rhythm pattern Tom into address "B-n1" of the data base means 5 and detects the degree of complexity of the rhythm pattern Tom. Since the degree of complexity of the rhythm pattern Tom is "20", the pattern registration means 62 moves each of the head addresses "C-1, B-3, C-2, C-3, . . . . B-n" at and after address "3" of the disco music pattern table backward by one address, and then newly registers the head address of the tom tom rhythm pattern Tom into address "3" of the table.

Now, various processing carried out by the CPU 11 of the electronic musical instrument 1F of FIG. 1 will be described with reference to FIG. 7.

Figure 7A:
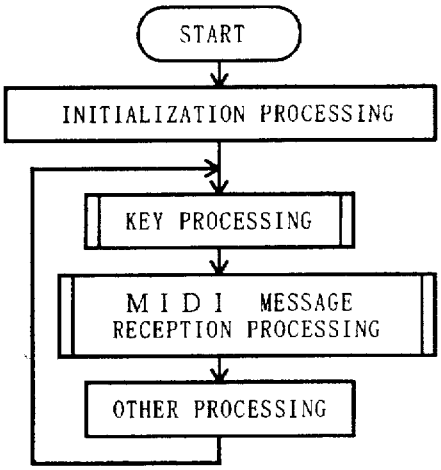
FIG. 7A is a flowchart illustrating an example of a main routine carried out by a CPU of the electronic musical instrument of FIG. 1.

In FIG. 7A, there is illustrated an example of main routine carried out by the CPU 11.

First, upon power-on, the CPU 11 starts executing processing in accordance with control programs stored in the ROM 12. In initialization processing, various registers and flags provided within the RAM 13 are initialized. After that, the CPU 11 repetitively carries out key processing, MIDI massage reception processing and other processing in response to occurrences of respective events.

Figure 7B:
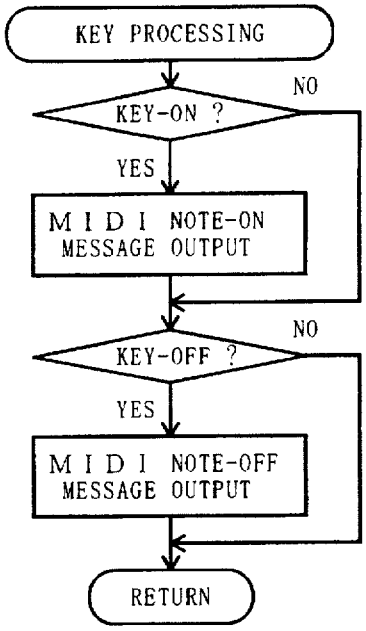
FIG. 7B is a flowchart illustrating a detailed example of key processing of FIG. 7A.

FIG. 7B illustrates the detail of the key processing of FIG. 7A.

In the key processing, it is determined whether the operational state of the keyboard is a key-on state or a key-off state. Then, depending on the determination result, a MIDI note-on or note-off message is supplied via the MIDI interfaces 1D and 2C to the personal computer 20. This embodiment is designed in such a manner that, even when the keyboard is operated, processing in the electronic musical instrument itself, i.e., processing in the tone source circuit 17 is not triggered; thus, the tone source circuit 17 does not start its tone generation processing at the time of this key processing.

Figure 7C:
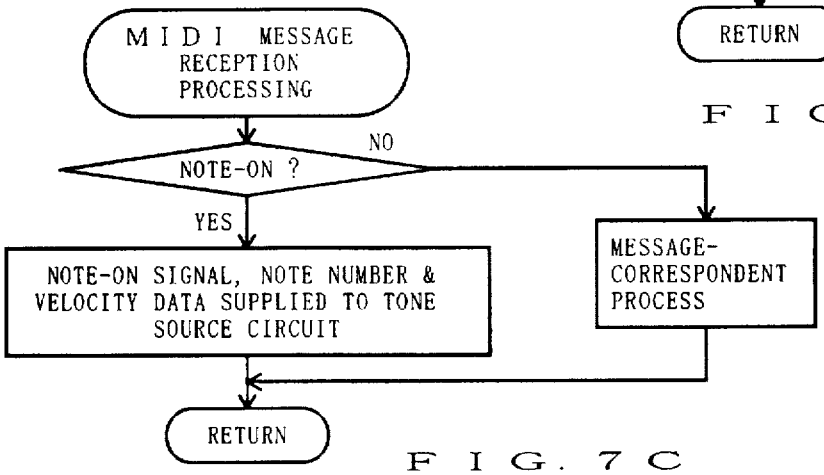
FIG. 7C is a flowchart illustrating a detailed example of MIDI message reception processing of FIG. 7A.

FIG. 7C illustrates the detail of the MIDI message reception processing of FIG. 7A.

The MIDI message reception processing is carried out each time a MIDI message is received from the personal computer 20 via the MIDI interfaces 2C and 1D. In this MIDI message reception processing, it is determined whether the received MIDI message is a note-on message or not. If the received message is a note-on message (i.e., the determination result is YES), the note-on signal, note number, velocity data and note-on signal are supplied to the tone source circuit 17, so as to cause the circuit 17 to generate a tone. If, on the other hand, the received MIDI is a note-off message (NO), the program returns to the main routine of FIG. 7A after performing a message-correspondent process corresponding to the received MIDI message.

In the other processing of FIG. 7A, various other processes than the above-mentioned are executed which include such operations responsive to the actuation of other operating members on the switch panel 1B.

Next, various processing carried out by the CPU 21 in the personal computer 20 of FIG. 1 will be described with reference to FIGS. 8 to 17.

Figure 8A:
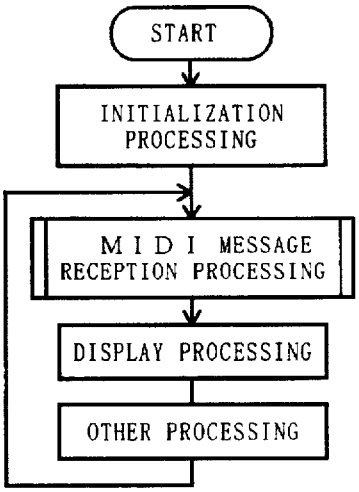
FIG. 8A is a flowchart illustrating an example of a main routine carried out by a CPU of the personal computer of FIG. 1.

In FIG. 8A, there is illustrated an example of main routine carried out by the CPU 21.

First, upon power-on, the CPU 21 starts executing processing in accordance with the control programs stored in the ROM 22. In initialization processing, various registers and flags provided within the RAM 23 are initialized. After that, the CPU 21 carries out MIDI massage processing, display processing and other processing.

Figure 8B:
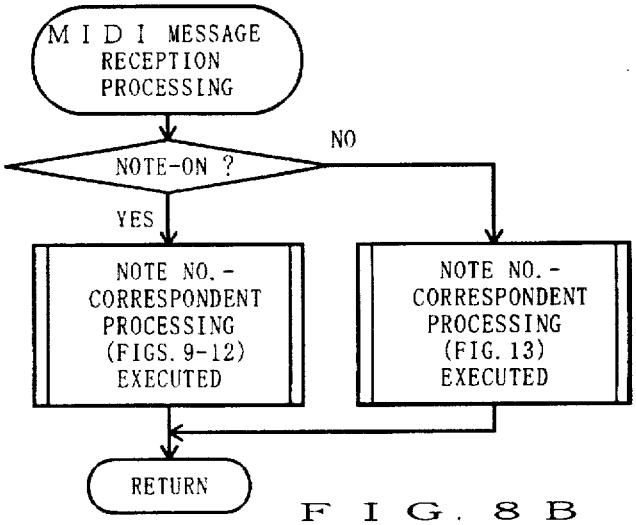
FIG. 8B is a flowchart illustrating a detailed example of the MIDI message reception processing of FIG. 8A.

FIG. 8B illustrates the detail of the MIDI message reception processing of FIG. 8A.

This MIDI message reception processing is carried out each time a MIDI message is received from the electronic musical instrument 1F via the MIDI interfaces 1D and 2C. In this processing, it is determined whether the received MIDI message is a note-on message or not. If the received message is a note-on message (YES), processing as shown in FIGS. 7A to 10 is carried out which corresponds to the key-on note number (processing of FIGS. 9 to 12 to be detailed later). If, on the other hand, the determination is in the negative (NO), processing as shown in FIGS. 1 and 11B is carried out which corresponds to the key-off note number (processing of FIG. 13 to be later detailed).

Figure 21:
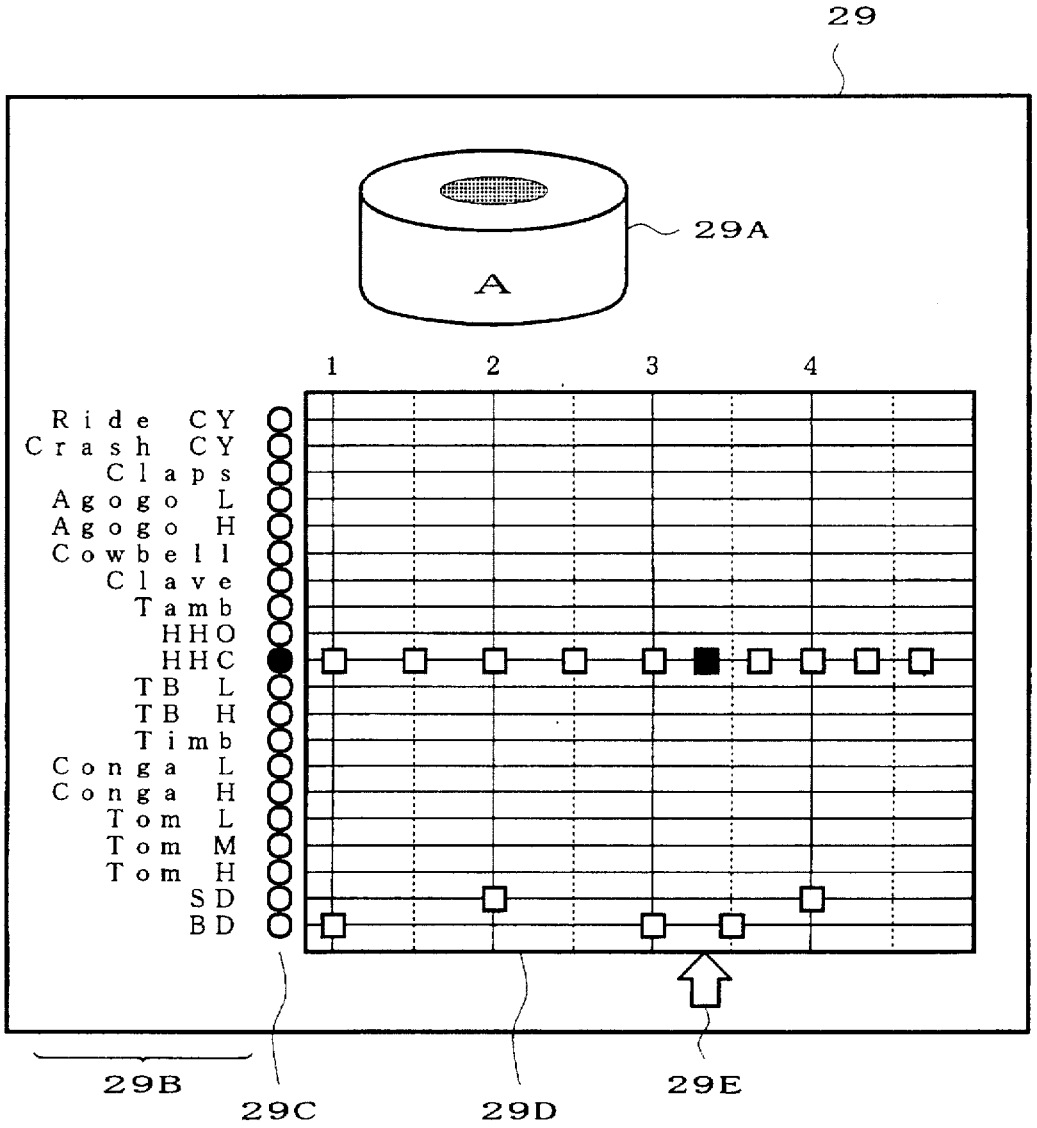
FIG. 21 is a diagram illustrating an example of video information shown on a display of FIG. 1.

In the display processing, such an operation is carried out for showing on the display 29 which of the banks in the data base means 5 is being processed and showing on the display 29 the kind of drum sound being performed and also showing which part of the current pattern is being performed. That is, video information as shown in FIGS. 5 and 21 is displayed on the screen.

Figure 17:
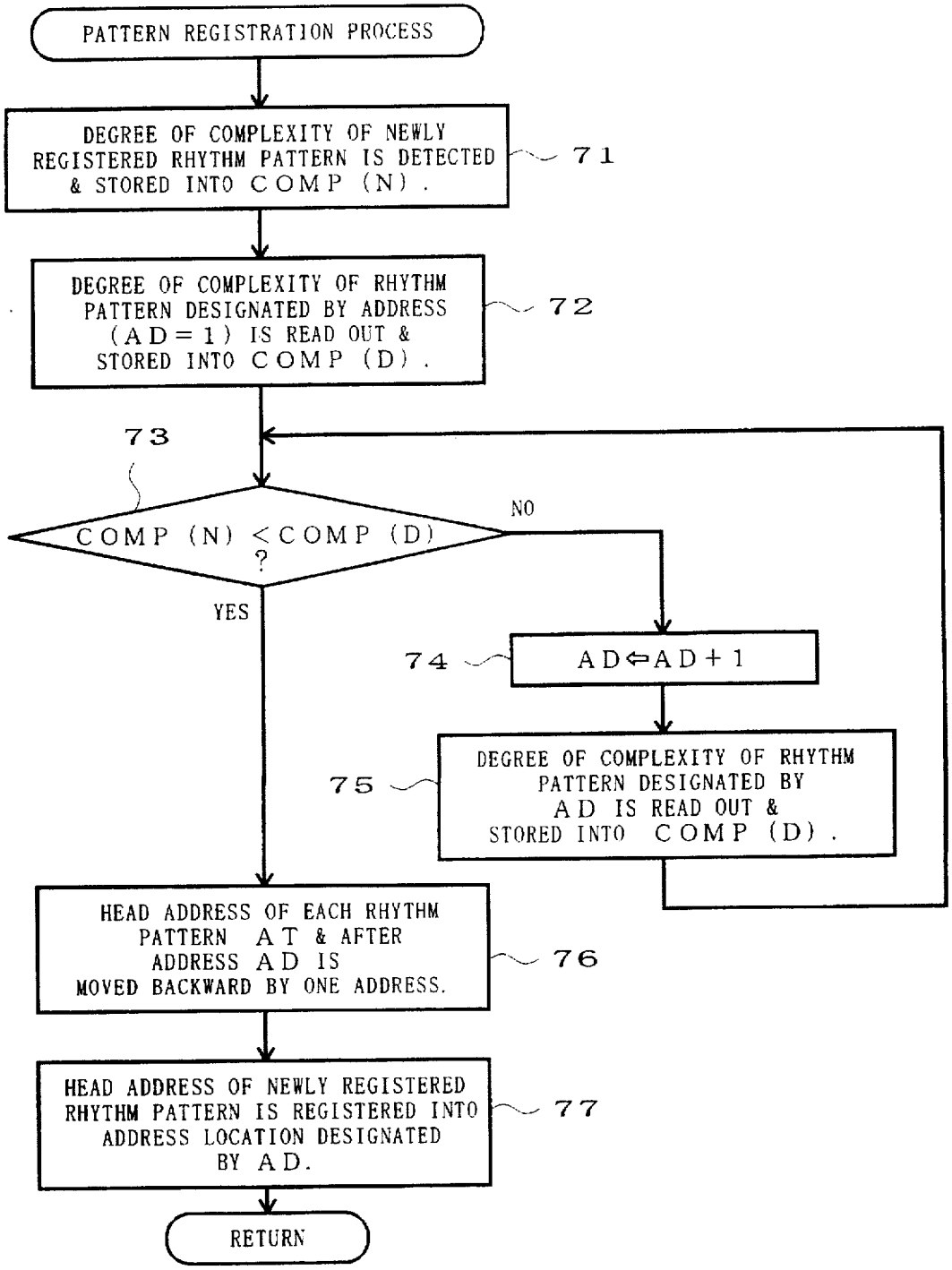
FIG. 17 is a flowchart illustrating a detailed example of a pattern registration process contained in other processing of FIG. 8, which is carried out by the CPU of the personal computer of FIG. 1.

In the other processing are performed operations based on the actuation of any of the other operators on the switch panel 2B and various other operations. In particular, pattern registration processing of FIG. 17 is performed in response to actuation of the pattern registration operator on the switch panel 2B, as will be later described in detail.

FIGS. 9 to 12 illustrate the detail of note-number-correspondent processing of FIG. 8B which is carried out in such a case where the received MIDI message is a note-on message.

Figure 9A:
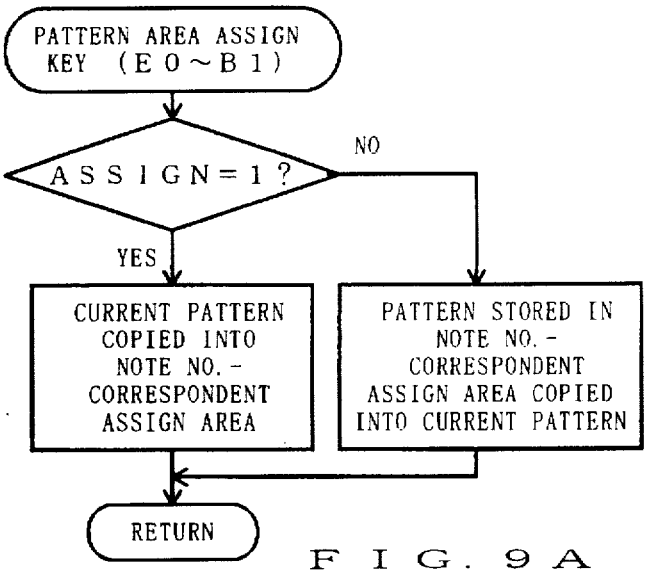
FIG. 9A is a flowchart illustrating a detailed example of the MIDI message reception processing of FIG. 8B which is carried out in such a case where a received MIDI message is a note-on message corresponding to any of pattern assign area keys of note numbers E0 to B1.

FIG. 9A shows pattern assign area key processing that is carried out when a MIDI message containing any of note numbers E0 to B1 is received from the electronic musical instrument 1F, in response to actuation of the pattern assign are keys corresponding to note numbers E0 to B1.

In this pattern assign area key processing, it is first determined whether assign flag ASSIGN is at high level "1", and then processing is carried out depending on the determination result.

Figure 9B:
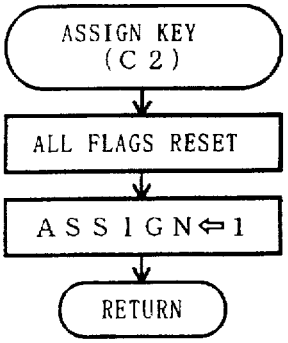
FIG. 9B is a flowchart illustrating a detailed example of the MIDI message reception processing of FIG. 8B which is carried out in such a case where the received MIDI message is a note-on message corresponding to an assign key of note number C2.

More specifically, the assign flag ASSIN is set to high level "1" by assign key processing of FIG. 9B when key-on operation has been made of the assign key (key of note number C2), but the flag ASSIGN is set to low level "0" by processing of FIG. 1 if key-off operation has been made of the assign key. Accordingly, if it has been ascertained that the assign flag ASSIGN is at high level "1" (the determination result is YES), this means that one of the keys in the pattern assign area and the assign key have been depressed simultaneously, and thus, the current pattern in the current pattern memory 1 is copied into the assign memory area of the assign memory 2 which corresponds to the note number, and then the program returns to the main routine.

If, on the other hand, it has been ascertained that the assign flag ASSIGN is at low level "0" (the determination result is NO), this means that one of the keys in the pattern assign area alone has been operated, and thus, the rhythm pattern stored in the assign memory area of the assign memory 2 which corresponds to the note number of the operated key is copied into the current pattern memory 1.

Namely, if any of the keys in the pattern assign area has been actuated while the assign key is depressed, the rhythm pattern data then stored in the current pattern memory 1 is registered for the operated key in the pattern assign area. If, however, only any of the keys in the pattern assign area has been operated singly, the rhythm pattern previously registered for that key is read into the current pattern memory 1.

Processing shown in FIG. 9B is assign key processing that is carried out when actuation has been made of the assign key on the keyboard which corresponds to note number C2 and a MIDI message containing such note number C2 has been received from the electronic musical instrument 1F.

In this assign key processing, all associated flags are reset to low level "0", the assign flag ASSIGN is set to "1", and then the program returns to the main routine.

Figure 9C:
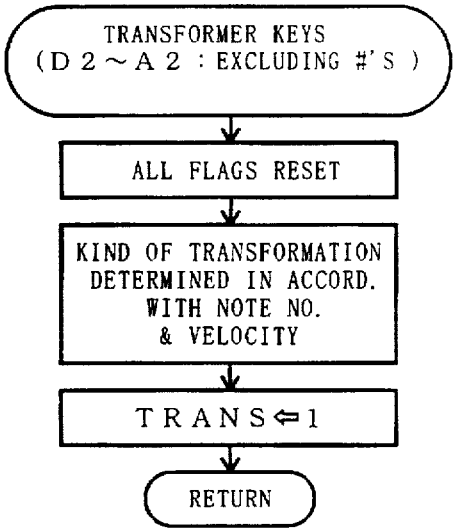
FIG. 9C is a flowchart illustrating a detailed example of the processing of FIG. 8B which is carried out in such a case where the received MIDI message is a note-on message corresponding to any of transformer keys of note numbers D2 to A2 (excluding #'s)

Processing shown in FIG. 9C is transformer key processing that is carried out when actuation has been made of any of the transformer keys on the keyboard which correspond to any of note numbers D2–A2 (excluding #'s) and a MIDI message containing any of note numbers D2–A2 (excluding #'s) has been received from the electronic musical instrument 1F.

The fact that a MIDI message containing any of note numbers D2–A2 (excluding #s) has been received from the electronic musical instrument 1F means that some kind of transformer modifier has been instructed. Therefore, in this transformer key processing, all associated flags are reset to low level "0" and the kind of transformer modifier is determined on the basis of the note number and velocity data. After that, transformer flag TRANS is set to "1", and then the program returns to the main routine.

In this embodiment, two modifiers are allotted to each of transformers 1–5, and either one of the two allotted modifiers is selected depending on the magnitude of velocity data. For instance, modifiers "Complex" and "Simple" representing complexing and simplifying processing respectively are allotted to transformer 1, "Hard" and "Soft" representing hardening and softening processing are allotted to transformer 2, and "Energetic" and "Calm" representing energizing and calming processing are allotted to transformer 3. Further, "Mechanical" and "Graceful" representing mechanizing and gracing processing are allotted to transformer 4, and "Stuttering" and "Floating" representing stuttering and floating processing are allotted to transformer 5.

For each of transformers 1–5, the first-said modifier is selected when the magnitude of velocity data is equal to or smaller than a predetermined value, and the second-said modifier is selected when the magnitude of velocity data is greater than the predetermined value.

Figure 16A:
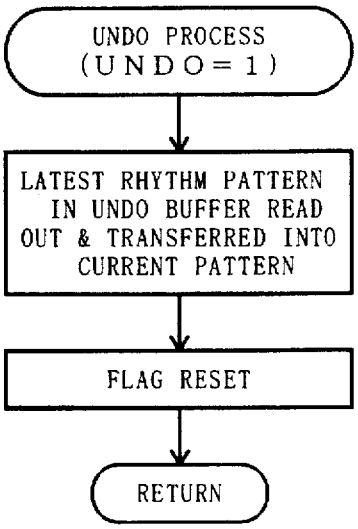
FIG. 16A is a flowchart illustrating a detailed example of an undo process which is performed in second flag-correspondent processing (step 43) of FIG. 14.
Figure 16B:
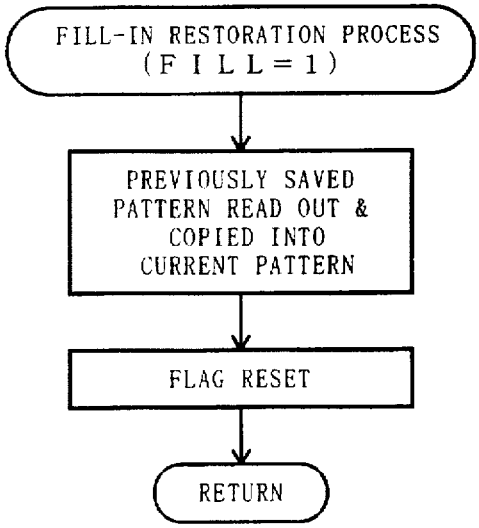
FIG. 16B is a flowchart illustrating a detailed example of a fill-in restoration process which is performed in the second flag-correspondent processing of FIG. 14.
Figure 16C:
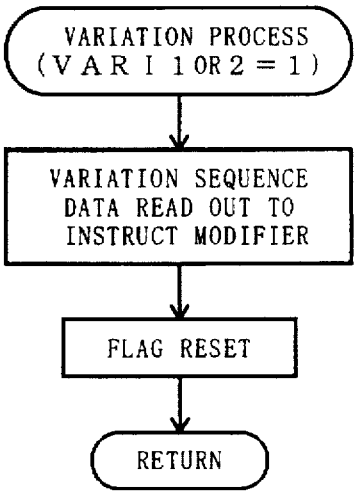
FIG. 16C is a flowchart illustrating a detailed example of a variation process which is performed in the second flag-correspondent processing of FIG. 14.
Figure 16D:
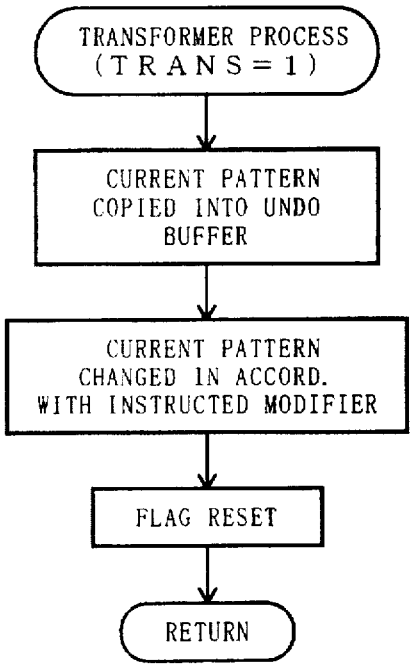
FIG. 16D is a flowchart illustrating a detailed example of a transformer process which is performed in the second flag-correspondent processing of FIG. 14.

When the transformer flag TRANS is at high level "1", transformer 9 executes transformer key processing of FIG. 16D to change the contents of the current pattern in accordance with the selected modifier.

Each of the processing represented by the above-mentioned modifiers will be described below.

The complexing processing (Complex) is done in either of the following two styles. In the first style, the complexing processing is achieved by searching through the data base means 5 for a triplet note pattern corresponding to a preselected pattern prototype called "template" and then adding the searched-out note pattern to the current pattern. In the second style, the complexing processing is achieved by randomly extracting from the data base means 5 such drum sound which constitutes a non-crash component and then adding the extracted drum sound to the current pattern.

The simplifying processing (Simple) is done in any of the following three styles. In the first style, the simplifying processing is achieved by searching through the data base means 5 for a rhythm pattern which is closer to a basic rhythm pattern than that of bus drum (BD) and snare drum (SD) of the current pattern, and then replacing the current pattern with the searched-out rhythm pattern. In the second style, the simplifying processing is achieved by searching through the data base means 5 for a rhythm pattern which is closer to a basic rhythm pattern than that of high hat (HHC, HHO) in the current pattern, and then replacing the current pattern with the searched-out rhythm pattern. In the third style, the simplifying processing is achieved by removing, from the current pattern, rhythm pattern of a component comprising drum sounds other than those of the above-mentioned bus drum (BD), snare drum (SD) or high hat (HHC, HHO).

The hardening processing (Hard) is done in either of the following two styles. In the first style, the processing is achieved by uniformly increasing all the velocity data of the rhythm pattern in the current pattern. In the second style, the processing is achieved by changing the drum sounds in the current pattern from those of a softening component to those of a hardening component.

Here, among such drum sounds forming the hardening component are bus drum (BD), snare drum (SD), tom tom (Tom H, Tom M, Tom L), cowbell (Cowbell), agogo (Agogo H, Agogo L), hand claps (Claps) and crash cymbals (Crash CY), while among such drum sound forming the softening component are claves (Clave), tambourine (Tamb), high hat (HHC, HHO), ride cymbals (CY), conga (Conga H, Conga L), wood block and shaker. Wood block and shaker are listed here just by way of example as the softening component forming drum sound, although they are not actually allotted to the keyboard in this embodiment.

The softening processing (Soft) is done in either of the following two styles. In the first style, the processing is achieved by uniformly decreasing all the velocity data of the rhythm pattern in the current pattern. In the second style, the processing is achieved by changing the drum sounds in the current pattern from those of a hardening component to those of a softening component.

Further, the energizing processing (Energetic) is done in any of the following three styles. In the first style, the processing is achieved by increasing the number of template-based note patterns within the current pattern. In the second style, the processing is achieved by causing the tempo speed to approach about "120". In the third style, the processing is achieved by causing the rhythm pattern in the current pattern to approach a triplet rhythm pattern on the basis of the template (shuffling process).

The calming processing (Calm) is done in any of the following three styles. In the first style, the processing is achieved by decreasing the number of the number of template-based note patterns within the current pattern. In the second style, the processing is achieved by causing the tempo speed to approach an approximate value of "60". In the third style, the processing is achieved by causing the rhythm pattern in the current pattern to approach a non-triplet rhythm pattern on the basis of the template (non-shuffling process).

Furthermore, the mechanizing processing (Mechanical) is done in any of the following four styles. In the first style, the processing is achieved by quantizing the rhythm pattern in the current pattern to within a resolution of sixteenth note. In the second style, the processing is achieved by, on the basis of a template for bus drum (BD) or snare drum (SD), quantizing the rhythm pattern in the current pattern to within a resolution of eighth note. In the third style, the processing is achieved by changing the drum sounds in the current pattern from those of a softening component to those of a hardening component. In the fourth style, the processing is achieved by compressing the velocity data to a value centering around "90".

Furthermore, the gracing processing (Graceful) is done in any of the following four styles. In the first style, the processing is achieved by extending the velocity data in opposite directions about a value of 64. In the second style, the processing is achieved by adding triplet note pattern to the current pattern on the basis of a template. In the third style, the processing is achieved by changing the drum sounds in the current pattern from those of a hardening component to those of a softening component. In the fourth style, the processing is achieved by applying flutter (decorative sound) to the drum sound in the current pattern.

Moreover, the stuttering processing (Stuttering) is done in either of the following two styles. In the first style, the processing is achieved by, on the basis of a template, replacing downbeat in the rhythm pattern of the current pattern with upbeat (syncopation process). In the second style, the processing is achieved by adding triplet note pattern to the current pattern on the basis of a template.

Finally, the floating processing (Floating) is done in any of the following five styles. In the first style, the processing is achieved by, on the basis of a template, replacing upbeat in the rhythm pattern of the current pattern with downbeat (non-syncopation process). In the second style, the processing is achieved by, on the basis of a template, decreasing the number of triplet note patterns in the current pattern. In the third style, the processing is achieved by, on the basis of a template, adding 12/8-triplet note pattern to the current pattern. In the fourth style, the processing is achieved by changing the drum sounds in the current pattern from those of a hardening component to those of a softening component. In the fifth style, the processing is achieved by causing the tempo speed to approach to an approximate value of "120".

Figure 9D:
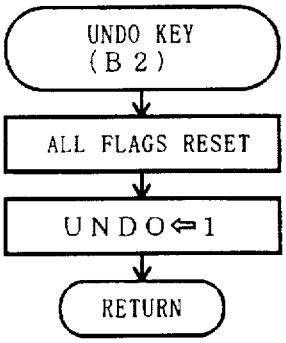
FIG. 9D is a flowchart illustrating a detailed example of the processing of FIG. 8B which is carried out in such a case where the received MIDI message is a note-on message corresponding to an undo key of note number B2.

The processing of FIG. 9D is undo key processing which is carried out when actuation has been made of the undo key corresponding to note number B2 on the keyboard and thus a MIDI message containing such note number B2 has been received from the electronic musical instrument.

In the undo key processing, all associated flags are first reset to low level "0" and then undo flag UNDO is set to "1", after which the program returns to the main routine.

When the undo flag UNDO is at high level "1", the undo means 10 executes an undo process as shown in FIG. 16A to read out one of the previous rhythm patterns and then copy the read-out rhythm pattern into the current pattern. In this way, if the pattern changed by the transformer 9 is not satisfactory, any desired previous rhythm pattern can be restored. Namely, because in this embodiment the undo buffer 3 sequentially stores a total of 20 rhythm patterns, it is possible to restore any desired previous pattern by reading backwardly the buffer 3 in response to actuation of the undo key.

Figure 9F:
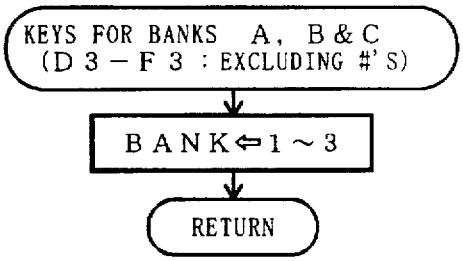
FIG. 9F is a flowchart illustrating a detailed example of the processing of FIG. 8B which is carried out in such a case where the received MIDI message is a note-on message corresponding to any of bank keys of note numbers D3 to F3 (excluding #'s)
Figure 9E:
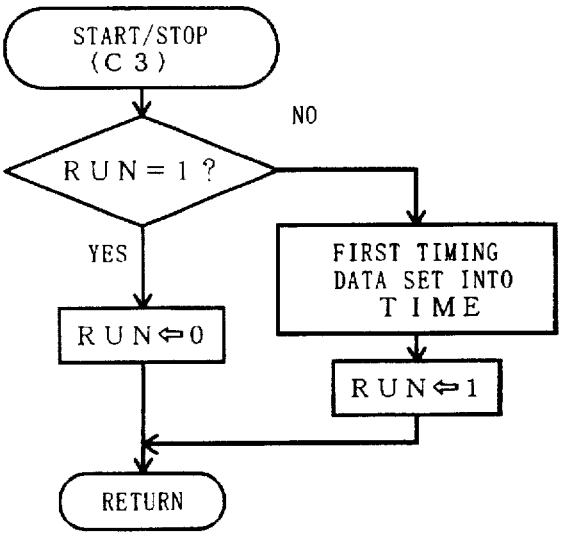
FIG. 9E is a flowchart illustrating a detailed example of the processing of FIG. 9B which is carried out in such a case where the received MIDI message is a note-on message corresponding to a start/stop key of note number C3.

Processing of FIG. 9E is start/stop key processing which is carried out when actuation has been made of the start/stop key corresponding to note number C3 on the keyboard and thus a MIDI message containing such note number C3 has been received from the electronic musical instrument 1F.

In this start/stop key processing, it is determined whether run state flag RUN is at high level "1", and different processing is executed depending on the determination result. The run state flag RUN indicates whether the current pattern is being read out from the current pattern memory 1.

Therefore, if it has been ascertained that the run state flag RUN is at high level "1" (YES), the flag RUN is set to low level "0" to stop reading, and then the program returns to the main routine. If it has been ascertained that the run state flag RUN is at low level "0" (NO), the first timing data in the current pattern memory 1 is set into timing register TIME to start reading and the run state flag RUN is set to high level "1", and then the program returns to the main routine. In response to this, current patterns are sequentially read out from the current pattern memory 1 by timer interrupt processing of FIG. 14.

The processing of FIG. 9F is bank key processing which is carried out when actuation has been made of one of the bank keys for banks A–C corresponding to note numbers D3–F3 (excluding #'s) on the keyboard and thus a MIDI message containing any of note numbers D3–F3 (excluding #'s) has been received from the electronic musical instrument 1F.

In this bank key processing, one of the values "1", "2" and "3" is stored into bank register BANK, and then the program returns to the main routine. According to the embodiment, "1" is stored when actuation has been made of the bank key for bank A corresponding note number D3, "2" is stored when actuation has been made of the bank key for bank B corresponding note number E3, and "3" is stored when actuation has been made of the bank key for bank C corresponding note number F3. In this manner, bank switching in the data base means 5 is effected depending on the bank key actuated. Then, when a component has been designated later, a specific rhythm pattern is read out from that bank and stored into the current pattern memory 1.

Figure 10A:
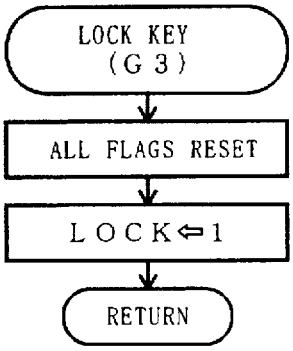
FIG. 10A is a flowchart illustrating a detailed example of the processing of FIG. 8B which is carried out in such a case where the received MIDI message is a note-on message corresponding to a lock key of note number G3.

FIG. 10A illustrates lock key processing which is carried out when actuation has been made of the lock key corresponding to note number G3 on the keyboard and thus a MIDI message containing that note number G3 has been received from the electronic musical instrument 1F.

In this lock key processing, all associated flags are reset to low level "0" and lock flag LOCK is set to high level "1", after which the program returns to the main routine.

The rhythm pattern read out from the data base means 5 is normally available or effective only when any of the keys in the drum pattern area is being operated, but by actuating this lock key, the contents of the rhythm pattern are made effective or locked so that the rhythm pattern remains available even after the key in the drum pattern area is released.

Figure 10B:
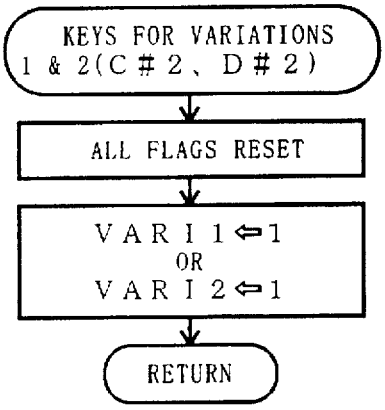
FIG. 10B is a flowchart illustrating a detailed example of the processing of FIG. 8B which is carried out in such a case where the received MIDI message is a note-on message corresponding to any of variation keys of note numbers C#2 and D#2.

FIG. 10B illustrates variation key processing which is carried out when actuation has been made of any of the keys for variations 1 and 2 corresponding to note numbers C#2 and D#2 on the keyboard and thus a MIDI message containing any of such note numbers C#2 and D#2 has been received from the electronic musical instrument 1F.

In this variation key processing, all associated flags are first reset to low level "0" and then variation flags VAR1 and VAR12 are set to high level "1", after which the program returns to the main routine. This causes a variation pattern (modifier sequence of FIG. 3) to be read out when the current pattern readout has advanced to a measure bar.

Figure 10C:
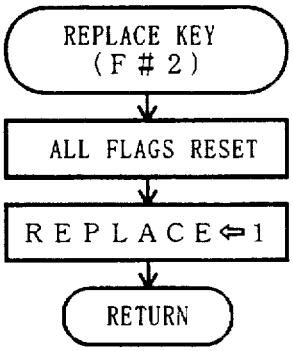
FIG. 10C is a flowchart illustrating a detailed example of the processing of FIG. 8B which is carried out in such a case where the received MIDI message is a note-on message corresponding to a replace key of note number F#2.

FIG. 10C illustrates replace key processing which is carried out when actuation has been made of the replace key corresponding to note number F#2 on the keyboard and thus a MIDI message containing such note number F#2 has been received from the electronic musical instrument 1F.

In this replace key processing, all associated flags are first reset to low level "0" and then replace flag REPLACE is set to high level "1", after which the program returns to the main routine. Consequently, when any of the keys in the drum pattern area has been actuated while the replace key is being depressed, processing of FIG. 11D is executed such that the corresponding drum sound is newly input to the position of the key operation timing, replacing the preceding corresponding drum sound.

Figure 10D:
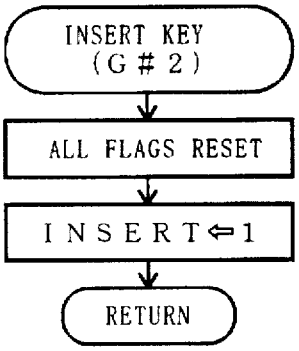
FIG. 10D is a flowchart illustrating a detailed example of the processing of FIG. 8B which is carried out in such a case where the received MIDI message is a note-on message corresponding to an insert key of note number G#2.

FIG. 10D illustrates insert key processing which is carried out when actuation has been made of the insert key corresponding to note number G#2 on the keyboard and thus a MIDI message containing such note number G#2 has been received from the electronic musical instrument 1F.

In this insert key processing, all associated flags are reset to low level "0" and then insert flag INSERT is set to high level "1", after which the program returns to the main routine. Consequently, when any of the keys in the drum pattern area has been actuated while the replace key is depressed, the corresponding drum sound is newly input to the position of the key operation timing. Thus, the new drum sound is added without the preceding drum sound being eliminated.

Figure 10E:
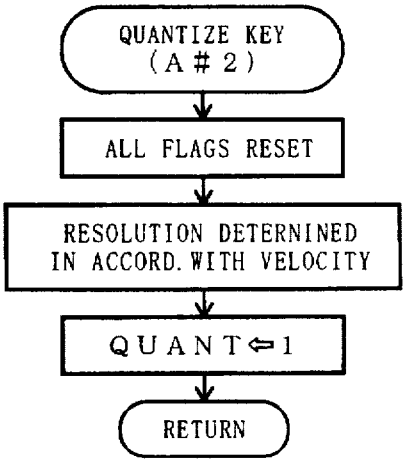
FIG. 10E is a flowchart illustrating a detailed example of the processing of FIG. 8B which is carried out in such a case where the received MIDI message is a note-on message corresponding to a quantize key of note number A#2.

FIG. 10E illustrates quantize key processing which is carried out when actuation has been made of the quantize key corresponding to note number A#2 on the keyboard and thus a MIDI message containing such note number A#2 has been received from the electronic musical instrument 1F. In this quantize key processing, all associated flags are reset to low level "0", a quantizing resolution is determined on the basis of a then-detected velocity data magnitude, and then quantize flag QUANT is set to high level "1". After that, the program returns to the main routine.

Consequently, once the current pattern readout has advanced to a measure line, a quantizing process is applied, in reading out rhythm patterns after the next measure line, to the data readout timing, without the data themselves being rewritten. Such processing is called quantize processing.

Figure 10F:
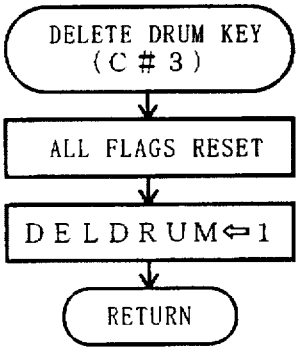
FIG. 10F is a flowchart illustrating a detailed example of the processing of FIG. 8B which is carried out in such a case where the received MIDI message is a note-on message corresponding to a delete drum key of note number C#3.

FIG. 10F illustrates delete drum key processing which is carried out when actuation has been made of the delete drum key corresponding to note number C#3 on the keyboard 1A and thus a MIDI message containing such note number C#3 has been received from the electronic musical instrument 1F.

In this delete drum key processing, all associated flags are reset to low level "0" and then delete drum flag DELDRUM is set to high level "1", after which the program returns to the main routine. Consequently, once a note-on message of, for example, note number C4 has been detected later, the drum sound corresponding to note number C4 (Tom Tom L) is eliminated from the current pattern.

Figure 11A:
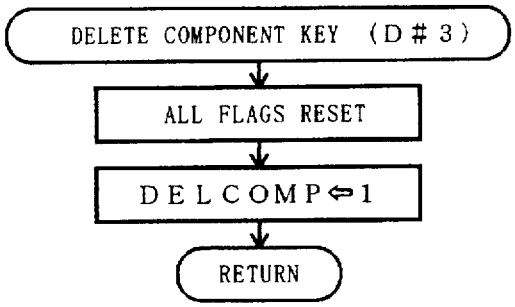
FIG. 11A is a flowchart illustrating a detailed example of the processing of FIG. 8B which is carried out in such a case where the received MIDI message is a note-on message corresponding to a delete component key of note number D#3.
Figure 11B:
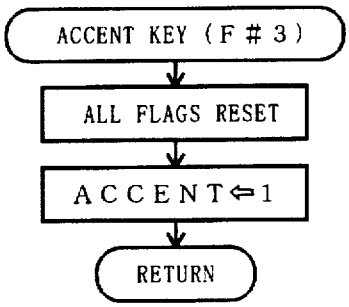
FIG. 11B is a flowchart illustrating a detailed example of the processing of FIG. 8B which is carried out in such a case where the received MIDI message is a note-on message corresponding to an accent key of note number F#3.

FIG. 11A illustrates delete component key processing which is carried out when actuation has been made of the delete component key corresponding to note number D#3 on the keyboard 1A and thus a MIDI message containing note number D#3 has been received from the electronic musical instrument 1F.

In this delete component key processing, all associated flags are reset to low level "0" and then delete component flag DELCOMP is set to high level "1", after which the program returns to the main routine. Consequently, once a note-on message of, for example, note number C4 has been detected later, all drum sounds of each component containing tom tom low (Tom L)) note number C4 (Tom Tom High (Tom H), tom tom middle (Tom M)) and tom tom low (Tom L)) are eliminated from the current pattern.

FIG. 11B illustrates accent key processing which is carried out when actuation has been made of the accent key corresponding to note number F#3 on the keyboard 1A and thus a MIDI message containing note number F#3 has been received from the electronic musical instrument 1F.

In this accent key processing, all associated flags are reset to low level "0" and then accent flag ACCENT is set to level "1", after which the program returns to the main routine. Consequently, once a note-on message of, for example, note number C4 has been detected later and a note event of the same note number has been read out before a corresponding note-off message of the note number is detected, the velocity of the note event is rewritten into the note-on velocity of C4.

Figure 11C:
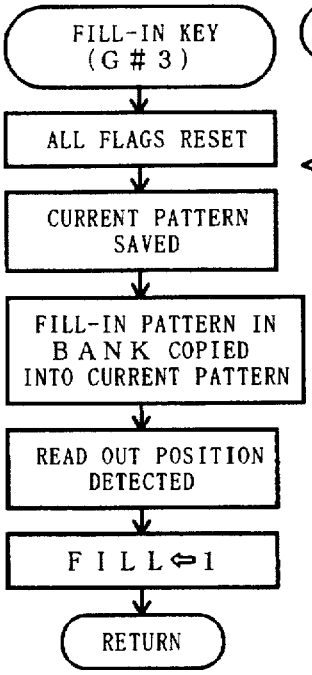
FIG. 11C is a flowchart illustrating a detailed example of the processing of FIG. 8B which is carried out in such a case where the received MIDI message is a note-on message corresponding to a fill-in key of note number G#3.
Figure 11D:
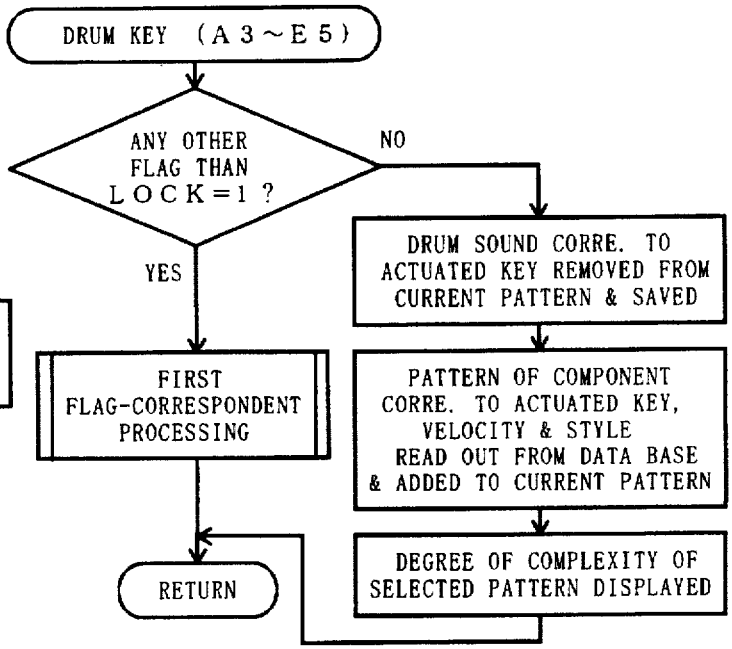
FIG. 11D is a flowchart illustrating a detailed example of the processing of FIG. 8B which is carried out in such a case where the received MIDI message is a note-on message corresponding to any of drum keys of note numbers A3 to E5.

FIG. 11C illustrates fill-in key processing which is carried out when actuation has been made of the fill-in key corresponding to note number G#3 on the keyboard 1A and thus a MIDI message containing note number G#3 has been received from the electronic musical instrument 1F.

In this fill-in key processing, all associated flags are reset to low level "0" and then the current pattern in the current pattern memory 1 is temporarily saved into the save memory 4. Subsequently, a fill-in pattern in the corresponding bank A, B, C in the data base means 5 is copied into the current pattern memory 1, and detection is made of its readout position (position in the pattern corresponding to the timing within the current measure). After that, fill-in flag FILL is set to high level "1", and then the program returns to the main routine. Consequently, the fill-in pattern is performed from the time of actuation of the fill-in key corresponding to note number G#3 through to the end of the measure.

FIG. 11D illustrates drum key processing which is carried out when actuation has been made of any of the keys in the drum pattern area corresponding to note numbers A3–E5 on the keyboard 1A and thus a MIDI message containing any of these note numbers A3–E5 has been received from the electronic musical instrument 1F.

In this drum key processing, it is determined whether any of the flags other than the lock flag LOCK (the replace flag REPLACE, insert flag INSERT, delete drum flag DELDRUM and delete component flag DELCOMP) is at high level "1", and different processing is executed depending on the determination result.

Namely, if the note number is one of A3–E5, this represents designation of a drum sound (single sound) or of a component. So, if it has been ascertained that any of the flags other than the lock flag LOCK is at high level "1" (YES), first flag-correspondent processing corresponding to the high level flag is carried out, and then the CPU returns to the main routine. The first flag-correspondent processing is illustrated in detail in FIG. 12.

It, on the other hand, it has been ascertained that none of the flags other than the lock flag LOCK is at high level "1" (NO), one or more drum sounds of the component corresponding to the actuated drum pattern area key (note number) are removed from the current pattern and temporarily stored into the save memory 4. Then, rhythm pattern of the component corresponding to the actuated key (note number), velocity data and bank is read out from the data base means 5 and added to the current pattern.

The degree of complexity of the selected rhythm pattern is presented on the display as shown in FIG. 5.

Consequently, only by actuating one of the keys corresponding to A3–E5, it is allowed to selectively add the rhythm pattern of the component corresponding to the note number, in accordance with the magnitude of velocity data. Since, as previously mentioned, the pattern table 63 sequentially stores the head addresses of the rhythm patterns in such a manner that the pattern become more complex as the velocity value becomes greater as shown in FIG. 4, it is possible to finely select the kind of rhythm pattern.

FIG. 12 illustrates the detail of the first flag-correspondent processing which is carried out when any of the flags other than the lock flag LOCK, i.e., the replace flag REPLACE, insert flag INSERT, delete drum flag DELDRUM and delete component flag DELCOMP is at high level "1". The first flag-correspondent processing includes a replace process, insert process, delete drum process and delete drum process.

Figure 12A:
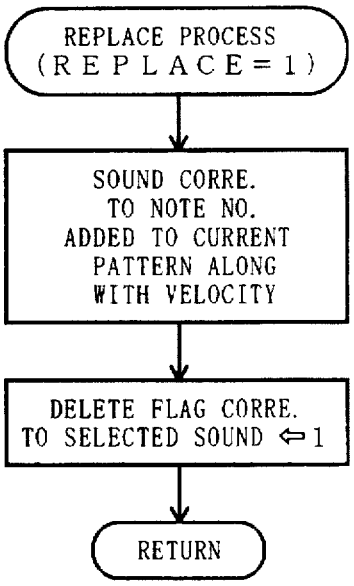
FIG. 12A is a flowchart illustrating a detailed example of a replace process which is performed in first flag-correspondent processing of FIG. 11D.

More specifically, FIG. 12A illustrates the replace process which is carried out when any of the keys in the drum pattern area has been actuated while the replace key corresponding to note number F#2 on the keyboard 1A is in the depressed, i.e., ON state. Namely, during the time when the replace key is in the depressed state, the replace flag REPLACE is set at high level "1" as the result of the replace key processing of FIG. 10C, and accordingly, it is ascertained in the drum key processing of FIG. 11D that the replace flag REPLACE other than the lock flag LOCK is at high level "1". Such an ascertainment in the drum key processing triggers this replace process.

In this replace process, the selected drum sound corresponding to the actuated key is added to the current pattern along with the associated velocity data. Subsequently, the delete flag corresponding to the selected drum sound is set to high level "1", and then the program returns to the drum key processing of FIG. 1D. The drum sound for which delete flag has thus been set to high level "1" is removed from the current pattern in step 56 of FIG. 15.

Figure 12B:
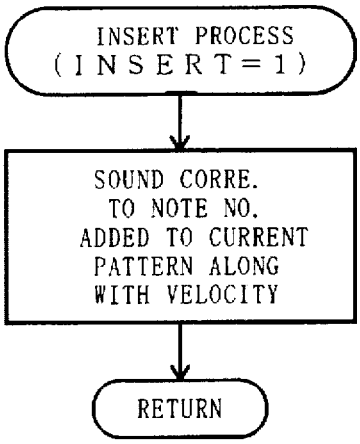
FIG. 12B is a flowchart illustrating a detailed example of an insert process which is performed in the first flag-correspondent processing of FIG. 11D.

FIG. 12B illustrates the insert process which is carried out when any of the keys in the drum pattern area has been actuated while the insert key corresponding to note number G#2 on the keyboard 1A is in the depressed state. Namely, during the time when the insert key is in the depressed state, the insert flag INSERT is set at high level "1" as the result of the insert key processing of FIG. 10D, and accordingly, it is ascertained in the drum key processing of FIG. 10D that the insert flag INSERT other than the lock flag LOCK is at high level "1". Such an ascertainment in the drum key processing triggers the insert process.

In this insert process, the selected drum sound corresponding to the actuated key is added to the current pattern along with the associated velocity data, and then the program returns to the drum key processing of FIG. 11D.

Figure 12C:
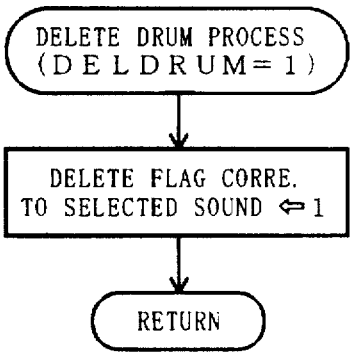
FIG. 12C is a flowchart illustrating a detailed example of a delete drum process which is performed in the first flag-correspondent processing of FIG. 11D.

FIG. 12C illustrates the delete drum process which is carried out when any of the keys in the drum pattern area has been actuated while the delete drum key corresponding to note number C#3 on the keyboard 1A is in the depressed state. Namely, during the time when the delete drum key is in the depressed state, the delete drum flag DELDRUM is set at high level "1" as the result of the delete drum key processing of FIG. 10F, and accordingly, it is ascertained in the drum key processing of FIG. 11D that the delete drum flag DELDRUM other than the lock flag LOCK is at high level "1". Such an ascertainment in the drum key processing triggers the delete drum process.

In this delete drum process, the delete flag corresponding to the selected drum sound is set to high level "1", and then the program returns to the drum key processing of FIG. 1D. The selected drum sound for which delete flag has thus been set to high level "1" is removed from the current pattern in step 54 of FIG. 15.

Figure 12D:
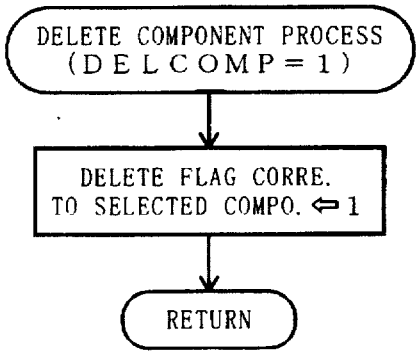
FIG. 12D is a flowchart illustrating a detailed example of a delete component process which is performed in the first flag-correspondent processing of FIG. 11D.

FIG. 12D illustrates the delete drum process which is carried out when any of the keys in the drum pattern area has been actuated to select a drum sound while the delete component key corresponding to note number D#3 on the keyboard 1A is in the depressed state. Namely, during the time when the delete component key is in the depressed state, the delete component flag DELCOMP is set at high level "1" as the result of the delete component key processing of FIG. 11A, and accordingly, it is ascertained in the drum key processing of FIG. 11D that the delete component flag DELCOMP other than the lock flag LOCK is at high level "1". Such an ascertainment in the drum key processing triggers the delete drum process.

In this delete drum process, the delete flag corresponding to a component containing the selected drum sound is set to high level "1", and then the program returns to the drum key processing of FIG. 1D. The drum sound forming the component for which delete flag has thus been set to high level "1" is removed from the current pattern in step 54 of FIG. 15.

FIG. 13 illustrates in detail the note number-correspondent processing of FIG. 8B which is carried out in such a case where a received MIDI message is a note-off message.

Figure 13A:
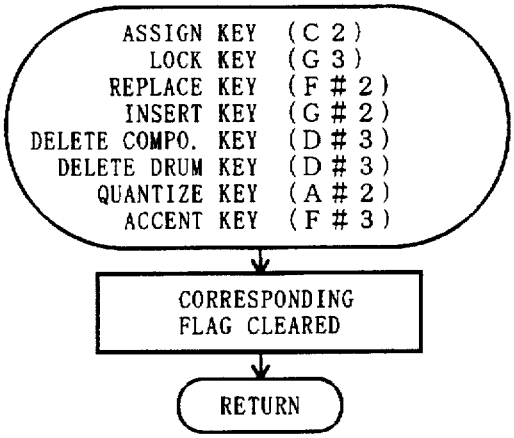
FIG. 13A is a flowchart illustrating a detailed example of the processing of FIG. 8B which is carried out in such a case where the received MIDI message is a note-off message corresponding to any of note numbers C2, G3, F#2, G#2, A#2, C#3, D#3 and F#3.

More specifically, in FIG. 13A, when actuation has been made of the assign key corresponding to note number C2 on the keyboard 1A, lock key corresponding to note number G3, replace key corresponding to note number F#2, insert key corresponding to note number G#2, quantize key corresponding to note number A#2, delete drum key corresponding to note number C#3, delete component key corresponding to note number D#3, or accent key corresponding to note number F#3, and thus a MIDI message containing such note number C2, G3, F#3, G#2, A#2, C#3, D#3 or F#3 has been received from the musical instrument 1F, the flag is cleared which has been set to high level "1" in one of the key processing of FIGS. 9 to 11 corresponding to the above-mentioned note numbers.

Figure 13B:
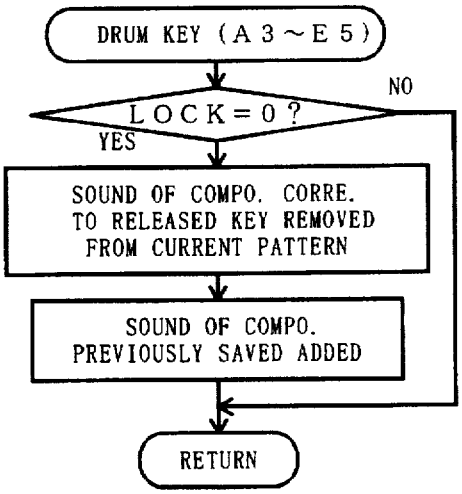
FIG. 13B is a flowchart illustrating a detailed example of the processing of FIG. 8B which is carried out in such a case where the received MIDI message is a note-off message corresponding to any of note numbers A3 to E5.

The processing of FIG. 13B is drum key processing which is executed when any of the drum pattern area keys corresponding to note numbers A3–E5 has been released or deactuated and thus a MIDI message containing a note-off message of any of note numbers A3–E5 has been received from the electronic musical instrument 1F.

In this drum key processing, it is first determined whether or not the lock flag LOCK is at low level "0". The CPU 21 executes the following operations if the determination result is YES, but if the result is NO, it returns to the main routine of FIG. 8A in order to make a rhythm pattern being read out from the data base means 5 effective.

If the lock flag LOCK is at low level "0", the drum sound (single sound) or component drum sounds corresponding to the released key are removed from the current pattern, and the component drum sounds previously saved in the processing of FIG. 11D are restored into the current pattern.

Figure 14:
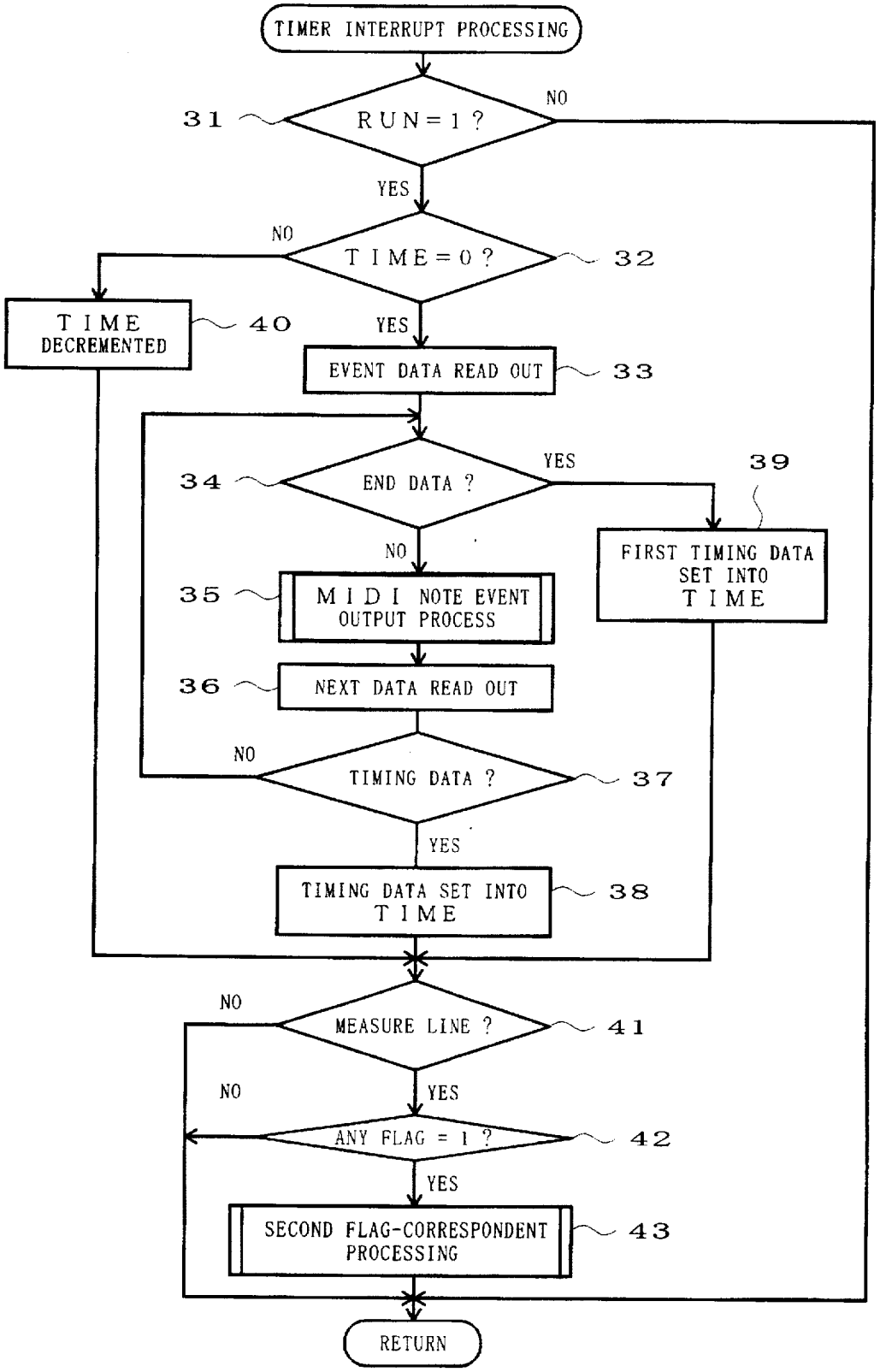
FIG. 14 is a flowchart of timer interrupt processing which is carried out at an interrupt frequency of 24 times per quarter note.

FIG. 14 is a flowchart of timer interrupt processing which is carried out at an interrupt rate of, for example, 480 times per quarter note. This timer interrupt processing is conducted in accordance with the tempo at which current pattern is read out from the current pattern memory 1; that is, the interrupt period can be varied with the readout tempo. The timer interrupt processing is carried out in the following sequence.

Step 31: It is determined whether or not the run state flag RUN is at high level "1". If the flag RUN is at high level "1" (YES), the program goes to next step 32; otherwise (NO), the program returns to the main routine.

Step 32: It is determined whether or not the value of time register TIME storing the timing data is "0", i.e., the time to a next note event has passed. If the value is "0" (YES) meaning that the time to the next note has passed, the program goes to next step 33. But if the value is not "0" (NO) meaning that the time to the next note event has not passed, the program goes to step 40.

Step 33: Because of the ascertainment in the above-mentioned step 32 that the time to the next note event has passed, this step reads out event data corresponding to the timing.

Step 34: It is determined whether or not the event data read out in the above-mentioned step 33 is end data. The program goes to step 39 if the read-out data is end data, but it goes to step 35 if the read-out data is other than end data.

Step 35: Because of the ascertainment in step 43 that the event data read out in step 33 is other than end data, a MIDI note event (MIDI message) is output to the electronic musical instrument 1F via the MIDI interfaces 2C and 1D as will be described in detail later.

Step 36: Data next to the event data having been read out in step 33 is read out.

Step 37: It is determined whether or not the data read out in step 36 is timing data. The program goes to step 38 if the determination result is YES, but otherwise it goes back to step 34. Therefore, if the data read out in step 36 is end data, YES determination is obtained in step 34 and then step 39 is taken, but if the read out data is event data, steps 35 and 36 are taken.

Step 38: The read-out timing data is set into the time register TIME.

Step 39: Because of the ascertainment in step 34 that the read-out data is end data, the first timing data of the rhythm pattern is set into the time register TIME, and the program goes to step 41.

Step 40: Because of the ascertainment in step 32 that the time has not passed, the time register TIME is decremented only by one, and then the program goes to step 41.

Step 41: It is determined whether or not the readout timing within a measure (counted by an unillustrated counter) corresponds to the timing of a measure line. The program goes to step 41 if the determination result is YES, but it returns to the main routine if the result is NO.

Step 42: It is determined whether or not any of the flags is at high level "1". If any of the flags is at high level "1" (YES), step 43 is taken, but if NO, the processing returns to the main routine.

Step 43: Because it has been ascertained in step 42 that any of the flags is at high level "1", second flag-correspondent processing corresponding to the flag at high level "1" is executed, and then the program returns to the main routine. The detail of the second flag-correspondent processing will be described later in connection with FIG. 16.

Figure 15:
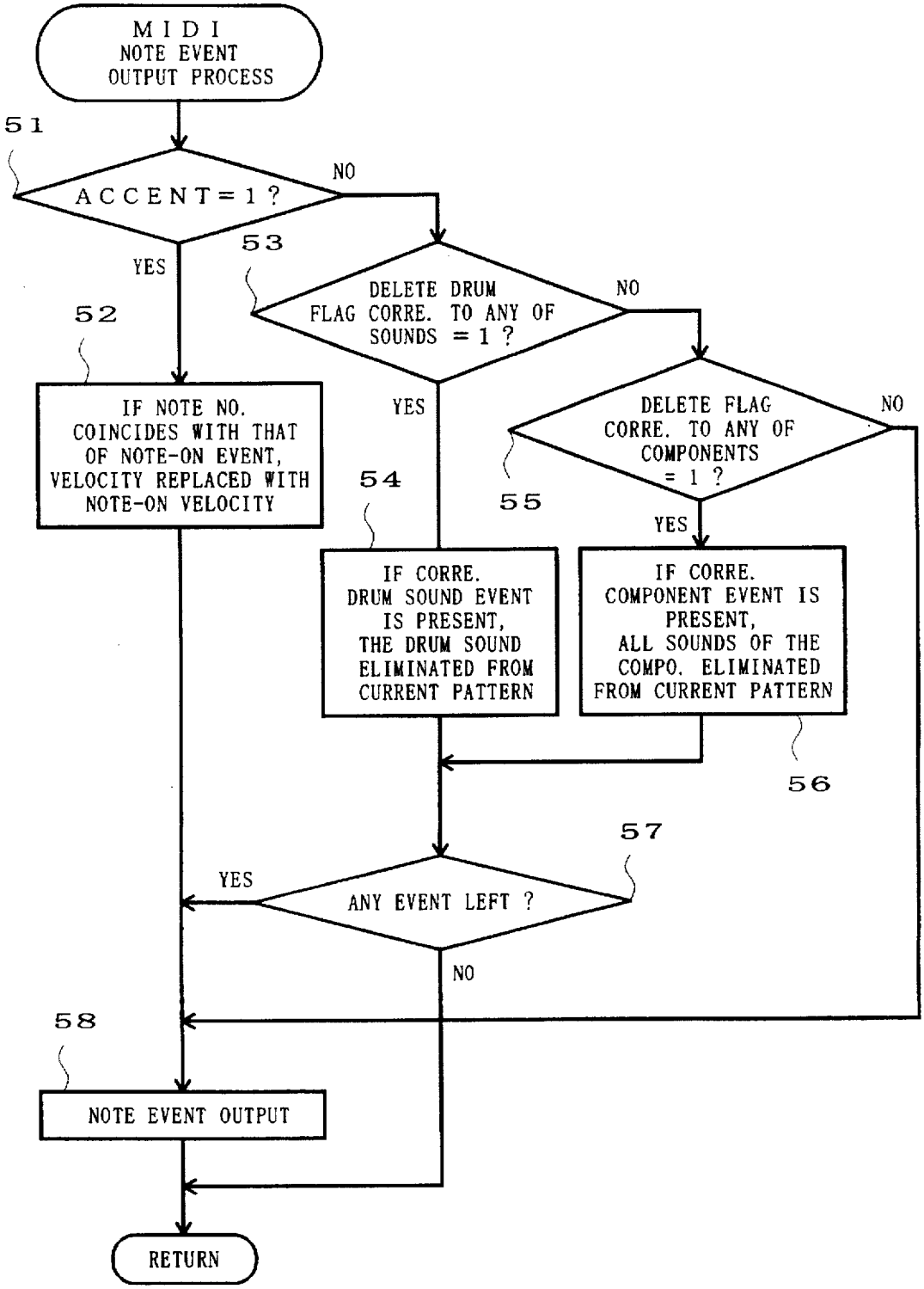
FIG. 15 is a flowchart illustrating a detailed example of a MIDI note event output process (step 35) of FIG. 14.

FIG. 15 is a flowchart illustrating the detail of the MIDI note event output process shown in step 35 of FIG. 14.

In this MIDI note event output process, if any of the accent flag ACCENT, delete drum flag DELDRUM and delete component flag DELCOMP is at high level "1", specific processing corresponding to the high level flag is carried out. Otherwise, the note event output process is carried out which corresponds to the rhythm pattern in the current pattern memory 1. This processing is executed in the following sequence.

Step 51: It is determined whether or not the accent key corresponding to note number F#3 on the keyboard 1A has been actuated or depressed and thus the accent flag ACCENT is at high level "1". If YES, next step 52 is taken, but if NO, step 53 is taken.

Step 52: If the note number of the read-out note event coincides with the note number of the received note event (note-on event), the velocity of the read-out note event is replaced with that of the received note-on message.

Step 53: It is determined whether or not the delete drum key corresponding to note number C#3 on the keyboard 1A has been depressed and thus the delete drum flag DELDRUM corresponding to any of the drum sounds has been set to high level "1". If the determination result is YES, step 54 is taken, but if NO, step 55 is taken.

Step 54: If event of the drum sound corresponding to the received note number is present among the events read out from the current pattern memory 1, the drum sound is eliminated from the read-out current pattern events.

Step 55: It is determined whether or not the delete component key corresponding to note number D#3 on the keyboard 1A has been depressed and thus the delete component flag DELCOMP corresponding to any of the components has been set to high level "1". If the determination result is YES, step 56 is taken, but if NO, step 59 is taken.

Step 56: If event of the drum sounds forming the component corresponding to the received note number is present among the current pattern events read out from the current pattern memory 1, all the drum sounds of the component are eliminated from the read-out current pattern events.

Step 57: It is determined whether or not there is still any event left in the read-out current pattern after the drum sound elimination in steps 54 and 56 above. The program goes to step 58 if the determination result is YES, but if NO, it returns to the main routine and then goes to step 36 of FIG. 14.

Step 58: Each note event which has undergone the accent processing in step 52 or which has been left uneliminated in step 52 or which has not undergone the operations in steps 52, 54, 56 is output to the electronic musical instrument 1F via the MIDI interfaces 2C and 1D.

FIG. 16 illustrates the detail of the second flag-correspondent processing of step 43 in FIG. 14.

The second flag-correspondent processing is carried out when any of the undo flag UNDO, fill-in flag FILL-IN, variation flags VARI1, VARI2 and transformer flag TRANS is at high level "1".

FIG. 16A illustrates an undo process included in the second flag-correspondent processing which is carried out when the undo flag UNDO is set at high level "1" (UNDO=1) in response to depression or actuation of the undo key corresponding to note number B2 on the keyboard 1A.

In this undo process, the latest rhythm pattern stored in the undo buffer 3 is read out and transferred into the current pattern memory 1 as a current pattern, and then the undo flag UNDO is reset to low level "0".

FIG. 16B illustrates a fill-in restoration process which is carried out when the fill-in flag FILL is set at high level "1" (FILL=1) in response to depression of the fill-in key corresponding to note number G#3 on the keyboard 1A.

In this fill-in restoration process, rhythm pattern having been previously saved in the save memory 4 is read out and copied into the current pattern memory 1 as a current pattern, and then the fill-in flag FILL is reset to low level "0".

FIG. 16C illustrates a variation process which is carried out when either of the variation flags VARI1 or VARI2 is set at high level "1" (VARI1 or VARI2=1) in response to depression of the variation key corresponding to note number D#2 or C#2 on the keyboard 1A.

In this variation process, because variation is being instructed, a next (or first) modifier is read out from the modifier variation sequence of FIG. 3 and instructed to the transformer 9. For instance, in the case where the modifier variation sequence contains data covering four measures, the variation process is repetitively executed to complete four times of such modifier readout, with one modifier read out per execution. When four times of the modifier readout have been completed, the variation flag VARI1 or VARI2 is reset to low level "0".

FIG. 16D illustrates a transformer process which is carried out when the transformer flag TRANS is set at high level "1" (TRANS=1) in response to depression of any of the transformer key corresponding to note number D2, E2, F2, G2 or A2 on the keyboard 1A.

In this transformer process, the current pattern in the current pattern memory 1 is copied into the undo buffer 3, and then, as will be described in detail below, specific operations are executed for changing the contents of the current pattern in accordance with the instructed modifier. After that the transformer flag TRANS is reset to low level "0".

FIG. 17 shows the detail of a pattern registration process included in the other processing of FIG. 8 performed by the CPU 21 of the personal computer 20. When new rhythm pattern data in the current pattern memory 1 is to be registered into the data base mens 5, this pattern registration process detects the degree of complexity of the rhythm pattern data, determines at which level in the pattern table 63 the detected degree of complexity is located, and registers the rhythm pattern data at that level, so as to rewrite the pattern table 63.

Step 71: A detection is made of the degree of complexity of the rhythm pattern to be newly registered, and the detected degree of complexity is stored into newly registered complexity register COMP(N).

Step 72: The degree of complexity of the rhythm pattern designated by address register AD (=1) is read out from the pattern table of FIG. 2 and stored into already registered complexity COMP(D). The address register AD is provided for storing addresses of the pattern table shown in FIG. 4.

Step 73: A determination is made as to whether the degree of complexity stored in the newly registered complexity register COMP(N) is smaller than the degree of complexity stored in the already registered complexity register COMP (D). If so, the CPU 21 proceeds to step 76; otherwise, the CPU branches to step 74.

Step 74: The address register AD is incremented by one.

Step 75: The degree of complexity of the rhythm pattern designated by the address register AD is read out from the pattern tables and stored into the already registered complexity COMP(D), and the CPU 21 loops back to step 73.

That is, the operations of steps 73 to 75 detect to which address of the current pattern table 63 the complexity of the rhythm pattern to be newly registered corresponds.

Step 76: Because it has been determined in previous step 73 that the degree of complexity stored in the newly registered complexity register COMP(N) is smaller than the degree of complexity stored in the already registered complexity register COMP(D), this step moves, backward by one address, the head address of each of the rhythm patterns at and after the address designated by the address register AD and records each of the patterns as thus moved.

Step 77: The head address and complexity of the newly registered rhythm pattern is registered into the address location of the table designated by the address register AD.

FIGS. 18 to 20 show by way of example arithmetic operations for changing the current pattern by the transformer process.

The pattern changing transformer process shown in FIGS. 18 to 20 searches a note pattern to be changed on the basis of a search template (Search-template) and changes the searched-out note pattern into a predetermined note pattern on the basis of a replace template (Replace-template). In other words, a note pattern corresponding to the search template is replaced with a triplet-type rhythm pattern corresponding to the replace plate.

In the illustrated example, the search template has a data format of Search-template=(offset data) (search data) (error range data), while the replace template has a data format of Replace-template=(replace data) (velocity selection data) (drum sound selection data).

The search data and replace data each contain a rhythm pattern expressed in timing data. It is assumed in this embodiment that the values of timing data corresponding to a quarter note, eighth note, sixteenth note and thirty-second note are "480", "240" and "120" and "6", respectively. Thus, search data (0 240 360 480) of the search template shown in FIG. 18 represents a rhythm pattern equivalent to one quarter note which is composed of one eighth note and two sixteenth notes, while replace data (0 160 320) of the replace template represents a triplet note type pattern equivalent to one quarter note.

In FIG. 18, the search template is expressed as "Search-template=((0 480 960 1440) (0 240 360 480) (20 20 20 20))", and the replace template is expressed as "Replace-template=((0 160 320) (001) (011))".

The offset data (0 480 960 1440) if the search template indicates an offset amount to be applied when a rhythm pattern represented by the search data is searched through the current pattern, i.e., it is indicative of the location in the current pattern of the rhythm pattern represented by the search data. The error range data (20 20 20 20) indicates an allowance range of the search data. Accordingly, the searched-out rhythm pattern, even if it is not in accurate coincidence with the search data (0 240 360 480), can be suitably replaced with replacement data as long as it falls within the range defined by the search data plus allowance range data (0±20 240±20 360±20 480±20)=(460 to 20 220 to 260 340 to 380 460 to 20).

The replace data (0 160 320) of the replace template indicates a replacing rhythm note pattern.

Further, the velocity selection data indicates which of the velocities of the respective notes in the search data is to be used as the velocity of the replace data. More specifically, velocity selection data "0" indicates the velocity of the first data (eighth note) in the search data, velocity selection data "1" indicates the velocity of the second data (first sixteenth note), and velocity selection data "2" indicates the velocity of the third data (second sixteenth note). The data order in the velocity selection data corresponds to that in the replace data.

Namely, in the case where the velocity data is "001", the velocity of the first data (eighth) in the search data is replaced with the first and second data (first and second notes of triplet) in the replace data, and the velocity of the second data (sixteenth note) in the search data is replaced with the third data (third note of triplet).

Further, the drum sound selection data indicates which of the drum sounds of the respective notes in the search data is to be used as the drum sound of the replace data. More specifically, drum sound selection data "0" indicates the drum sound of the first data (eighth note) in the search data, drum sound selection data "1" indicates the drum sound of the second data (first sixteenth note), and drum sound selection data "2" indicates the drum sound of the third data (second triplet note). The data order in the drum selection data corresponds to that in the replace data.

Namely, in the case where the drum sound selection data is "011", the drum sound of the first data (eighth note) in the search data is replaced with that of the first data (first note of triplet) in the replace data, and the drum sound of the second data (sixteenth note) in the search data is replaced with those of the second and third data (second and third notes of triplet) in the replace data.

Figures 18A, 18B, 18C, 18D, 18E:
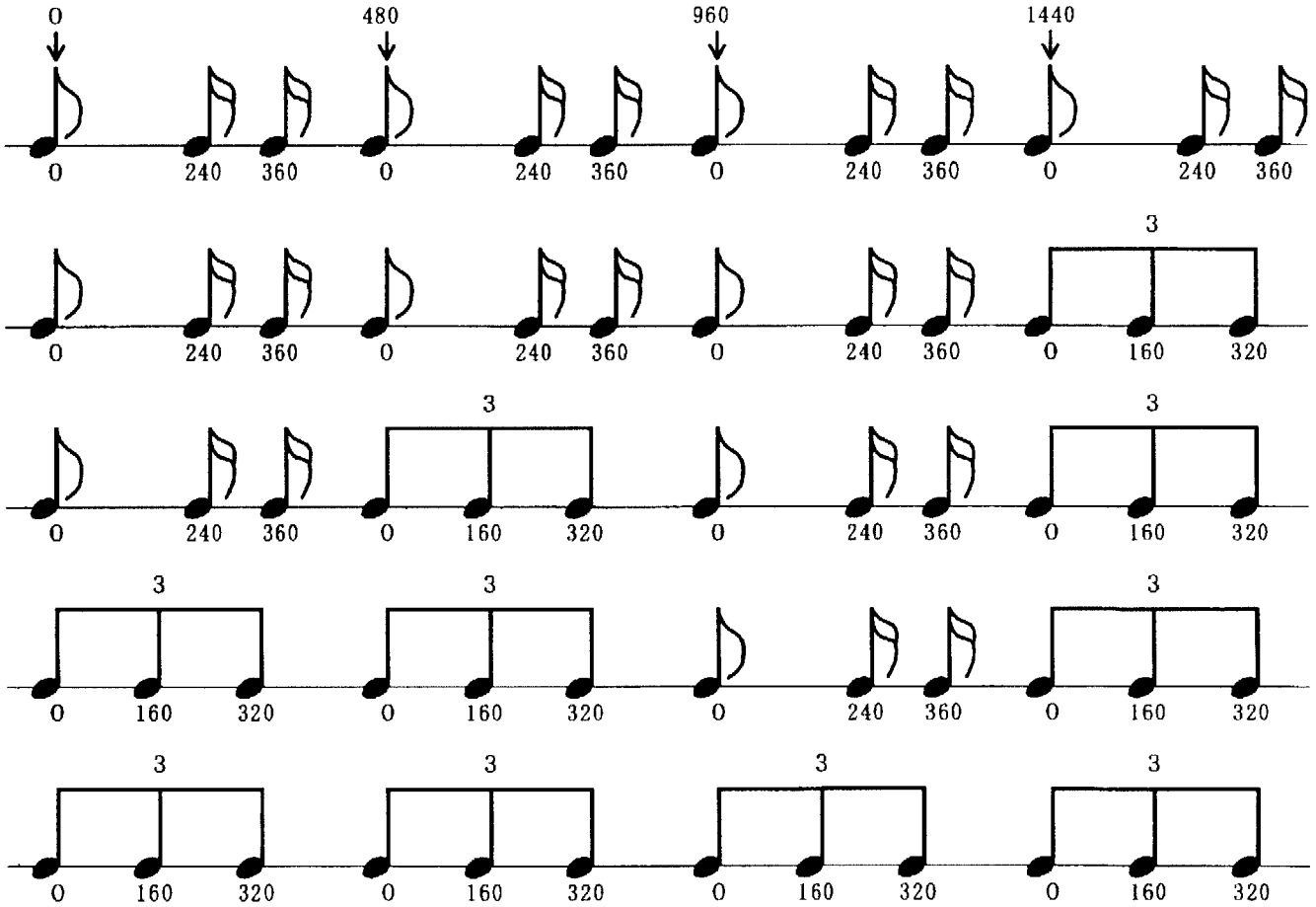
FIGS. 18A to 18E are diagrams explaining an example of arithmetic operations for changing the contents of a current pattern by the transformer process.

FIGS. 18A to 18E shows a manner in which the current pattern of FIG. 18A is sequentially transformer-processed as shown by FIGS. 18B–E in accordance with the search template ((0 480 960 1440) (0 240 360 480) (20 20 20 20)) and replace template ((0 160 320) (001) (011)).

First, in the current pattern of FIG. 18A, there are quarter-note-equivalent note patterns which start from the locations indicated by the offset data (0 480 960 1440) and correspond to the search data (0 240 360), and thus any one of the note patterns is replaced in a random fashion. In the illustrated example, the fourth rhythm pattern corresponding to the search data (0 240 360) is replaced with a triplet indicated by the replace data (0 160 320), as shown in FIG. 18B. After that, the second rhythm pattern is replaced with a triplet as shown in FIG. 18C, and then the first rhythm pattern is replaced with a triplet as seen in FIG. 18D. Finally, the third rhythm pattern is replaced a triplet as shown in FIG. 18E. In this way, the rhythm pattern of FIG. 18A is ultimately transformed into a triplet rhythm pattern as shown in FIG. 18E.

Figures 19A, 19B, 19C, 19D:
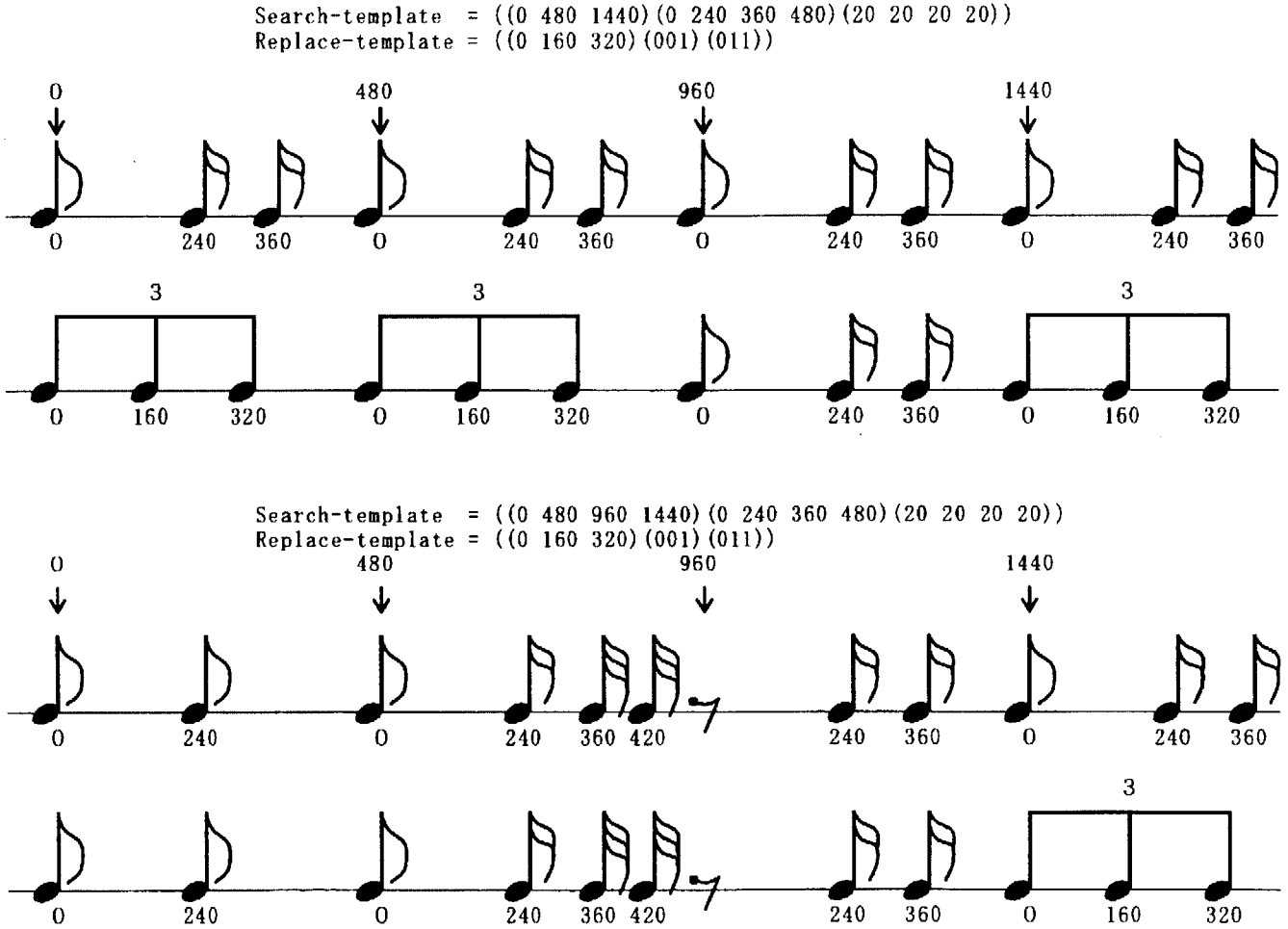
FIGS. 19A to 19D are diagrams explaining another example of the arithmetic operations for changing the contents of a current pattern by the transformer process.

FIGS. 19A and 19B are explanatory of a manner in which the current pattern of FIG. 18A is transformed in accordance with the search template ((0 480 960 1440) (0 240 360 480) (20 20 20 20)) and replace template ((0 160 320) (001) (011)).

The current pattern A of FIG. 19 is substantially the same as the one of FIG. 18A and has rhythm patterns which start from the locations indicated by the offset data (0 480 960 1440) and correspond to the search data (0 240 360). However, in FIG. 19A, the offset data of the search template is (0 480 1440) which is devoid of "960" contained in the offset data of FIG. 18. Therefore, in this case, only the third one of the rhythm patterns corresponding to the search data (0 240 360) is maintained in the original form without being replaced with a triplet as indicated by the replace data (0 160 320).

Further, FIGS. 19C and 19D are explanatory of a manner in which the current pattern of FIG. 19C is transformed in accordance with the search template ((0 480 960 1440) (0 240 360 480) (20 20 20 20)) and replace template ((0 160 320) (001) (011)).

Unlike the one of FIG. 18A, the current pattern of FIG. 19C has no rhythm pattern which starts from the locations indicated by the offset data and which corresponds to the search data (0 240 360), but it has a rhythm pattern which starts from the location indicated by the last offset data (1440). Therefore, in this case, only the fourth one of the rhythm patterns corresponding to the search data (0 240 360) is replaced with a triplet of the replace data (0 160 320), but the other note patterns are maintained in the original form.

Furthermore, FIGS. 20A to 20D show a manner in which the drum sound and velocity of a rhythm pattern are replaced in accordance with the drum sound selection data and velocity selection data.

In FIGS. 20A and 20B, search template ((0 480 960 1440) (0 240 360 480) (20 20 20 20)) and replace template ((0 160 320) (001) (011)) are the same as those of FIG. 18. Therefore, the rhythm pattern of FIG. 20A is transformed into a triplet rhythm pattern as shown in of FIG. 20B.

Since, in this case, the drum sound selection data is "011", the drum sound of the first data (eighth note) in the search data is replaced with that of the first data (first note of triplet) in the replace data, and the drum sound of the second data (sixteenth note) in the search data is replaced with those of the second and third data (second and third notes of triplet) in the replace data. Such replacements are shown by arrows between FIGS. 20A and 20B where the the first or second rhythm pattern is replaced with a triplet.

Similarly, since, in this case, the velocity selection data is "001", the velocity of the first data (eighth note) in the search data is replaced with the first and second data (first and second notes of triplet) in the replace data, and the velocity of the second data (sixteenth note) in the search data is replaced with the third data (third note of triplet). Such replacements are shown by arrows between FIGS. 20A and 20B where the the third or fourth rhythm pattern is replaced with a triplet.

In FIGS. 20C and 20D, the search template is ((0 480 960 1440) (0 240 360 480) (20 20 20 20)) which is the same as the above-mentioned, but the replace template is ((0 160 320) (001) (*) which is different from the above-mentioned only in drum sound selection data, so that the rhythm pattern of FIG. 20C is replaced with a triplet rhythm pattern as shown in FIG. 20**D in a similar manner to the above-described transformer process.

In this case, the drum sound selection data (***) comprises a combination of values "0", "1" and "2" which sequentially varies like (000), (111), (222), (012), . . . .

Accordingly, in the first rhythm pattern of FIG. 20C, the drum sound of the first data (eighth note) in the search data is replaced with the first, second and third data (first, second and third notes of triplet) in the replaced data.

In the second rhythm pattern, the drum sound of the second data (sixteenth note) in the search data is replaced with the first, second and third data (first, second and third notes of triplet) in the replaced data.

In the third rhythm pattern, the drum sound of the third data (sixteenth note) in the search data is replaced with the first, second and third data (first, second and third notes of triplet) in the replaced data.

In the fourth rhythm pattern, the drum sound of the first data (eighth note) in the search data is replaced with the first data (first note of triplet) in the replaced data, the drum sound of the second data (sixteenth note) in the search data is replaced with the second data (second note of triplet) in the replaced data, and the drum sound of the third data (sixteenth note) in the search data is replaced with the third data (third note of triplet) in the replaced data. Such replacements are shown by arrows between FIGS. 20C and 20D where each rhythm pattern is replaced with a triplet.

FIG. 21 illustrates an example of video data shown on the display 29 of FIG. 1.

A bank display section 29A indicates which of the banks in the hard disk 24 the current bank is. In the illustrated example, the section 29A indicates that the current bank is bank A.

Below the bank display section 29A is a section for indicating the state of the current pattern. This section comprises a drum sound name display section 29B, a current sound display section 29C, a current pattern display section 29D and a current position display section 29E.

In the drum sound name display section 29B are presented drum sound names corresponding to the keyboard 1A.

The current sound display section 29C comprises a plurality of circular lighting sections which are provided on the right side of the respective drum sound names, in such a manner that only such a lighting section corresponding to a currently-generated drum sound is lit.

The current pattern display section 29D shows a rhythm pattern for one measure by a plurality of square lighting sections. In the illustrated example, a rhythm pattern comprising bus drum, snare drum and closed high hat are shown. The current position display section 29E shows the position in the measure of the currently-generated sound.

By such video data presented on the display 29, it is possible to immediately recognize the contents of the current pattern. In addition, even when the current pattern has been transformed, it is possible to easily recognize how the pattern has been transformed. To this end, it is only sufficient to simultaneously display the patterns before and after transformation.

The foregoing embodiment has been described as being applied to rhythm accompaniment, but the present invention may also be applied to other forms of accompaniment such as base and chord backing accompaniments, in which case a multiplicity of base patterns and backing patterns are stored in the data base means so that any of the patterns is selected for each performance part in response to actuation of a predetermined operating member. Namely, in this case, operating members are provided in corresponding relation to the base part and backing parts 1, 2, 3, . . . (assuming that tone color is different for each backing part), so that, for example, any of the base patterns is selected from the data base by actuating the operating member for the base part, or any of the backing patterns is selected from the data base by actuating the operating member for backing part 1.

Further, although, in the foregoing embodiment, the second flag-correspondent processing (undo, fill-in, variation and transformer processes) has been described as initiated when performance to a measure line has been completed, it may be initiated immediately upon actuation of any of the corresponding keys.

The accent processing of step 52 in FIG. 15 has been described above as providing an accent effect by directly replacing note-on velocity with note number-correspondent velocity. But, an alternative arrangement is possible such that, just like the above-mentioned search template or replace template, plural accent templates each of which, for example, is a pattern indicating the degree of velocity replacement for each timing) are employed so that any of the templates is selected depending on the velocity of note-on note number, and then the velocity of the selected accent template replaces the note-on velocity.

Furthermore, the above-described embodiment employs keyboard keys as keys to which various functions are assigned, but in stead of such keys, switches may be displayed on the display of the personal computer in such a manner that various functions can be designated by selectively designating the switches. Or, the keyboard may be replaced by other suitable operator means such as drum pads or simple switches. Moreover, in the above-described embodiment, all the functions are designated entirely by the keyboard, but these functions may be designated by a combined use of the keyboard and other operating members; for example, the lock function may be assigned to and achieved by foot switch.

Moreover, although the present invention has been described above as applied to an automatic accompaniment device comprising an electronic musical instrument and a personal computer that are interconnected via MIDI circuitry, it is also applicable to an independent electronic musical instrument.

Moreover, although it has been described above that two kinds of modifiers are allotted to each transformer key so that either of the modifiers is selected depending on velocity value, the degree or depth of modifier-dependent transformation may be progressively switched depending on the varying velocity values. Further, only one modifier may be allotted to each transformer key.

Moreover, although, in the above-described embodiment, sequence data for each modifier covers four measures so that it terminates upon completion of performance of the four measures, the sequence data for four measures may be repetitively performed unless termination of the sequence data readout is specifically instructed. Further, of course, the sequence data may cover any other number of measures than four. In addition, the modifier designation may be made at any timing other than the measure line timing.

Furthermore, in changing a rhythm pattern by the transformer, different changing processes may be applied depending on the contents of the rhythm pattern. For instance, in such a case where the change is effected by adding drum sound or replacing a pattern by the transformer, it may be determined what kind of pattern a current rhythm pattern is, and then drum sound to be added or replacing pattern may be varied depending on whether the determined pattern is a 16-beat rhythm pattern or an 8-beat rhythm pattern.

Next, another embodiment of the present invention will be described.

This embodiment will be explained in relation to a case where each of the above-mentioned pattern tables has, in addition to the address, head address and degree of complexity areas, an availability/unavailability flag area for storing an availability or unavailability flag for each rhythm pattern indicating whether it is possible to select the rhythm pattern.

Figures 22A, 22B, 24:
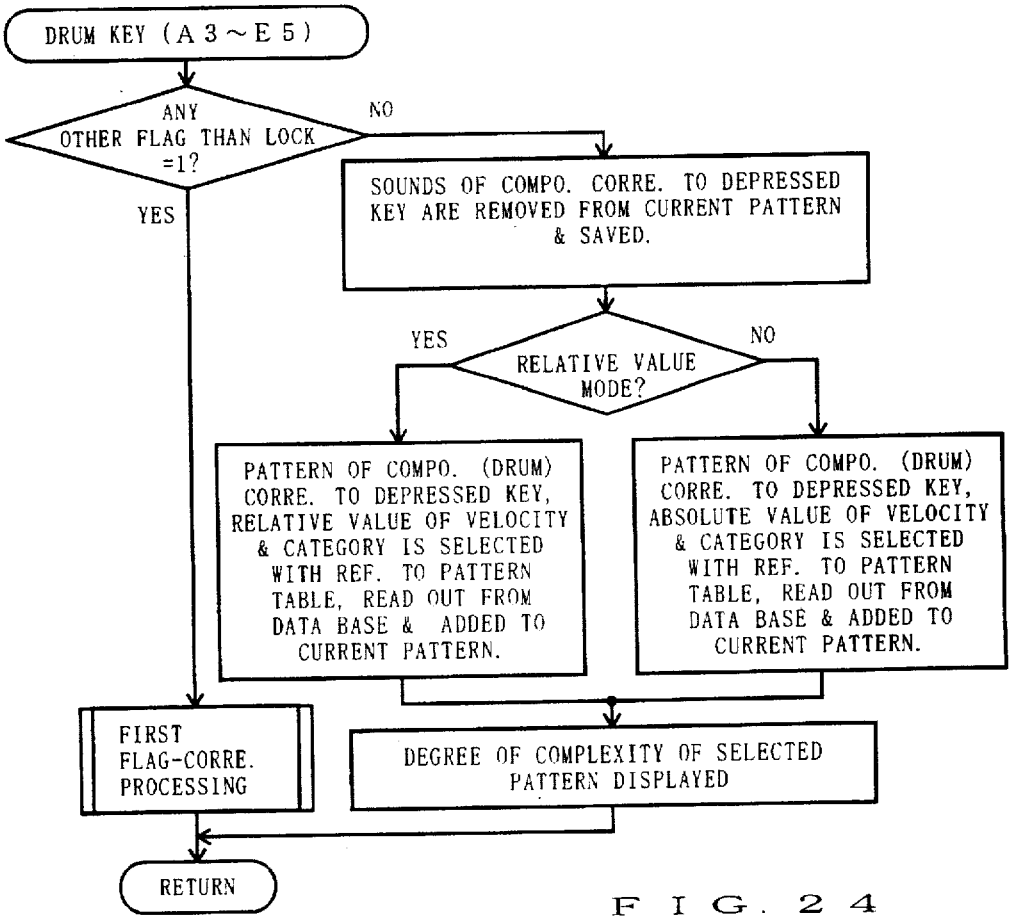
FIG. 22A is a diagram illustrating a rock music pattern table as an example where an address conversion pattern table stored in a pattern table area has an "availability/unavailability" flag area.
FIG. 22B is a diagram illustrating a disco music pattern table as another example where an address conversion pattern table stored in a pattern table area has an "availability/unavailability" flag area.
FIG. 24 is a flowchart illustrating an example of the drum key process which is performed on the basis of an absolute or relative value of velocity data generated by actuation of the component designating operator.

FIGS. 22A and 22B show examples of address conversion tables stored in the pattern table area; FIG. 22A shows a rock music pattern table and FIG. 22B shows a disco music pattern table. Each of the pattern tables, as noted above, is composed of the address, head address, degree of complexity areas and availability/unavailability flag area. Addresses of the pattern table are stored in the address area; respective head addresses in bank A, B or B of individual rhythm patterns are stored in the head address area; respective degrees of complexity of the rhythm patterns are stored in the degree of complexity area; and availability/unavailability flags are stored in the availability/unavailability flag area for indicating whether the corresponding rhythm patterns are selectable (available) or not.

For example, the rock music pattern table stores head addresses A-1, A-2, A-3, C-1, A-4, C-2, . . . . , A-n for uniquely identifying the individual rhythm patterns contained in banks A and C, using, as addresses, the serial numbers 1, 2, 3, . . . . , n corresponding to the degrees of complexity of the rhythm patterns. Similarly, the disco music pattern table stores head addresses B-1, B-2, C-1, B-3, C-2, C-3, . . . . , B-n for uniquely identifying each of the individual rhythm patterns contained in banks B and C, using, as addresses, the serial numbers 1, 2, 3, . . . . , n corresponding to the degrees of complexity of the rhythm patterns.

Here, the prefix "A", "B" or "C" of each head address specifies any one of the banks where the corresponding rhythm pattern is stored. That is, the head addresses A-1, A-2, A-3, A-4 and A-n specify bank A, the head addresses B-1, B-2, B-3 and B-n specify bank B, and the head addresses C-1, C-2 and C-3 specify bank C.

For convenience of description, it is assumed that the degrees of complexity stored in the degree of complexity area are of the same values as those in FIG. 4.

Of the rhythm patterns contained in the rock music table, selectable rhythm patterns, i.e., rhythm patterns for which the availability flags are set, are, in the illustrated example, at addresses "1", "2", "4", "6", . . . . , "n". Further, of the rhythm patterns contained in the disco music table, selectable rhythm patterns, i.e., rhythm patterns for which the availability flags are set, are, in the illustrated example, at addresses "1", "2", "4", "6", . . . . , "n".

Accordingly, if the pattern selector 61 selects any of the patterns for which the availability flag is not set, the pattern selection will be invalid so that another pattern for which the availability flag is set will be selected.

By setting some of the accompaniment patterns in the data base as "unselectable" in the above-mentioned manner, it is allowed to foreclose the inconvenience that a real-time automatic accompaniment is performed in an undesired accompaniment pattern, and thus an automatic accompaniment can be performed exactly as desired by the user. In this case, selectability of each individual accompaniment pattern (whether it is available or unavailable) may be determined component by component. Further, information as to which of the patterns should be made unselectable may be preset or may be set as desired by the user.

The above-mentioned embodiments have been described in relation to a case where the component designating operators comprise the designating keys of note numbers A3, A#3, B3, . . . . , E5 provided in the drum pattern area on the keyboard 1A of FIG. 2 and where a note number generated in response to operation of any of the designating keys is output as a component designation signal. Alternatively, dedicated component designating switches that correspond to the individual components may be provided on the switch panel 1B or 2B so that a desired component is designated by selectively operating any of the designating switches.

Furthermore, the above-mentioned embodiments have been described in relation to a case where the pattern selector 61 corresponds to the designating keys of note numbers A3, A#3, B3, . . . , E5 provided in the drum pattern area on the keyboard 1A of FIG. 2 and where velocity data generated in response to operation of any of the designating keys is output as a pattern selection signal. Alternatively, there may be provided, on the switch panel 1B or 2B, a sliding operator, rotating operator such as in the form of a wheel, or multidimensional operator such as a joystick or the like which is capable of outputting successively varying values so that a pattern selection signal is output by activating the operator.

A pattern selection signal from the pattern selector is processed as an absolute or relative value signal. If the pattern selection signal is processed as an absolute value signal, it will be readily seen how the currently selected pattern is different (e.g., in degree of complexity) from the last selected pattern. Further, whether an absolute value or a relative value should be used may be selected in any appropriate manner that fits the user's preference.

Figure 23A:
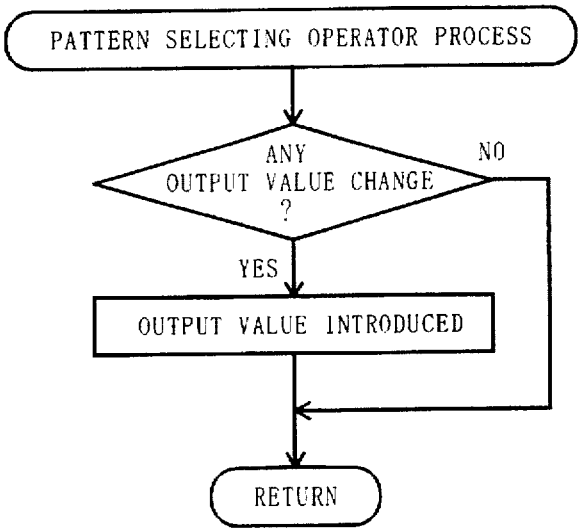
FIG. 23A is a flowchart illustrating an example of a pattern selecting operator process performed in response to actuation of a pattern selecting operator.
Figure 23B:
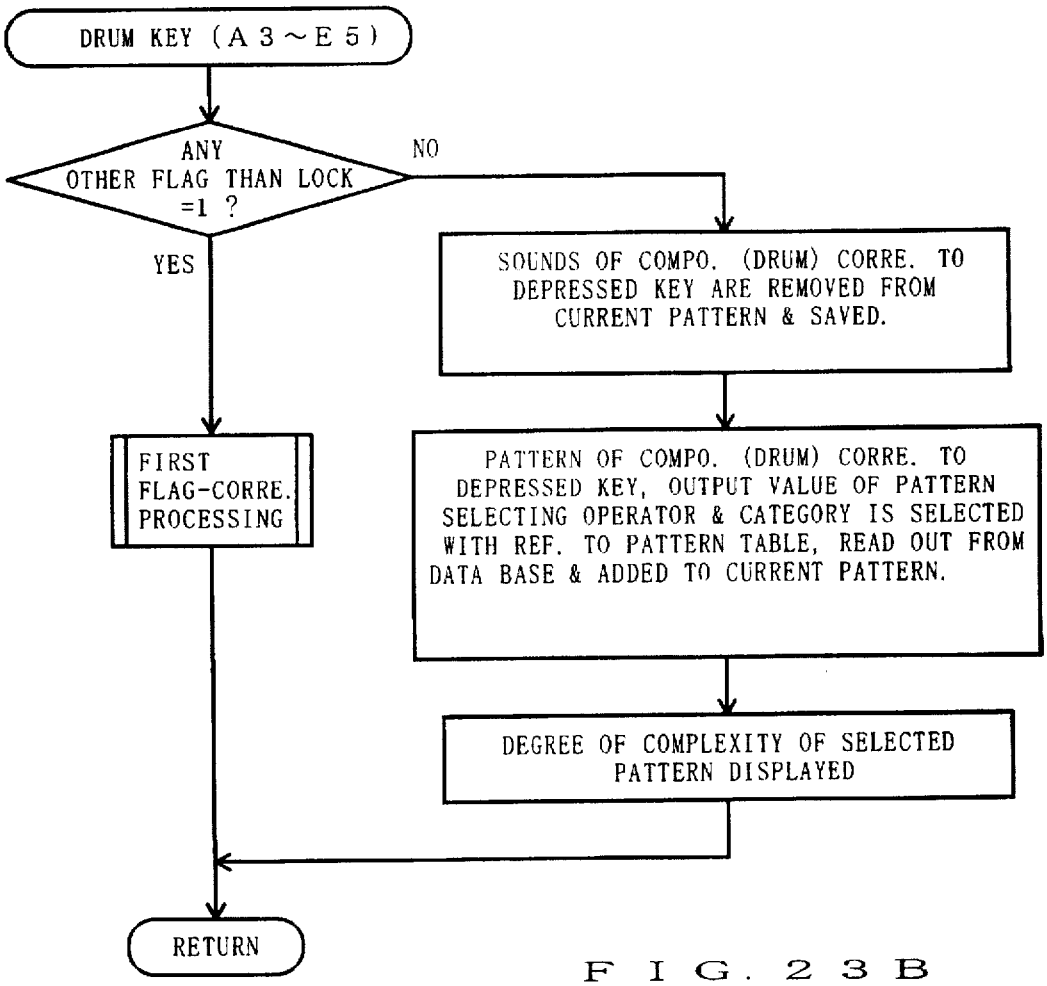
FIG. 23B is a flowchart illustrating an example of a drum key process performed in response to actuation of a component designating operator.

FIG. 23 shows processes performed in response to actuation of any of component designating and pattern selecting operators in the case where the component designating operators comprise keys of note numbers A3 to E5 in the drum pattern area on the keyboard 1A and the pattern selecting operator comprise a sliding operator, rotating operator such as a wheel, or multidimensional operator such as a joystick or the like which is provided on the switch panel 1B or 2B and is capable of outputting successively varying values. FIG. 23A is a flowchart illustrating a pattern selecting operator process performed in response to actuation of the pattern selecting operator, while FIG. 23B is a flowchart illustrating a drum key process performed when a MIDI message containing any of note numbers A3 to E5 is received from the electronic musical instrument 1F in response to actuation of any of the component designating operators.

Where the pattern selecting operator is provided on the panel switch 1B of the electronic musical instrument 1F, the MIDI message will contain a pattern selection signal responsive to actuation of the operator as well as any of note numbers A3 to E5.

In the pattern selecting operator process of FIG. 23A, a determination is made as to whether there has been any change in the output value of the pattern selecting operator. If answered in the affirmative, the output value is introduced; otherwise the program returns to the main routine. This process is executed at each predetermined timing.

The drum key process of FIG. 23B is substantially the same as that of FIG. 11D. First, it is determined whether any of the flags other than lock flag LOCK is at high level "1". If so, the first flag-correspondent processing of FIG. 12 is executed which corresponds to that flag set at high level "1", and thereafter the program returns to the main routine.

On the other hand, if no flag other than the lock flag LOCK is set at high level "1", sounds (at least one of them is a drum sound) of the component corresponding to the depressed key (note number) are removed from the current pattern memory and temporarily saved in the save memory 4. Then, a rhythm pattern of the component (drum) corresponding to the depressed key (note number), output value from the pattern selecting operator and designated style or category are selected with reference to the pattern table 63, and the rhythm pattern of the selected component is read out from the data base means 5 and added to the current pattern. Then, the degree of complexity of the selected rhythm pattern is indicated on the display 29 as shown in FIG. 5.

Because previous values up to the last one are hold if no pattern selecting operator has been actuated, a component designation can be made by only depressing a key corresponding to any of note numbers A3 to E5, and hence delicate selection and setting of an accompaniment pattern can be achieved by finely changing the successive output value from the pattern selecting operator and then operating any of the keys of note numbers A3 to E5.

FIG. 24 shows a drum key process performed in the case where the component designating and pattern selecting operators both comprise the keys of note numbers A3 to E5 in the drum pattern area on the keyboard 1A as in FIG. 11D, and where a MIDI message containing any of note numbers A3 to E5 and velocity data generated in response to the key operation and the received velocity data is recognized as an absolute or relative value to output a pattern selection signal on the basis of such recognition.

The drum key process of FIG. 24 is almost the same as that of FIG. 11D, where, first of all, it is determined whether any of the flags other than lock flag LOCK is at high level "1". If so, the first flag-correspondent processing of FIG. 12 is executed which corresponds to that flag set at high level "1", and the program returns to the main routine.

On the other hand, if no flag other than the lock flag LOCK is set at high level "1", sounds (at least one of them is a drum sound) of the component corresponding to the depressed key (note number) are removed from the current pattern memory and temporarily saved in the save memory 4.

Then, it is determined whether the current mode of a velocity recognition mode is a relative value mode or not. If the current mode has been determined as the relative value mode, a rhythm pattern of the component (drum) corresponding to the depressed key (note number), relative value of the velocity data and designated category is selected with reference to the pattern table 63, and the selected rhythm pattern is read out from the data base means 5 and added to the current pattern. The relative value is used, for example, in such a manner that "current selection data=last selection data+relative value (current velocity value−64" (i.e., in such a manner that a little more complicated pattern than the last selected pattern is selected if the current velocity value is greater than "64", while a little less complicated pattern than the last selected pattern is selected if the current velocity value is smaller than "64".

If, on the other hand, the current mode has been determined as an absolute value mode, then a rhythm pattern of the component (drum) corresponding to the depressed key (note number), absolute value of the velocity data and designated category is selected with reference to the pattern table 63, and the selected rhythm pattern is read out from the data base means 5 and added to the current pattern.

Then, the degree of complexity of the selected rhythm pattern is indicated on the display 29 as shown in FIG. 5.

The above-mentioned drum key process may be designed in such a manner that a pattern selection signal corresponding to the absolute value of velocity data is first output and then another pattern selection signal corresponding to the relative value is output. Alternatively, a predetermined absolute value may be first output automatically and then a pattern selection signal may be output in correspondence to the relative value. Further, the drum key process may also be designated in such a manner that the user can select whether the pattern selection should be made by the absolute value or by the relative value.

Furthermore, although has been described above in relation to the case where the pattern selecting operator outputs velocity data corresponding to operation on the keyboard, the drum key according to the present invention should not be understood as limited to this. It is a matter of course that the process may also be applied to the case where the pattern selecting operator comprises a sliding operator, rotating operator such as a wheel, multidimensional operator such as a joystick or the like which is provided on the switch panel 1B or 2B and is capable of outputting successively varying values.

Figure 25:
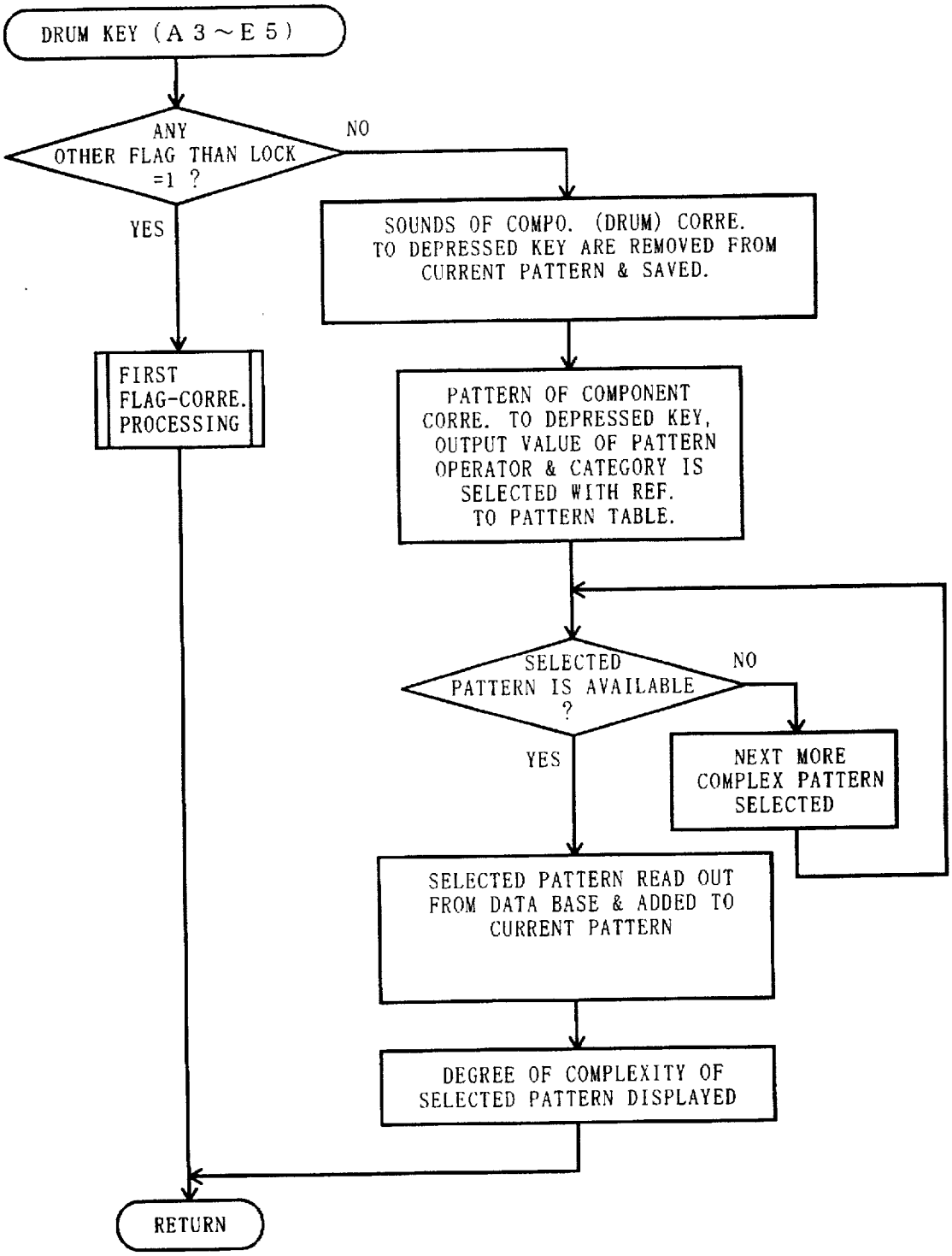
FIG. 25 is a flowchart illustrating an example of the drum key process which is performed when an "unavailability" flag exists in the "availability/unavailability" flag area.

FIG. 25 shows a drum key process performed when one or more unavailability flags are set in the availability/unavailability flag area of the pattern table as shown in FIG. 22 and thus a condition permitting no pattern selection has occurred. This drum key process will be described in connection with the case where the component designating operators comprise the keys of note numbers A3 to E5 in the drum pattern area on the keyboard 1A and the pattern selecting operator comprise a sliding operator, rotating operator such as a wheel, or multidimensional operator such as a joystick or the like which is provided on the switch panel 2B and is capable of outputting successively varying values.

First, it is determined whether any of the flags other than lock flag LOCK is at high level "1". If so, the first flag-correspondent processing of FIG. 12 is executed which corresponds to that flag set at high level "1", and then the program returns to the main routine.

On the other hand, if no flag other than the lock flag LOCK is set at high level "1", sounds (at least one of them is a drum sound) of a component corresponding to the depressed key (note number) are removed from the current pattern memory and temporarily saved in the save memory 4.

Then, a rhythm pattern of the component (drum) corresponding to the depressed key (note number), output value from the pattern selecting operator and designated category is selected with reference to the pattern table 63. After that, a determination is made as to whether the selected pattern is available or not. If available, the program proceeds to a next step; if not, a next more complex rhythm pattern is sequentially selected one after another until an available rhythm pattern is selected. Once an available rhythm pattern has been selected, a rhythm pattern of that component is read out from the data base means 5 and added to the current pattern. Then, the degree of complexity of the selected rhythm pattern is indicated on the display 29.

In this way, it is allowed to foreclose the inconvenience that a real-time automatic accompaniment is performed in undesired accompaniment pattern, and thus an automatic accompaniment can be performed exactly as desired by the user.

The embodiment has been described above as, when the pattern corresponding to the output value from the pattern selecting operator is not available, selecting a next more complex pattern, but a next less complex pattern may be selected. If the most complex (or simplest) pattern has been reached as the result of sequential selection of next more complex (or simpler) pattern, search for the pattern may be made in the reverse or opposite direction.

Moreover, although the embodiment has been described in connection with the case where the pattern selecting operator comprise a sliding operator, rotating operator such as a wheel, or multidimensional operator such as a joystick or the like which is provided on the switch panel 2B and is capable of outputting successively varying values, it may also be applicable to the case where velocity data generated in response to the keyboard operation is used as a pattern selection signal. In such a case, the velocity resolution (which is determined by dividing the velocity value range by the number of patterns) may be varied. That is, where the number of the velocity values is "128" ranging from "0" to "127" and the number of patterns is "50", the resolution will be 2.56=128/50 which means that a different pattern is selected each time the velocity increases by the value of 2.56; however, if the number of the selectable patterns is reduced to "40" by making some of the patterns unselectable, then the resolution will be 3.2=128/40.

The drum key processes of FIGS. 23 to 25 have been described above in relation to the case where a rhythm pattern of the selected component is added to the current pattern exactly as it is. The following description, however, is on another example of the drum key process where only part (only a designated range) of the rhythm pattern of the selected component or only selected one of plural drum sounds constituting the component is electively added to the current pattern.

Figure 26:
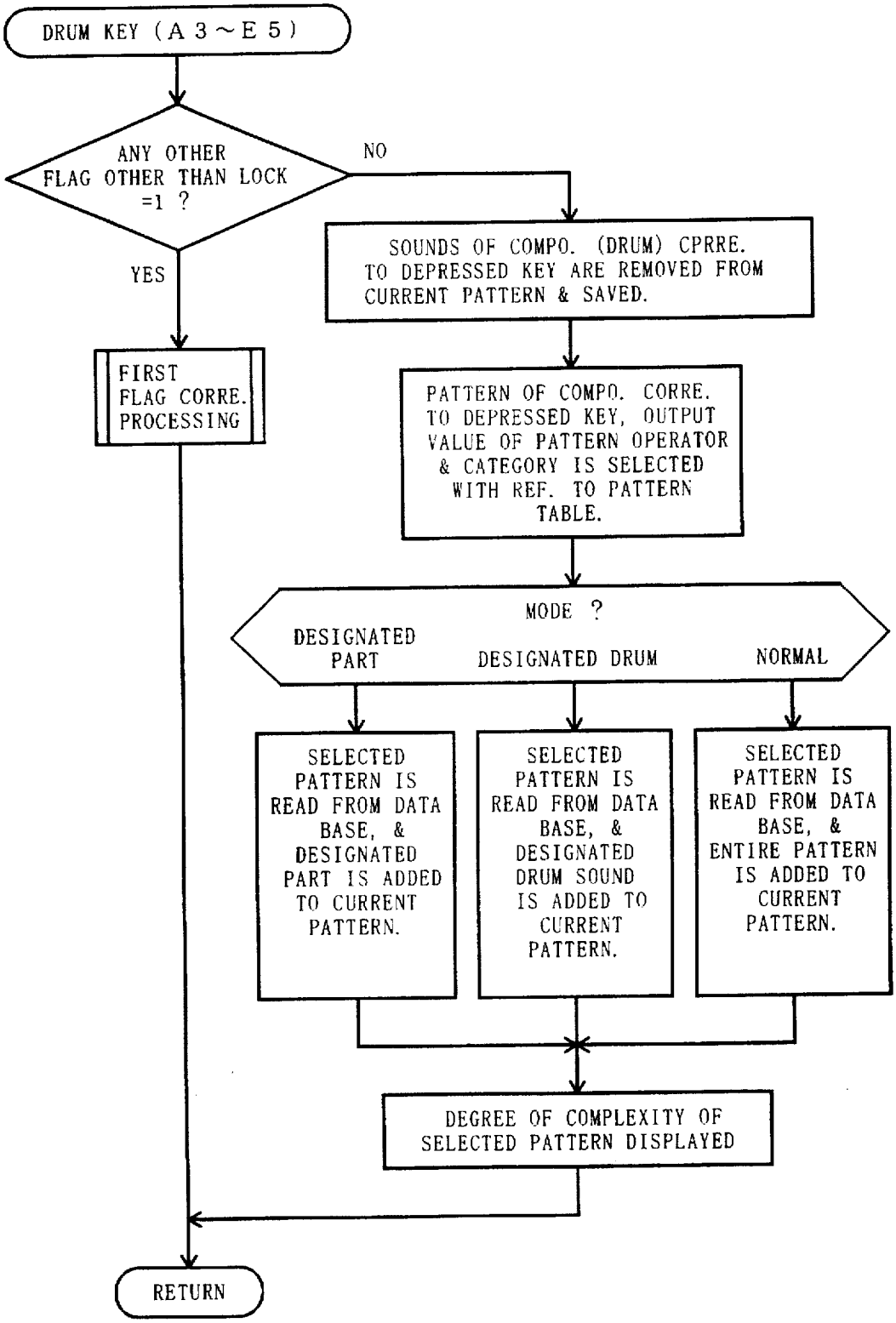
FIG. 26 is a flowchart illustrating another example of the drum key process which is capable of adding only part (only a designated range) of a rhythm pattern and selectively adding only desired one of plural drum sounds constituting a component.

FIG. 26 shows such an example of the drum key process where only part (designated range) of the rhythm pattern of the selected component or only selected one of plural drum sounds constituting the component is selectively added to the current pattern. FIG. 27 is diagram conceptually showing a manner in which the rhythm pattern is added by the drum key process of FIG. 26.

Before execution of the drum key process of FIG. 26, a designated part mode is set ON when a specific part of the rhythm pattern is designated by a part designating switch (not shown) provided on the switch panel 2B, a designated drum mode is set ON when a specific drum sound is designated by a drum designating switch (not shown) provided on the switch panel 2B, or a normal mode is set ON when nothing is designated.

Figure 27A:
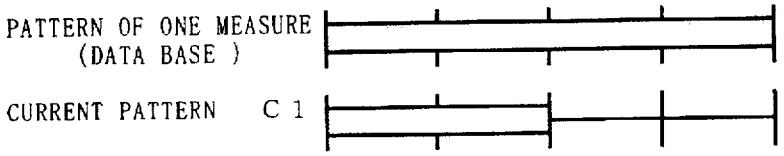
FIGS. 27A and 27B are diagrams conceptually illustrating how a rhythm pattern is added by the drum key process of FIG. 26.

If, for example, the length of a basic accompaniment pattern stored in the data base means 5 is one measure length as shown in FIG. 27A, the use of the part designating switch can selectively designate only a specific part, such as a first beat, former or latter half, of the measure. Thus, after the specific part of one measure has been designated by the part designating switch, the designated part mode is set ON.

FIG. 27A shows a case where only the former half of one measure of a pattern stored in the data base means 5 is designated by the part designating means, and the designated part is read into the current pattern memory 1 as a current pattern CP1.

Figure 27B:
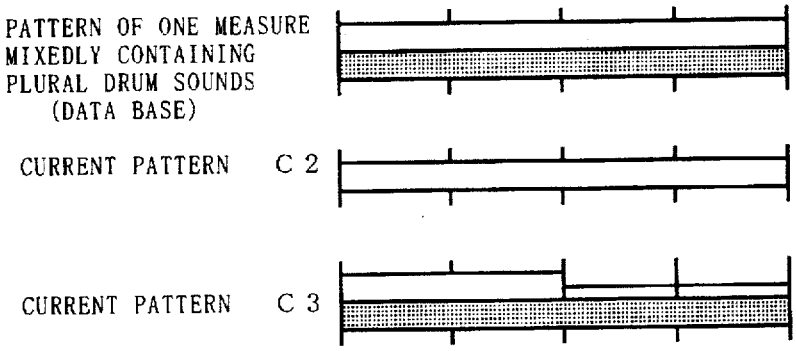

If, on the other hand, the basic accompaniment pattern is composed of plural drum sounds as shown in FIG. 27B, the use of the drum designating switch can designate only specific one of the drum sounds. For example, where the user likes bus drum BD in the current pattern but does not like snare drum SD, the snare drum can be replaced with another by designating only the snare drum pattern via the drum designating switch. Thus, after the specific drum sound has been designated by the drum designating designating switch, the designated drum mode is set ON.

FIG. 27B also shows a case where only a specific drum sound (snare drum SD) of one measure mixedly containing plural sounds (snare drum in the upper part and bus drum BD in the lower part) in the data base means 5 is designated by the drum designating switch, and only the designated drum sound is read into the current pattern memory 1 as a current pattern CP2.

In such a case where all drum sounds of one measure mixedly containing plural sounds (snare drum in the upper part and bus drum BD in the lower part) in the data base means 5 are designated by the drum designating switch and only a specific part (former half of one measure) of specific one of the drum sounds (snare drum in the upper part) is designated by the part designating switch, the drum key process may be designed in such a manner that only the designated part of the designated drum sound is read into the current pattern memory 1 as a current pattern CP3.

The drum key process of FIG. 26 is executed upon actuation of any of the keys of note numbers A3 to E5 in the drum pattern area on the keyboard 1A after any of the designated part, designated drum and normal modes has been set in the above-mentioned manner.

First, it is determined whether any of the flags other than lock flag LOCK is at high level "1". If so, the first flag-correspondent processing of FIG. 12 is executed which corresponds to the flag set at high level "1", and the program returns to the main routine.

On the other hand, if no flag other than the lock flag LOCK is set at high level "1", sounds (at least one of them is a drum sound) of a component corresponding to the depressed key (note number) are removed from the current pattern memory and temporarily saved in the save memory 4.

Then, a rhythm pattern of the component (drum) corresponding to the depressed key (note number), output value from the pattern selecting operator and designated category is selected with reference to the pattern table 63.

After that, a determination is made as to what is the current mode, and a process is performed corresponding to the determined current mode.

If the current mode is the designated part mode, the selected rhythm pattern is read out from the base means 5, and only the designated part of the pattern is added to the current pattern.

If the current mode is the designated drum mode, then the selected rhythm pattern is read out from the base means 5, and only the designated drum sound of the pattern is added to the current pattern.

If the current mode is the normal drum mode, then the selected rhythm pattern is read out from the base means 5 as in FIGS. 23 to 25, and the entire pattern is added to the current pattern.

Then, the degree of complexity of the selected rhythm pattern is indicated on the display 29.

In this way, freedom to create accompaniment patterns is greatly enhanced so that only part preferred by the user can be newly added.

The selectable part of the pattern may be arbitrarily set by the user, and plural kinds of such selectable part may be stored as preset data. Further, if the accompaniment pattern is composed of plural measures, one or more of the measures may be designated as desired. If a given component has more than two drum sounds, one or more of the drum sounds may be designated as necessary.

The following description is on such a case where the switch panel 1B or 2B has, for each component, a fine adjustment operator comprising a sliding operator, rotating operator such as a wheel, or multidimensional operator such as a joystick or the like which is cap able of outputting successively varying values. Because this fine adjustment operator, once actuated, can output successively varying values corresponding to the operational amounts thereof, it is possible to achieve finer selection and setting of an accompaniment pattern than the above-mentioned velocity-based patten selection. However, it is also to be noted that the velocity-based pattern selection advantageously allows rough selection of an accompaniment pattern to be made very easily, although it is difficult for this type of pattern selection to successively vary the velocity data value.

Figure 28:
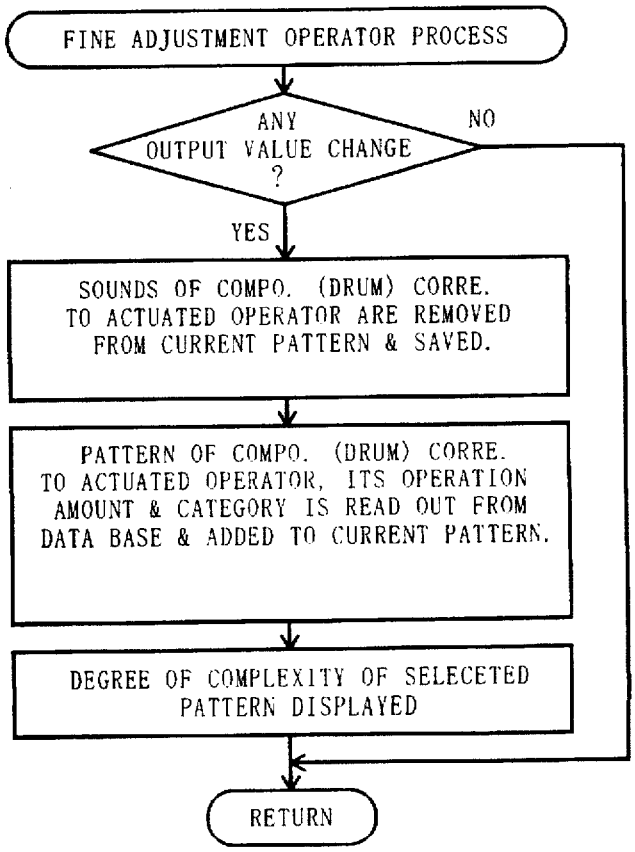
FIG. 28 is a flowchart illustrating the detail of a fine adjustment operator process included in the other processing of FIG. 8, which is performed by the CPU of the personal computer of FIG. 1.

FIG. 28 shows in detail a fine adjustment operator process contained in the other processing of FIG. 8, which is performed by the CPU 21 of the personal computer 20 in response to operation of any of the fine adjustment operators provided in corresponding to the individual components.

Since each of the fine adjustment operators comprises a sliding operator, rotating operator such as a wheel, or multidimensional operator such as a joystick or the like and is capable of outputting successively varying values, this fine adjustment operator process first determines whether there has been an output value change in any of the fine adjustment operators. With the determination that there has no such an output value change, the CPU 21 immediately returns to the main routine.

If, on the other hand, it has been determined that there has been an output value change in any of the fine adjustment operators (YES), sounds (at least one of them is a drum sound) of the component corresponding to the actuated fine adjustment operator are removed from the current pattern and temporarily saved in the save memory 4. A rhythm pattern of the component (drum) corresponding to the actuated fine adjustment operator, its operation amount and designated category is selected with reference to the pattern table 63. Then, the degree of complexity of the selected rhythm pattern is indicated on the display 29.

In this manner, the component designation achieves fine or delicate selective setting of an accompaniment pattern by only operating the corresponding fine adjustment operator.

A description is made below as to a case where retrieval condition designating operators for designating desired retrieval conditions for a pattern selection are provided as a pattern selector on the switch panel 1B or 2B. The retrieval condition designating operators designate retrieval conditions such as "pattern having events at second and fourth beats", "pattern in which the total number of events is equal to or greater than n", "pattern in which there is no other drum sound event at timing where a specific drum sound event is present is", etc. for example on the ANDing or ORing basis. Any accompaniment patterns satisfying the thus-designated condition are determined as objects of the intended accompaniment pattern selection. In this way, it is allowed to select only a pattern desired by the user at an increased speed. The conditions may be preset or set arbitrarily by the user, and combinations of such conditions may be preset.

Further, in selection a pattern of a given component, the conditions may be determined in connection with another component. For instance, a pattern selection may be made on the basis of conditions such as "in selecting a pattern of high hat HH, if the BD+SD pattern being then selected is "#1", selection should be made from among high hat patterns in each which the total number of events is "n" or more" and "in selecting a pattern of tom to Tom, if the BD+SD pattern being then selected is "#1", selection should be made from among tom tom patterns whose events do not coincide in timing with those of BD". If there is no pattern satisfying the designated condition, a selection may be made in an appropriate manner from among those patterns not satisfying the condition.

Figure 29:
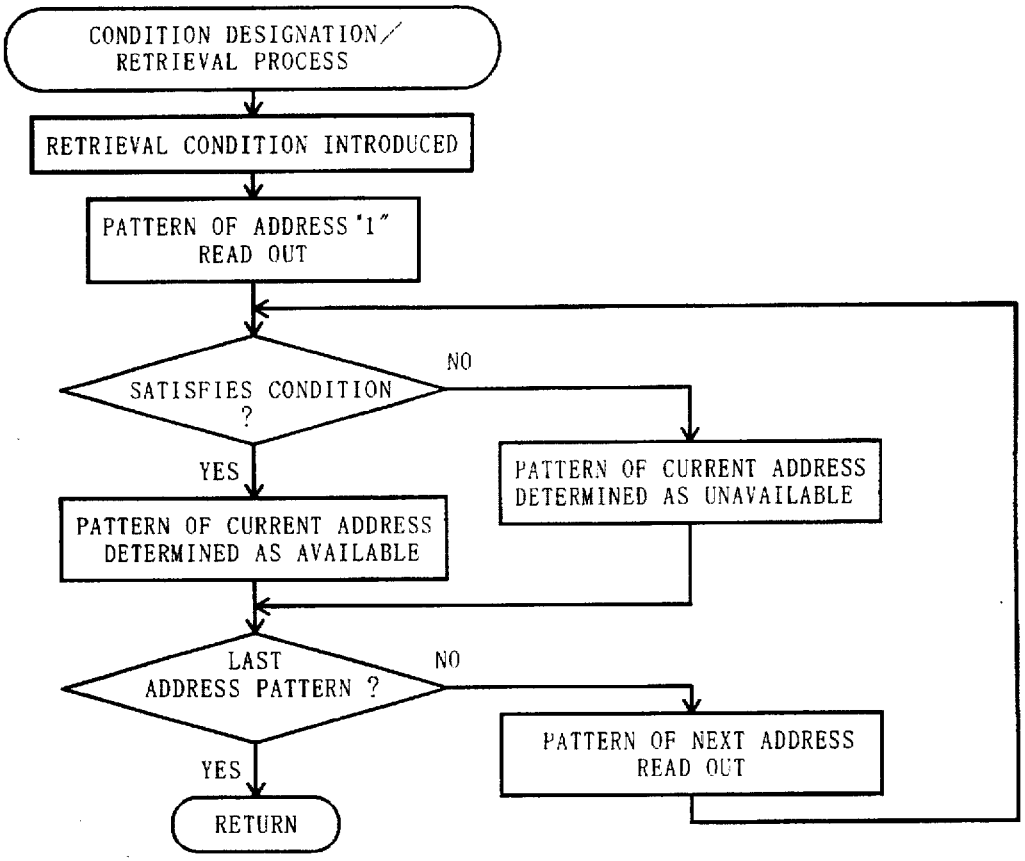
FIG. 29 is a flowchart illustrating the detail of a condition designation/retrieval process included in the other processing of FIG. 8, which is performed by the CPU of the personal computer of FIG. 1.

FIG. 29 shows in detail a condition designation/retrieval process contained in the other processing of FIG. 8, which is performed by the CPU 21 of the personal computer 20 in response to operation of any of the retrieval condition designating operators.

In this condition designation/retrieval process, the retrieval condition designated by the operated retrieval condition designating operator is introduced. For instance, there is introduced any of the above-mentioned conditions "pattern having events at second and fourth beats", "pattern in which the total number of events is equal to or greater than n", and "pattern in which there is no other drum sound event at timing where a specific drum sound event is present". The rhythm pattern corresponding to address "1" of the pattern table 63 is also read out from the data base means 5. For instance, in the case of the rock music rhythm pattern of FIG. 22, the rhythm pattern of head address A-1 is read out.

Then, a determination is made as to whether the read-out rhythm pattern satisfies the designated retrieval condition. With an affirmative determination (YES), an "availability" flag is set in the availability/unavailability flag section of the rhythm pattern at the current address of the pattern table 63; however, with the negative determination (NO), an "unavailability" flag is set in the availability/unavailability flag section of the rhythm pattern at the current address of the pattern table 63.

After that, it is checked whether the current rhythm pattern is the last address pattern in the pattern table 63. If it is the last pattern, the CPU 21 immediately returns to the main routine; if not, until the last rhythm pattern in the pattern table is reached, the CPU 21 repetitively executes the above-mentioned operations of reading out the rhythm pattern corresponding to the next address from the data base 5 and determining whether the read-out data satisfies the designated retrieval condition.

In this way, availability and unavailability flags are set in the pattern table 63 in accordance with the retrieval condition, so that only such rhythm patterns for which the availability flags are set, i.e., satisfying the retrieval condition are selected by the drum key process of FIG. 25.

Figure 30:
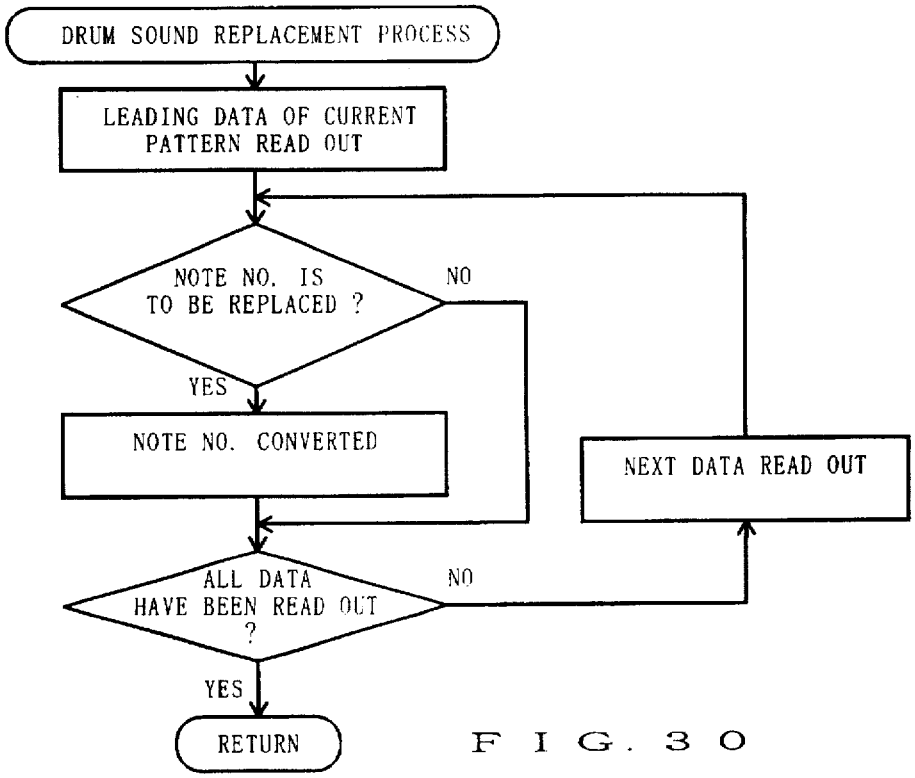
FIG. 30 is a flowchart illustrating the detail of a drum sound replacement process included in the other processing of FIG. 8, which is performed by the CPU of the personal computer of FIG. 1.

FIG. 30 shows in detail a drum sound replacement process contained in the other processing of FIG. 8, which is performed by the CPU 21 of the personal computer 20. This drum sound replacement process is for replacing a desired drum sound of an accompaniment pattern stored in the current pattern memory 1 by another drum sound. This drum sound replacement process is applied to such a case where the user likes the pattern of a drum but wants its color to be replaced with another color preferred by the user.

In the drum sound replacement process, the leading data (drum sound data) is read out from the current pattern stored in the current pattern memory 1. Then, it is determined whether the note number of the leading data corresponds to a drum sound to be replaced. If the answer is YES, the note number is converted to the note number of the resulting replaced drum sound. After this note number conversion, or when it has been determined that the note number does not correspond to a drum sound to be replaced (NO), it is further determined whether all the data (patterns) stored in the current pattern memory 1 have been read out. With an affirmative determination, the CPU 21 returns to the main routine; otherwise, the next data (pattern) of the current pattern memory 1 is read out. Then, the above-mentioned replacement operations depending on whether the note number is to be replaced or not are repetitively performed until readout of all the data (patterns) is completed.

By replacing the note number in the above-mentioned manner, it is allowed to replace the drum sound color. The color may be replaced by rewriting data indicative of a color in the current pattern (usually, note number) and may be converted when the pattern data is output. Further, the color indicating data may be converted when the pattern is read out from the data base means 5 or written into the current pattern. Alternatively, the contents of the data base means 5 may be rewritten in a direct fashion.

Figure 31:
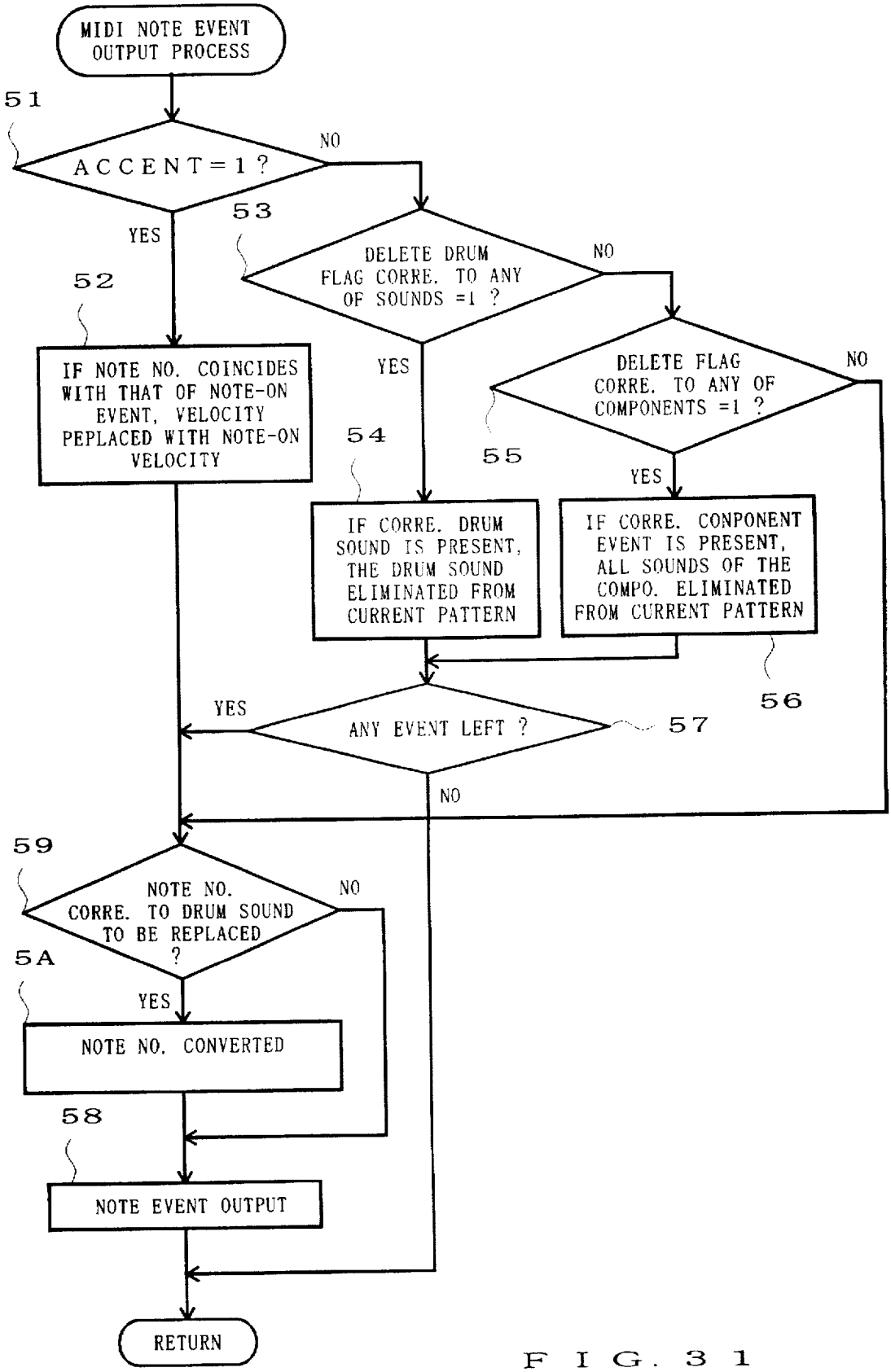
FIG. 31 is a flowchart illustrating the detail of a MIDI note event output process which is a modified example of the operation shown in FIG. 20.

FIG. 31 shows another example of the drum sound replacement process of FIG. 30 which is intended for rewriting the color of a drum sound when pattern data is read out from the current pattern memory 1 to output a note event. This process is realized by newly adding steps 59 and 5A to the MIDI note event output process of FIG. 15. In FIG. 31, the same reference characters as in FIG. 15 denote the same operations as in FIG. 15 and will not be explained here to avoid unnecessary duplication. The process of FIG. 31 is different from that of FIG. 15 only in that the operations of steps 59 and 5A are performed before the note event output operation of step 58.

That is, in step 59, a determination is made as to whether the note number of the note event having accent-processed in step 52, the note event having been left over after the removal operation of step 54, or the note event not having undergone the operations of steps 52, 54 or 56 corresponds to the drum sound to be replaced. If the note number corresponds to the drum sound to be replaced, the note number is converted in step 5A into the note number of the resulting replaced drum sound. If the note number does not correspond to the drum sound to be replaced, the CPU 21 jumps to step 58. Consequently, in step 58, the note event converted or not converted in step 5A is output to the electronic musical instrument 1F via the MIDI interfaces 2C and 1D.

The following description is on an example where a selected pattern inputting operator for inputting, such as by the real-time or step input method, a pattern desired by the user is provided as a pattern selector on the switch panel 1B or 2B. The selected pattern inputting operator may either be an operator dedicated to this purpose or be substituted by a key of the keyboard 1A of FIG. 2. Namely, the selected pattern inputting operator is provided for inputting a specific pattern imaged by the user (i.e., a pattern that may create a musical impression which the user wants to select).

The accompaniment pattern making device selects from the data base means 5 a pattern that appears to be closest to the input pattern.

Figure 32:
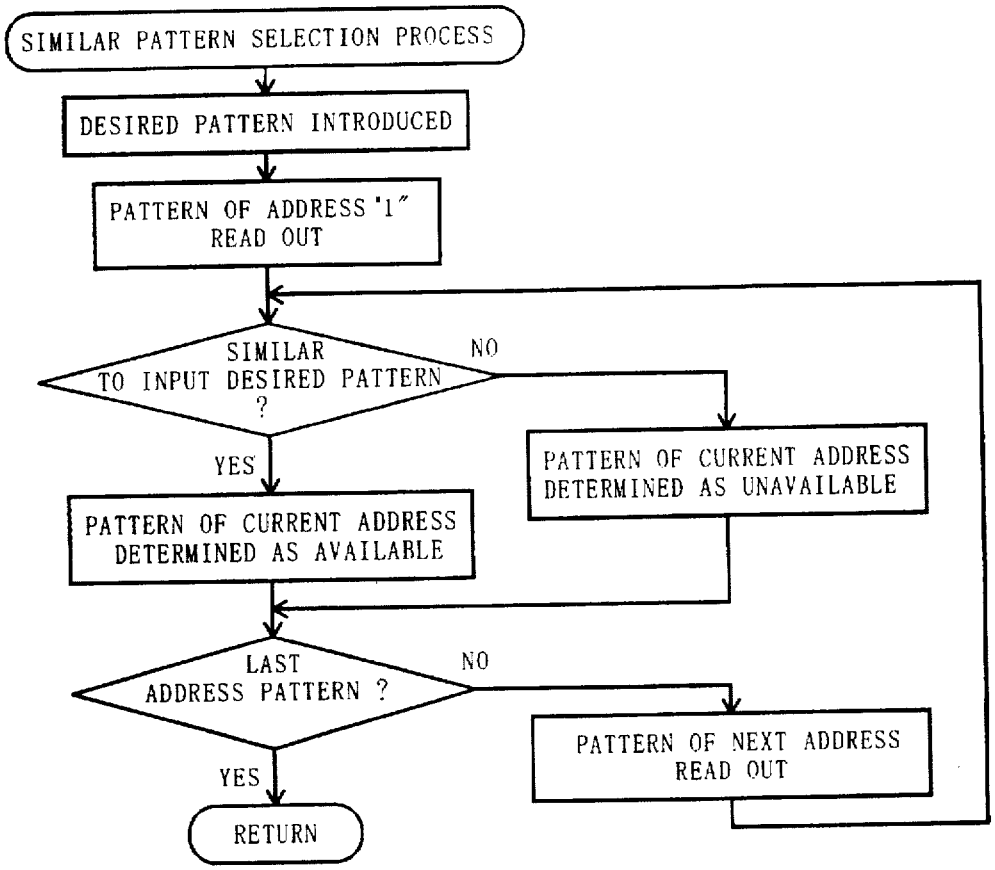
FIG. 32 is a flowchart illustrating the detail of a similar pattern selection process included in the other processing of FIG. 8, which is performed by the CPU of the personal computer of FIG. 1.

FIG. 32 shows in detail a similar pattern selection process contained in the other processing of FIG. 8, which is performed by the CPU 21 of the personal computer 20 in response to actuation of the selected pattern inputting operator.

The selected pattern inputting operator is for inputting, such as by the real-time or step input method, a specific pattern imaged by the user (i.e., a pattern that may create a musical impression which the user wants to select). Accordingly, this similar pattern selection process, in order to allow a pattern similar to the input pattern to be readily selected from the data base means 5, rewrites the flags in the availability/unavailability flag area.

In this similar pattern selection process, first, the desired pattern input via the selected pattern inputting operator is introduced. The rhythm pattern corresponding to address "1" of the pattern table 63 is also read out from the data base means 5. For instance, in the case of the rock music rhythm pattern of FIG. 22, the rhythm pattern at head address A-1 is read out, and in the case of the disco music pattern table, the rhythm pattern at head address B-1 is read out.

Then, it is determined whether the read-out rhythm pattern is similar to the input desired pattern. If the answer is YES, an availability flag is set in the availability/unavailability flag area of the rhythm pattern at the current address in the pattern table 63. If, on the other hand, the answer is NO, an unavailability flag is set in the availability/unavailability flag area of the rhythm pattern at the current address in the pattern table 63.

After that, it is checked whether the current rhythm pattern is the pattern at the last address in the pattern table 63. If it is the last address pattern, the CPU 21 immediately returns to the main routine; if not, the rhythm pattern corresponding to the next address is read out from the data base means 5. Then, until the last address rhythm pattern in the pattern table is reached, the CPU 21 repetitively executes the operations of reading out the rhythm pattern corresponding to the next address from the data base 5 and determining whether the read-out data satisfies the designated retrieval condition.

In this manner, availability and unavailability flags are set in the pattern table depending on whether or not the corresponding patterns are similar to the input desired pattern, and thus only such rhythm patterns for which the availability flag are set, i.e., which are similar to the input desired pattern may be selected by the drum key process of FIG. 25, so that the user can select a pattern as imaged by him at an increased speed. The degree of similarity of each pattern to the input desired pattern may be determined by using, singly or in combination, information as to whether the number of tones is equal between the two patterns, whether the positions of sounds are identical or similar between the two patterns, etc. Alternatively, the degree of similarity of each pattern to the input desired pattern may be determined with respect to a specific component and a specific drum sound pattern, or with respect to all drum sounds.

A description will be made below on a case where sequential reproduction means is provided for sequentially reading and reproducing accompaniment patterns of a designated component from among plural accompaniment patterns stored in the data base means 5. By thus sequentially reproducing accompaniment patterns via the sequential reproduction means, it is possible to briefly confirm what sorts of accompaniment pattern are stored in the data base means 5. Consequently, in the event that there is no accompaniment pattern desired by the user, the user can create a desired pattern such as by adding a new pattern or modifying an existing pattern through editing operations. Should any favorite pattern be found by the brief confirmation, the user may of course select that pattern. To previously recognize the arrangement of accompaniment patterns stored in the data base means 5 is extremely important for the user to efficiently select a desired pattern.

Figure 33:
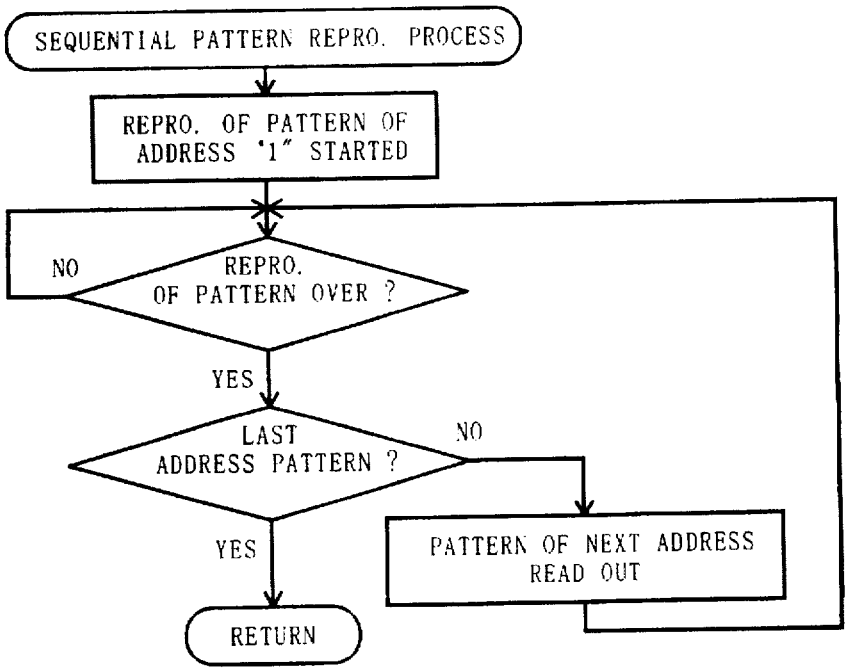
FIG. 33 is a flowchart illustrating the detail of a sequential pattern reproduction process included in the other processing of FIG. 8, which is performed by the CPU of the personal computer of FIG. 1.

FIG. 33 shows in detail a sequential pattern reproduction process contained in the other processing of FIG. 8, which is performed by the CPU 21 of the personal computer 20 in response to actuation of the sequential reproduction means 64 of FIG. 1.

The sequential reproduction means 64 is for sequentially reproducing the contents of the data base means 5. Accordingly, this sequential pattern reproduction process reproduces the rhythm patterns stored in the data base means 5, in the order of the serial addresses of the pattern table 63.

In this process, first, the rhythm pattern corresponding to address "1" of the pattern table 63 is read out from the data base means 5. For instance, in the case of the rock music rhythm pattern of FIG. 4, the rhythm pattern at head address A-1 is read out for reproduction, and in the case of the disco music pattern table of FIG. 4, the rhythm pattern at head address B-1 is read out for reproduction.

After that, it is determined whether reproduction of the read-out rhythm pattern has been completed. If the answer is YES, it is further checked whether the rhythm pattern reproduced at the time when the reproduction has been completed is the pattern at the last address in the pattern table 63. If it is the last address pattern (YES), the CPU 21 immediately returns to the main routine, but if not, the rhythm pattern corresponding to the next address is read out from the data base means 5 and reproduced. The above-mentioned operations are repetitively performed until the last address rhythm pattern is reached.

In this way, it is possible to briefly confirm what sorts of accompaniment pattern are stored in the data base means 5. Consequently, in the event that there is no accompaniment pattern desired by the user, the user can perform operations of addition, editing etc. Should any favorite pattern be found by the brief confirmation, the user may of course select that pattern. This process also permits the user's previous recognition of the arrangement of accompaniment patterns in the data base means 5, which, as highly expected, could provide very useful information for the user to select a pattern. In this case, an additional step for receiving the user's selection of desired one of the reproduced patterns may be provided in the "YES" or "NO" route of the determination "last address pattern?" in FIG. 33, so that information indicative of the selected desired pattern information is reserved for subsequent use in editing or making accompaniment pattern.

This sequential reproduction process is triggered at each timing of the timer interrupt process of FIG. 14.

It should be understood here that the present invention may employ a large-capacity storage device such as an optical magnetic disk device and a CD-ROM device, in place of the hard disk device.

The present invention as has been described so far achieves the benefit that it allows rhythm pattern modification to be performed in a simple manner with utmost ease.

What is claimed is:

1. An automatic accompaniment device comprising:

accompaniment pattern storage means for storing plural accompaniment patterns for each of plural accompaniment components, each of said components being composed of one or more musical instrument parts for an accompaniment performance;

selection means for, for each of said components, selecting a desired accompaniment pattern from among the plural accompaniment patterns, said selection means including a selecting operator;

readout means for reading out, from said accompaniment pattern storage means, the accompaniment pattern of any of said components selected by said selection means, wherein said plural accompaniment patterns of each said component correspond, in accordance with a predetermined rule, to different possible operated modes of said selecting operator, and said readout means selectively reads out one of the accompaniment patterns that corresponds to an actually operated mode of said selecting operator;

accompaniment tone generation means for generating automatic accompaniment tones on the basis of the accompaniment pattern read out by said readout means; and write means for registering a desired accompaniment pattern into said accompaniment pattern storage means in accordance with the predetermined rule.

2. An automatic accompaniment device as defined in claim 1 wherein said predetermined rule corresponds to degrees of complexity of said accompaniment patterns.

3. An automatic accompaniment device as defined in claim 1 wherein said accompaniment pattern storage means includes an accompaniment pattern storage area for storing the plural accompaniment patterns, and an arrangement order storage area for storing arrangement order information to be used for arranging the plural accompaniment patterns in accordance with said predetermined rule, and wherein said readout means, by referring to said arrangement order storage area in response to operation of said operator, selects one of the accompaniment patterns corresponding to the actually-operated mode of said operator.

4. An automatic accompaniment device as defined in claim 1 which further comprises modification means for modifying the accompaniment pattern read out by said readout means, and wherein said write means registers the accompaniment pattern modified by said modification means into said accompaniment pattern storage means as a new accompaniment pattern.

5. An automatic accompaniment device as defined in claim 1 which further comprises display means for displaying information indicative of said predetermined rule corresponding to the accompaniment pattern read out by said readout means.

6. An automatic accompaniment device comprising:

accompaniment pattern storage means for storing plural accompaniment patterns for each of plural accompaniment components, each of said components being composed of one or more musical instrument parts for an accompaniment performance;

selection means for, for each of said components, selecting a desired accompaniment pattern from among the plural accompaniment patterns, said selection means including a selecting operator;

readout means for reading out, from said accompaniment pattern storage means, the accompaniment pattern of any of said components selected by said selection means, wherein said plural accompaniment patterns of each said component correspond, in accordance with a predetermined rule, to different possible operated modes of said selecting operator, and said readout means selectively reads out one of the accompaniment patterns that corresponds to an actually operated mode of said selecting operator;

accompaniment tone generation means for generating automatic accompaniment tones on the basis of the accompaniment pattern read out by said readout means; and display means for displaying information indicative of the predetermined rule corresponding to said specific accompaniment pattern read out by said readout means.

7. An automatic accompaniment device as defined in claim 6 wherein the information displayed by said display means indicates said predetermined rule in numerical value or in graphic form.

8. An automatic accompaniment device comprising:

accompaniment pattern storage means for, with respect to plural accompaniment styles, storing plural accompaniment patterns for each of plural accompaniment components belonging to plural accompaniment styles, each of said components being composed of one or more musical instrument parts for an accompaniment performance, specific ones of said accompaniment patterns stored in said accompaniment pattern storage means being shared between the plural accompaniment styles;

selection means for, for each of said components, selecting a desired accompaniment pattern from among the plural accompaniment patterns, said selection means including a selecting operator;

readout means for reading out, from said accompaniment pattern storage means, the accompaniment pattern of any of said components selected by said selection means, wherein said plural accompaniment patterns of each said component correspond, in accordance with a predetermined rule, to different possible operated modes of said selecting operator, and said readout means selectively reads out one of the accompaniment patterns that corresponds to an actually operated mode of said selecting operator; and accompaniment tone generation means for generating automatic accompaniment tones on the basis of the accompaniment pattern read out by said readout means.

9. An automatic accompaniment device comprising:

accompaniment pattern storage means for storing plural accompaniment patterns for each of plural accompaniment components, each of said components being composed of one or more musical instrument parts for an accompaniment performance;

component designating operators for designating a desired one of the components;

a pattern selecting operator provided separately from said component designating operators, for selecting a desired one of the plural accompaniment patterns of the component designated by any of said component designating operators;

readout means for reading out, from said accompaniment pattern storage means, the accompaniment pattern corresponding to operation of said component designating operator and said pattern selecting operator; and accompaniment tone generation means for generating automatic accompaniment tones on the basis of the accompaniment pattern read out by said readout means;

wherein said pattern selecting operator generates an output successively varying in value as said pattern selecting operator is operated in a successive manner.

10. An automatic accompaniment device as defined in claim in claim 9 wherein, when any of said component designating operators is operated to designate desired one of the components, said readout means reads out one of the accompaniment patterns of the desired component which is selected on the basis of the output of said pattern selecting operator being generated at that time.

11. An automatic accompaniment device comprising:

accompaniment pattern storage means for storing plural accompaniment patterns for each of plural accompaniment components, each of said components being composed of one or more musical instrument parts for an accompaniment performance;

a selecting operator for selecting desired one of the accompaniment patterns for each of said components, said selecting operator outputting a pattern selection signal by being operated;

readout means for reading out, from said accompaniment pattern storage means, one of the accompaniment patterns for each of said components on the basis of the pattern selection signal output from said selecting operator, wherein said pattern selection signal being used as a relative value, and current pattern selection information is created by performing arithmetic operation between a value of last pattern selection information created when one of said accompaniment patterns was selected last and a value of the current pattern selection signal, said one of the accompaniment patterns being selected on the basis of the current pattern selection information; and accompaniment tone generation means for generating automatic accompaniment tone on the basis of the accompaniment pattern read out by said readout means.

12. An automatic accompaniment device comprising:

accompaniment pattern storage means for storing plural accompaniment patterns for each of plural accompaniment components, each of said components being composed of one or more musical instrument parts for an accompaniment performance;

setting means for setting, as unavailable for readout, any of said accompaniment patterns stored in said storage means;

selection means for selecting desired one of said accompaniment patterns for each of the components;

readout means for reading out, from said accompaniment pattern storage means, the accompaniment pattern selected by said selection means, said readout means being controlled so as not to read out said accompaniment pattern set as unavailable for readout by said setting means; and accompaniment tone generation means for generating automatic accompaniment tone on the basis of the accompaniment pattern read out by said readout means.

13. An automatic accompaniment device as defined in claim 12 wherein said setting means includes means for, with respect to each of said plural accompaniment patterns, storing information indicating whether said accompaniment pattern is selectable or not.

14. An automatic accompaniment device comprising:

accompaniment pattern storage means for storing plural accompaniment patterns for each of plural accompaniment components, each of said components being composed of one or more musical instrument parts for an accompaniment performance;

selection means for selecting desired one of the accompaniment patterns for each of said components;

designation means for designating a predetermined part in said accompaniment pattern selected by said selection means;

readout means for reading out, from said accompaniment pattern storage means, said desired accompaniment pattern in correspondence to selection of said selection means and designation of said designation means; and accompaniment tone generation means for generating automatic accompaniment tone on the basis of the accompaniment pattern read out by said readout means.

15. An automatic accompaniment device as defined in claim 14 wherein said predetermined part designated by said designation means corresponds to a desired percussion instrument sound among plural percussion instrument sounds constituting the accompaniment pattern selected by said selection means.

16. An automatic accompaniment device as defined in claim in claim 14 wherein said predetermined part designated by said designation means corresponds to a predetermined timing range in the accompaniment pattern selected by said selection means.

17. An automatic accompaniment device as defined in claim in claim 14 which further comprises means for, in response to selection of said selection means and designation of said designation means, registering a part of the accompaniment pattern read out by said readout means from said storage means into said storage means as a new accompaniment pattern.

18. An automatic accompaniment device comprising:

accompaniment pattern storage means for storing plural accompaniment patterns for each of plural accompaniment components, each of said components being composed of one or more musical instrument parts for an accompaniment performance;

selection means for selecting desired one of the accompaniment patterns for each of said components;

readout means for reading out, from said accompaniment pattern storage means, the accompaniment pattern selected by said selection means;

replacement means for replacing a predetermined percussion instrument sound of plural percussion instrument sounds constituting said accompaniment pattern read out by said readout means, with another percussion instrument sound; and accompaniment tone generation means for generating automatic accompaniment tones on the basis of the accompaniment pattern that is read out by said readout means and has the predetermined percussion instrument sound replaced with the other percussion instrument sound.

19. An automatic accompaniment device comprising:

accompaniment pattern storage means for storing plural accompaniment patterns for each of plural accompaniment components, each of said components being composed of one or more musical instrument parts for an accompaniment performance;

retrieval condition designating means for designating a predetermined retrieval condition based on distinct performance characteristics of individual ones of said plural accompaniment patterns;

readout means for reading out, from said accompaniment pattern storage means, any of said accompaniment patterns which satisfies the retrieval condition designated by said retrieval condition designating means; and accompaniment tone generation means for generating automatic accompaniment tones on the basis of the accompaniment pattern read out by said readout means.

20. An automatic accompaniment device as defined in claim 19 which further comprises selection means for selecting desired one of the accompaniment patterns for each of said components, and wherein said readout means reads out the accompaniment pattern selected by said selection means, from among any of said accompaniment patterns satisfying said retrieval condition.

21. An automatic accompaniment device comprising:

accompaniment pattern storage means for storing plural accompaniment patterns for each of plural accompaniment components, each of said components being composed of one or more musical instrument parts for an accompaniment performance;

pattern input means for inputting a desired accompaniment pattern;

readout means for selectively reading out, from said accompaniment pattern storage means, any of said accompaniment patterns that is close to the accompaniment pattern input by said pattern input means; and accompaniment tone generation means for generating automatic accompaniment tone on the basis of the accompaniment pattern read out by said readout means.

22. An automatic accompaniment device as defined in claim 21 which further comprises selection means for selecting desired one of the accompaniment patterns for each of said components, and wherein said readout means reads out the accompaniment pattern selected by said selection means, from among said accompaniment pattern close to the accompaniment pattern input by said pattern input means.

23. An automatic accompaniment device comprising:

accompaniment pattern storage means for storing plural accompaniment patterns for each of plural accompaniment components, each of said components being composed of one or more musical instrument parts for an accompaniment performance;

selection means for selecting a desired one of the accompaniment patterns for each of said components;

first readout means for reading out, from said accompaniment pattern storage means, the accompaniment pattern selected by said selection means;

second readout means for reading out, from said accompaniment pattern storage means, the plural accompaniment patterns in predetermined order; and accompaniment tone generation means for generating automatic accompaniment tone on the basis of one of the accompaniment patterns read out by said first or second readout means.

24. An automatic accompaniment device as defined in claim 23 which further comprises means for selecting desired one of the accompaniment patterns read out by said second readout means and reserving information indicative of the selected accompaniment pattern.

25. A method for providing automatic accompaniment comprising:

storing plural accompaniment patterns in a memory for each of plural accompaniment components, each of said components being composed of one or more musical instrument parts for an accompaniment performance;

selecting a desired accompaniment pattern from among the plural accompaniment patterns for each of said components by operation of a selecting operator;

reading out from said memory the accompaniment pattern of any of said components selected by said operation of said selecting operator, wherein said plural accompaniment patterns of each said component correspond, in accordance with a predetermined rule, to different possible operated modes of said selecting operator, and selectively reading out one of the accompaniment patterns that corresponds to an actually operated mode of said selecting operator;

generating automatic accompaniment tones on the basis of the accompaniment pattern read out; and registering a desired accompaniment pattern into said memory in accordance with the predetermined rule.

26. A method for providing automatic accompaniment comprising:

storing in an accompaniment pattern memory plural accompaniment patterns for each of plural accompaniment components belonging to plural accompaniment styles, each of said components being composed of one or more musical instrument parts for an accompaniment performance, specific ones of said accompaniment patterns stored in said accompaniment pattern memory being shared between the plural accompaniment styles;

selecting a desired accompaniment pattern for each of said components from among the plural accompaniment patterns by operation of a selecting operator;

reading out from said accompaniment pattern memory the accompaniment pattern of any of said components selected by operation of said selecting operator, wherein said plural accompaniment patterns of each said component correspond, in accordance with a predetermined rule, to different possible operated modes of said selecting operator, and selectively reading out one of the accompaniment patterns that corresponds to an actually operated mode of said selecting operator; and generating automatic accompaniment tones on the basis of the accompaniment pattern read out from said accompaniment pattern memory.

* * * * *